US007274794B1

(12) United States Patent
Rasmussen

(10) Patent No.: US 7,274,794 B1
(45) Date of Patent: Sep. 25, 2007

(54) SOUND PROCESSING SYSTEM INCLUDING FORWARD FILTER THAT EXHIBITS ARBITRARY DIRECTIVITY AND GRADIENT RESPONSE IN SINGLE WAVE SOUND ENVIRONMENT

(75) Inventor: Erik Witthoefft Rasmussen, Denmark (DK)

(73) Assignee: Sonic Innovations, Inc., Salt Lake City, UT (US)

( * ) Notice: Subject to any disclaimer, the term of this patent is extended or adjusted under 35 U.S.C. 154(b) by 898 days.

(21) Appl. No.: 09/927,771

(22) Filed: Aug. 10, 2001

(51) Int. Cl.
*H04R 3/00* (2006.01)

(52) U.S. Cl. ..... 381/92

(58) Field of Classification Search ..... 381/92
See application file for complete search history.

(56) References Cited

U.S. PATENT DOCUMENTS

| | | | | |
|---|---|---|---|---|
| 3,057,960 | A | 10/1962 | Kaiser | 179/1 |
| 4,589,137 | A | 5/1986 | Miller | 381/94 |
| 4,628,529 | A | 12/1986 | Borth et al. | 381/94 |
| 4,750,207 | A | 6/1988 | Gebert et al. | 381/68.4 |
| 4,759,071 | A | 7/1988 | Heide | 381/68.4 |
| 4,802,227 | A | 1/1989 | Elko et al. | 381/92 |
| 4,837,832 | A | 6/1989 | Fanshel | 381/68.4 |
| 5,097,510 | A | 3/1992 | Graupe | 381/47 |
| 5,170,434 | A | 12/1992 | Anderson | 381/68 |
| 5,263,019 | A | 11/1993 | Chu | 370/32.1 |
| 5,285,502 | A | 2/1994 | Walton et al. | 381/94 |
| 5,289,544 | A | 2/1994 | Franklin | 381/68.1 |
| 5,305,307 | A | 4/1994 | Chu | 370/32.1 |
| 5,347,496 | A | 9/1994 | Clark et al. | 367/140 |
| 5,412,735 | A | 5/1995 | Engebretson et al. | 381/94 |
| 5,473,684 | A | 12/1995 | Bartlett et al. | 379/387 |
| 5,473,701 | A | 12/1995 | Cezanne et al. | 381/92 |
| 5,511,128 | A | 4/1996 | Lindemann | 381/92 |
| 5,553,134 | A | 9/1996 | Allen et al. | 379/387 |
| 5,586,191 | A * | 12/1996 | Elko et al. | 381/92 |
| 5,602,962 | A | 2/1997 | Kellermann | 395/2.35 |

(Continued)

FOREIGN PATENT DOCUMENTS

| | | |
|---|---|---|
| DE | 195 40 795 | 5/1997 |

(Continued)

OTHER PUBLICATIONS

Greenberg, Julie E. et al., "Evaluation of an adaptive beamforming method for hearing aids", *J. Acoust. Soc. Am.* 91:3, pp. 1662-1676 (Mar. 1992).

(Continued)

*Primary Examiner*—Brian T. Pendleton
(74) *Attorney, Agent, or Firm*—Holland & Hart

(57) ABSTRACT

A sound processing system including at least one microphone, an audio processor, and at least one output device. The audio processor includes an analog beamformer, a microphone equalizer, and an apparent incidence processor. Two different embodiments of the apparent incidence processor are disclosed, that is, a wave generation method and a forward filtering method. Both embodiments use the same principles to estimate the properties of the individual waves of the sound field. With the present invention, it is possible to implement arbitrary directivity responses using a small number of microphones only, that is, two or three microphones. The present invention offers improved noise reduction also for environments with many independent noise sources. Furthermore, the present invention works for signals and noises with arbitrary statistics.

24 Claims, 36 Drawing Sheets

U.S. PATENT DOCUMENTS

| | | | | |
|---|---|---|---|---|
| 5,648,936 | A | 7/1997 | Clark et al. | 367/13 |
| 5,651,071 | A | 7/1997 | Lindemann et al. | 381/68.2 |
| 5,677,987 | A | 10/1997 | Seki et al. | 395/2.35 |
| 5,680,467 | A | 10/1997 | Hansen | 381/68.2 |
| 5,689,572 | A | 11/1997 | Ohki et al. | 381/71.3 |
| 5,694,474 | A | 12/1997 | Ngo et al. | 381/66 |
| 5,706,394 | A | 1/1998 | Wynn | |
| 5,825,898 | A | 10/1998 | Marash | 381/92 |
| 5,836,790 | A | 11/1998 | Barnett | 439/620 |
| 5,978,490 | A * | 11/1999 | Choi et al. | 381/92 |
| 6,023,514 | A | 2/2000 | Strandberg | 381/94.7 |
| 6,157,403 | A | 12/2000 | Nagata | 348/171 |
| 6,160,757 | A | 12/2000 | Tager | 367/119 |
| 6,272,229 | B1 | 8/2001 | Backgaard | 381/313 |
| 6,317,703 | B1 | 11/2001 | Linsker | 702/190 |
| 6,351,529 | B1 | 2/2002 | Holeva | |
| 6,549,630 | B1 | 4/2003 | Bobisuthi | 381/94.7 |
| 6,738,481 | B2 * | 5/2004 | Krasny et al. | 381/94.1 |
| 7,046,812 | B1 * | 5/2006 | Kochanski et al. | 381/92 |
| 2001/0038699 | A1 | 11/2001 | Hou | 381/92 |

FOREIGN PATENT DOCUMENTS

| | | |
|---|---|---|
| EP | 0 679 044 A2 | 10/1995 |
| EP | 0 795 851 | 9/1997 |
| EP | 0 831 458 | 3/1998 |
| EP | 0 883 325 | 12/1998 |
| EP | 0 942 628 | 9/1999 |
| EP | 1 091 615 | 4/2001 |
| EP | 1 065 909 A2 | 1/2002 |
| GB | 2 202 942 | 10/1988 |
| JP | 9-146443 | 6/1997 |
| JP | 11-18191 | 1/1999 |
| JP | 2000-47699 | 2/2000 |
| WO | WO 95/08248 | 3/1995 |
| WO | 95/34983 | 12/1995 |
| WO | WO 97/29614 | 8/1997 |
| WO | WO 97/50186 | 12/1997 |
| WO | WO 98/47227 | 10/1998 |
| WO | WO 99/04598 | 1/1999 |
| WO | WO 99/09786 | 2/1999 |
| WO | WO 99/39497 | 8/1999 |
| WO | 99/45741 | 9/1999 |
| WO | WO 99/52211 | 10/1999 |
| WO | WO 99/53336 | 10/1999 |
| WO | WO 00/19770 | 4/2000 |
| WO | WO 00/33634 | 6/2000 |
| WO | WO 00/41436 | 7/2000 |
| WO | 01/10169 | 2/2001 |
| WO | WO 01/69968 | 9/2001 |
| WO | WO 01/72085 | 9/2001 |
| WO | 03/015459 A3 | 2/2003 |
| WO | 03/015460 A3 | 2/2003 |

OTHER PUBLICATIONS

Kollmeier, B. et al., "Binaural Noise-Reduction Hearing Aid Scheme with Real-Time Processing in the Frequency Domain", *Scand Audiol* Suppl. 38, pp. 28-38 (1993).

Kollmeier, Birger et al., "Real-time multiband dynamic compression and noise reduction for binaural hearing aids", *Journal of Rehabilitation Research and Development*, vol. 30: 1, pp. 82-94 (1993).

Wittkop, Thomas et al., "Speech Processing for Hearing Aids: Noise Reduction Motivated by Models of Binaural Interaction", *ACUSTICA—acta acustica*, vol. 83, pp. 684-699 (1997).

Hanson et al., "Cascade Sample Matrix Inversion Arrays", 1990, IEEE, pp. 36.5.1-36.5.5 (in French).

Kellermann, Walter, "A Self-Steering Digital Microphone Array", 1991, IEEE, pp. 3581-3584.

Lleida et al., "Robust Continuous Speech Recognition System Based on a Microphone Array", 1998, IEEE, pp. 241-244.

Mahmoudi, Djarnila, "Speech Source Localization Using A Multi-Resolution Technique", 1998, IEEE, pp. 161-165.

Zhang et al., "Adaptive Beamforming By Microphone Arrays", 1995, IEEE, pp. 163-167.

International Search Report based on PCT/EP02/09022, dated Sep. 8, 2003.

International Search Report based on PCT/EP02/09031, dated Sep. 8, 2003.

International Search Report based on PCT/EP02/09030, dated Sep. 22, 2003.

Written Opinion based on PCT/EP02/09031, dated Nov. 27, 2003.

Written Opinion based on PCT/EP02/09030, dated Dec. 3, 2003.

Greenberg, Julie E., et al., "Evaluation of an Adaptive Beamforming Method for Hearing Aids"; J. Acoustical Society of America, vol. 91, No. 3 (Mar. 1992): pp. 1662-1676.

Kollmeier, B., et al., "Binaural Noise-Reduction Hearing Aid Scheme with Real-Time Processing in the Frequency Domain"; Scand Audiol (1993); Suppl. 38: pp. 28-38.

Kollmeier, Birger, et al., "Real-time Multiband Dynamic Compression and Noise Reduction for Binaural Hearing Aids"; Journal of Rehabilitation Research and Development, vol. 30 No. 1 (1993): pp. 82-94.

Wittkop, Thomas, et al., "Speech Processing for Hearing Aids: Noise Reduction Motivated by Models of Binaural Interaction"; ACUSTICA—acta acustica, vol. 83 (1997): pp. 684-699.

* cited by examiner

SOUND PROCESSING SYSTEM INCLUDING FORWARD FILTER THAT EXHIBITS ARBITRARY DIRECTIVITY AND GRADIENT RESPONSE IN SINGLE WAVE SOUND ENVIRONMENT

STATEMENT OF RELATED APPLICATIONS

This disclosure is related to: (1) U.S. patent application Ser. No. 09/927,784 filed on even date herewith and entitled "SOUND PROCESSING SYSTEM INCLUDING FORWARD FILTER THAT EXHIBITS ARBITRARY DIRECTIVITY AND GRADIENT RESPONSE IN MULTIPLE WAVE SOUND ENVIRONMENT" in the name of Erik W. Rasmussen, and commonly assigned herewith; (2) U.S. patent application Ser. No. 09/927,783 filed on even date herewith and entitled "SOUND PROCESSING SYSTEM INCLUDING WAVE GENERATOR THAT EXHIBITS ARBITRARY DIRECTIVITY AND GRADIENT RESPONSE" in the name of Erik W. Rasmussen, and commonly assigned herewith; and (3) U.S. patent application Ser. No. 09/928,229 filed on even date herewith and entitled "SOUND PROCESSING SYSTEM THAT EXHIBITS ARBITRARY GRADIENT RESPONSE" in the name of Erik W. Rasmussen, and commonly assigned herewith.

FIELD OF THE INVENTION

The present invention relates generally to audio signal processing. More specifically, the present invention relates to an audio processing system that exhibits an arbitrary directivity and gradient response.

BACKGROUND OF THE INVENTION

There are many instances where it is desirable to have a system capable of receiving information from a particular signal source where the environment includes sources of interference signals at locations different from that of the information signal source. For discussion purposes, the specific instances will be generalized to the extent possible. Turning first to FIG. 1, a block diagram of a sound processing system 10 is shown. The system 10 includes at least one microphone 12 that picks up sounds from a sound field in which it is located and converts these sounds to electrical signals. In the present case, a plurality of microphones are depicted and the microphones are numbered from one to N1. The electrical signals from the microphones 12 are preferably input to an audio processor 14. The sounds are to be reproduced by one or more output devices 16 such as loudspeakers, earphones, and the like. The sound can optionally pass through transmission channels or additional processing before arriving at the output device 16. It may even be recorded and played back before arriving at the output device 16.

In general, the sound field into which the system 10 is placed contains not only the sounds to be picked up, referred to as a utility signal, but also unwanted sounds, referred to as noise or noise signals. In these situations, it is desirable to process the signals picked up by the microphones 12 in order to reduce the noise contents electronically. There are several conventional methods for reducing the noise electronically through the audio processor 14. One is known as static beamforming where the signals from two or more microphones are passed through filters and combined to form a single signal. The resulting signal will show a sensitivity to sounds that depends upon the direction of the sound incidence as compared to the direction of the microphone assembly. The directivity response will take the form of one or more beams. Due to the fact that the lobes of the directivity response have different magnitudes, the beamformer will show a signal to noise improvement when the beam is oriented so that the utility signal falls within the main lobe and the main part of the noise falls outside the main lobe. Static beamformers have the disadvantage that, in order to provide substantial noise reduction under general noise conditions, a large number of microphones are required.

Another conventional method is known as adaptive beamforming which is achieved when the filters of a beamformer are variable and controlled by an adaptation process. Normally such an adaptation process works to minimize the output signal power. An adaptive beamformer can track noise sources and dynamically adjust the directivity response such that the sensitivity at the direction of the noise incidence is minimized while keeping the sensitivity at the utility direction high. Currently known adaptive beamformers show the disadvantage that they are only capable of tracking a limited number of noise sources, mostly only a single. Furthermore adaptive beamformers work with a fairly large time constant in the adaptation process. Therefore they are only able to track quasi-static noise sources.

Yet other conventional methods apply only to a single microphone multiband noise reduction situation, that is, spectral subtraction. When only a single microphone signal is available, it is not possible to obtain information as to the direction of sound incidence from the microphone signal and it is therefore not possible to perform beamforming as above. Still a reduction of the noise contents can be achieved under these circumstances. Such methods all rely on dividing the signal into a number of frequency bands. In each band the signal is analyzed statistically to derive measures of the utility signal and noise content. Based on these measures a band gain is derived and applied that amplifies bands with utility signal contents while attenuating bands with noise contents. Unfortunately, the statistical analysis requires long time constants. Therefore the single microphone methods are limited to a sound field with stationary noise signals and non-stationary utility signals.

Further conventional methods are known that use two microphones and analyze the microphone signal contents to derive and apply a gain in frequency bands. The gain is a function of how the microphone signals relate to each other. The known methods have the disadvantage that they only work when the signal in each frequency band consists of either utility signal or noise and not when a combination of utility signal and noise is present.

By contrast to the conventional methods above, the present invention uses a different approach to the problem. It uses the general equations for sound fields to analyze the microphone signals and find required properties of one or more components or waves contained in the input signals. The desired properties can for example be the direction of sound incidence or the pressure gradient of the impinging waves. The incoming waves are amplified with a gain function based on these properties, that is, the directivity or the gradient. Based on the amplified waves an output signal is generated either by synthesizing the amplified waves or by applying filtering to an input signal combination. The present invention can operate in a number of applications including hearing aids, directional microphones, microphone arrays, silicon microphone assemblies, headsets, hearing protectors, cordless phones, mobile phones, camcorders, personal computers, laptops, palmtops, and personal digital assistants, among others. In some embodiments, the present invention is especially suited to work with head worn microphones that pick up the speech signal of the wearer. In this application, the present invention offers a substantially improved noise reduction when compared to conventional solutions with comparable sound quality.

BRIEF DESCRIPTION OF THE INVENTION

A sound processing system including at least one microphone, an audio processor, and at least one output device is disclosed. The audio processor includes an analog beamformer, a microphone equalizer, and an apparent incidence processor. Two different embodiments of the apparent incidence processor are disclosed, that is, a wave generation method and a forward filtering method. Both embodiments use the same principles to estimate the properties of the individual waves of the sound field. With the present invention, it is possible to implement arbitrary directivity or gradient responses using a small number of microphones only, that is, two or three microphones. The present invention offers improved noise reduction also for environments with many independent noise sources. Furthermore, the present invention works for signals and noises with arbitrary statistics.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION

Embodiments of the present invention are described herein in the context of a sound processing system, including a forward filter, that exhibits an arbitrary directivity and gradient response in a single wave sound environment. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the specific goals of the developer, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In accordance with the present invention, the components, process steps, and/or data structures may be implemented using various types of operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein.

The figures and equations in this document will contain signals and variables that are vectors or matrices. Unless otherwise noted all operations on these vectors and matrices are to be interpreted as being performed element-by-element. For example, a multiplication of two vectors should, unless otherwise noted, be interpreted as an element-by-element multiplication and not as a vector multiplication. For the sake of clarity, the figures have been reduced to a minimum number of elements, however, as one of ordinary skill in the art will recognize, the number of elements will vary with the particular application.

Figure 1:
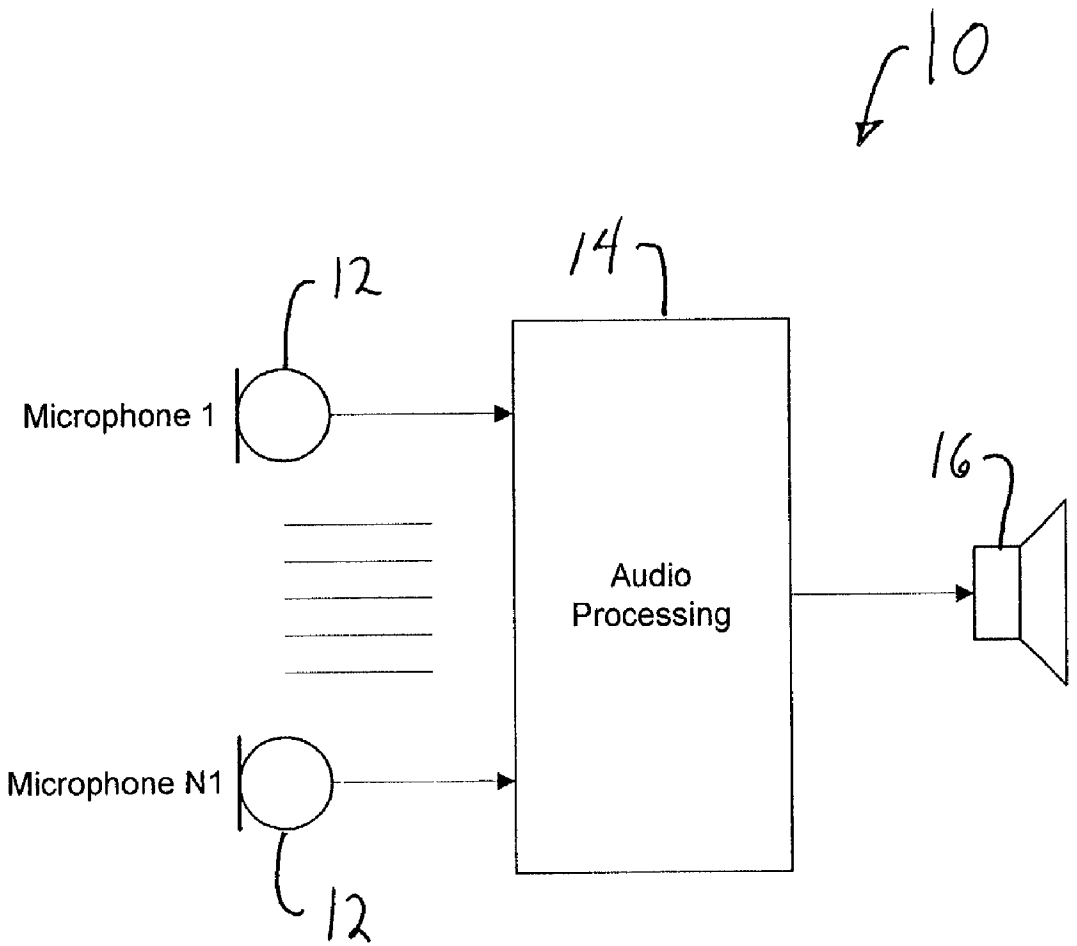
FIG. 1 is a block diagram of a sound processing system.
Figure 2:
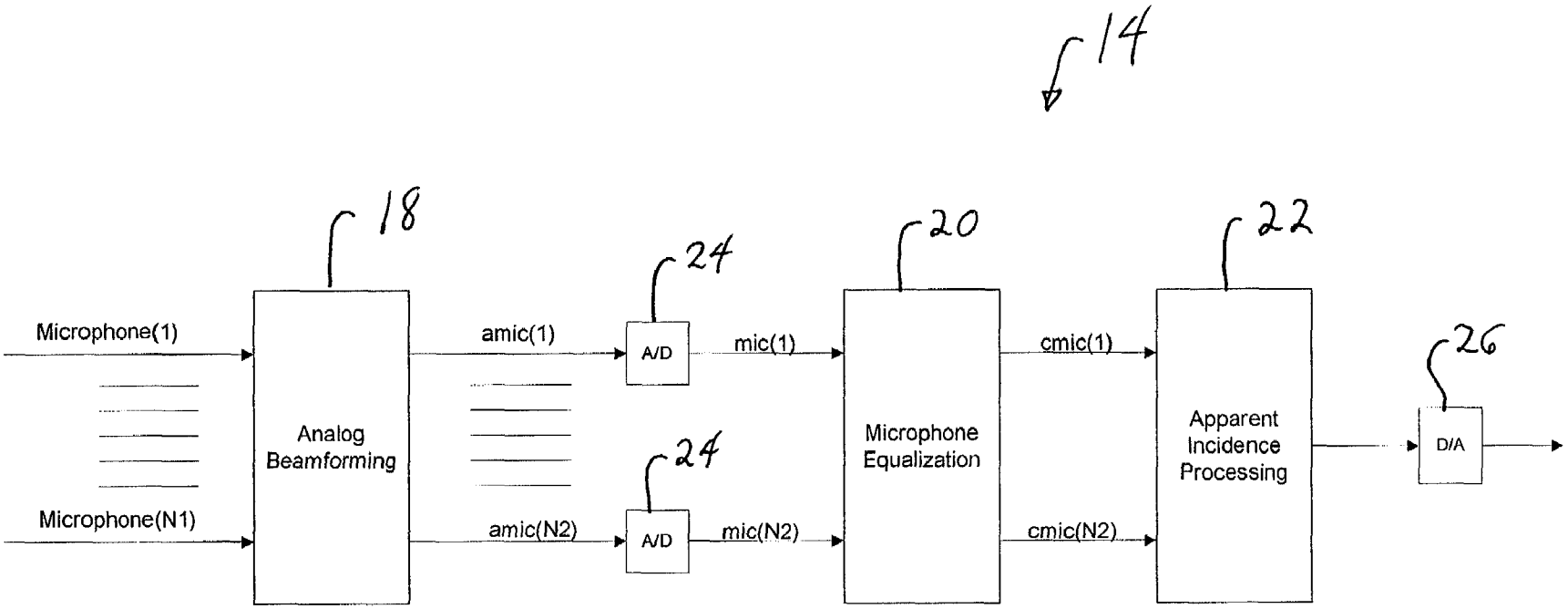
FIG. 2 is a block diagram according to a preferred embodiment of the present invention of the audio processor of FIG. 1.

Turning now to FIG. 2, a block diagram according to a preferred embodiment of the present invention of the audio processor 14 of FIG. 1 is shown. According to the present invention, the method of audio processing performed by the audio processor 14 will be referred to generally as apparent incidence audio processing. The audio processor 14 includes an analog beamformer 18, a microphone equalizer 20, and an apparent incidence processor 22. Below, two different embodiments of the apparent incidence processor 22 will be disclosed, that is, a wave generation method and a forward filtering method. Both embodiments use the same principles to estimate the properties of the individual waves of the sound field.

The method of apparent incidence processing involves complex signal operations. It is therefore possible that the processing will be performed with digital techniques. Thus the microphone signals will be converted to digital signals with at least one analog to digital (A/D) converter 24 and the output signal will be converted back to an analog signal, if needed, with a digital to analog (D/A) converter 26.

The analog beamformer 18 provides analog preprocessing according to conventional techniques of the microphone signals that enables the reduction of the resolution of all but one of the A/D converters 24. This can save size and reduce the power consumption. For hearing aids, for example, these properties are highly desirable. Depending on the circumstances however, the analog beamformer 18 may be deleted as unnecessary or too costly.

The method of apparent incidence processing requires, as generally do conventional beamformers, that the microphones 12 of FIG. 1 have sensitivities that are matched. The microphone equalizer 20 equalizes the signals from the microphones 12 according to conventional techniques. With this equalization, the functioning of the processing downstream will still be possible even if the microphones have different sensitivities and even when the microphone sensitivities change over time. Again, depending on the circumstances however, the microphone equalizer 20 may be deleted as unnecessary or too costly.

Figure 3:
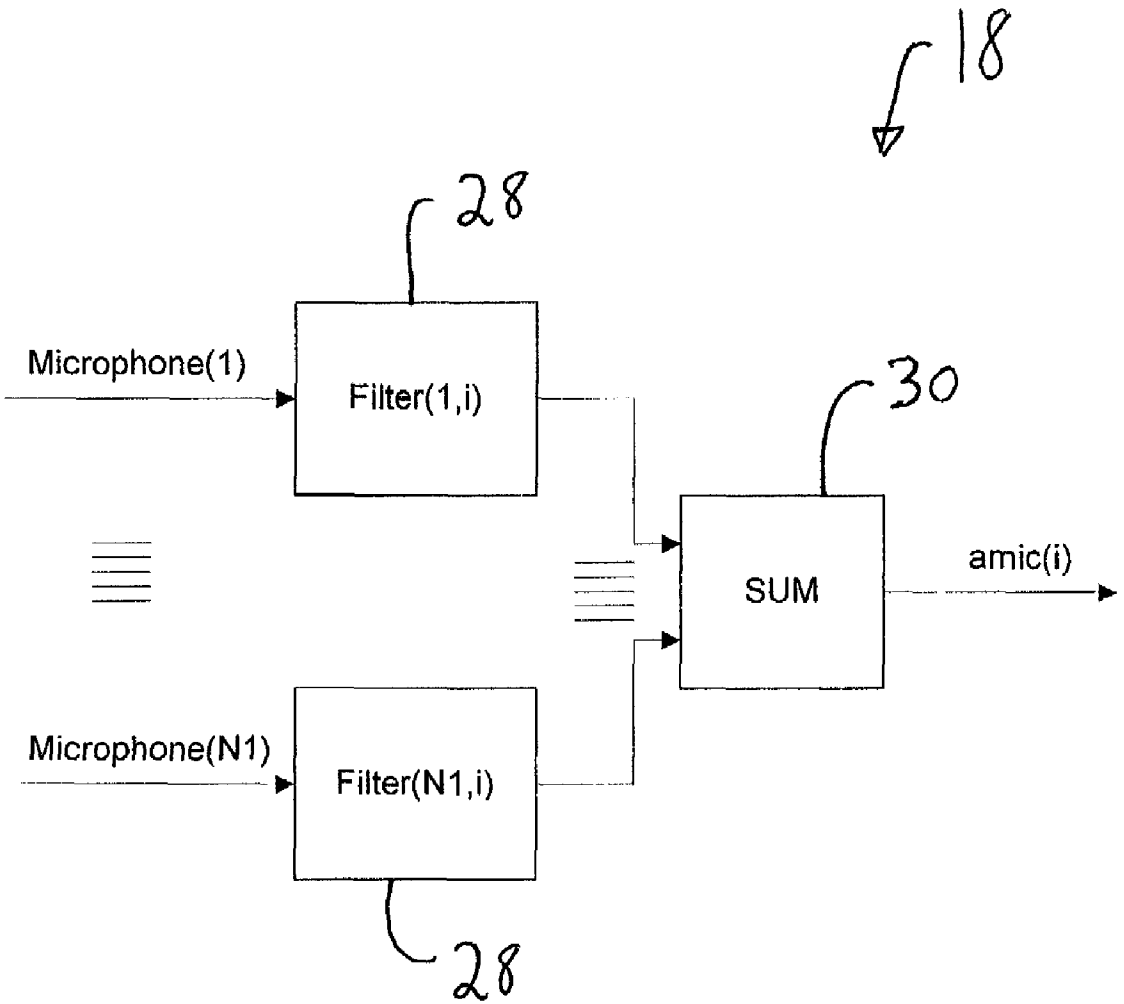
FIG. 3 is a block diagram of the analog beamformer of FIG. 2.

Turning now to FIG. 3, a block diagram of the analog beamformer 18 of FIG. 2 is shown. The analog beamformer 18 includes at least one filter 28 and a summing device 30. Each of the output beams of the analog beamformer 18 is derived as the sum of the filtered microphone signals. The variable i indexes the analog beam outputs. Each of the filters 28 will generally be different from microphone to microphone and from beam to beam.

In a embodiment, the beam amic(1), for example, is formed as the sum of all microphone inputs and the other beams are formed as the difference of a specific microphone signal and a reference microphone signal (Microphone(1)). The filter transfer functions in the laplace domain that implements such a beamforming are as shown in (1) below. In this way, as many analog beam outputs will be processed as there are microphone units, N1=N2. This analog beamforming is well suited for use with microphone arrays implemented as silicon transducers on a single piece of silicon with small transducer spacing.

$$(1)\begin{cases} Filter(j,1)=1 \text{ for all } j \\ Filter(i,i)=1 \text{ for } i\neq 1 \\ Filter(1,i)=-1 \text{ for } i\neq 1 \\ Filter(j,i)=0 \text{ for } j\neq i \wedge j,i>1 \end{cases}$$

With this beamforming, the generalized beam amic(i) will relate to the microphone signals as follows:

$$(2)\begin{cases} amic(1)=\sum_i Microphone(i) \\ amic(i)=Microphone(i)-Microphone(1) \text{ for } i>1 \\ N2=N1 \end{cases}$$

In another embodiment, all microphone signals are passed directly to the A/D converters without beamforming, amic (i)=Microphone(i), N2=N1.

In yet another embodiment, each of the filters, Filter(j,i), approximates different time delays of the microphone signals, that is, either inverting or non-inverting.

In a further embodiment, only two of the filters, Filters (j,i), for each beam i are present.

In yet a further embodiment, each of the beams amic(i) implements the same directivity using different microphone combinations.

In a still further embodiment, a variation of the last described, the microphones are placed equidistant along a common axis. The analog beamformer is defined according to (3) below. The numbering j of the microphones follows their placement along the common axis with number one being closest to the sound source. NB-1 is commonly referred to as the order of the directivity.

$$\begin{cases} Filter(j,i)=Filter(j+1,i+1) & \text{for all } j<N1-1,\ i<N2-1 \\ Filter(j,i)=0 & \text{for } j<i \vee j>i+NB \\ N2=N1-NB \end{cases} \quad (3)$$

Figure 4:
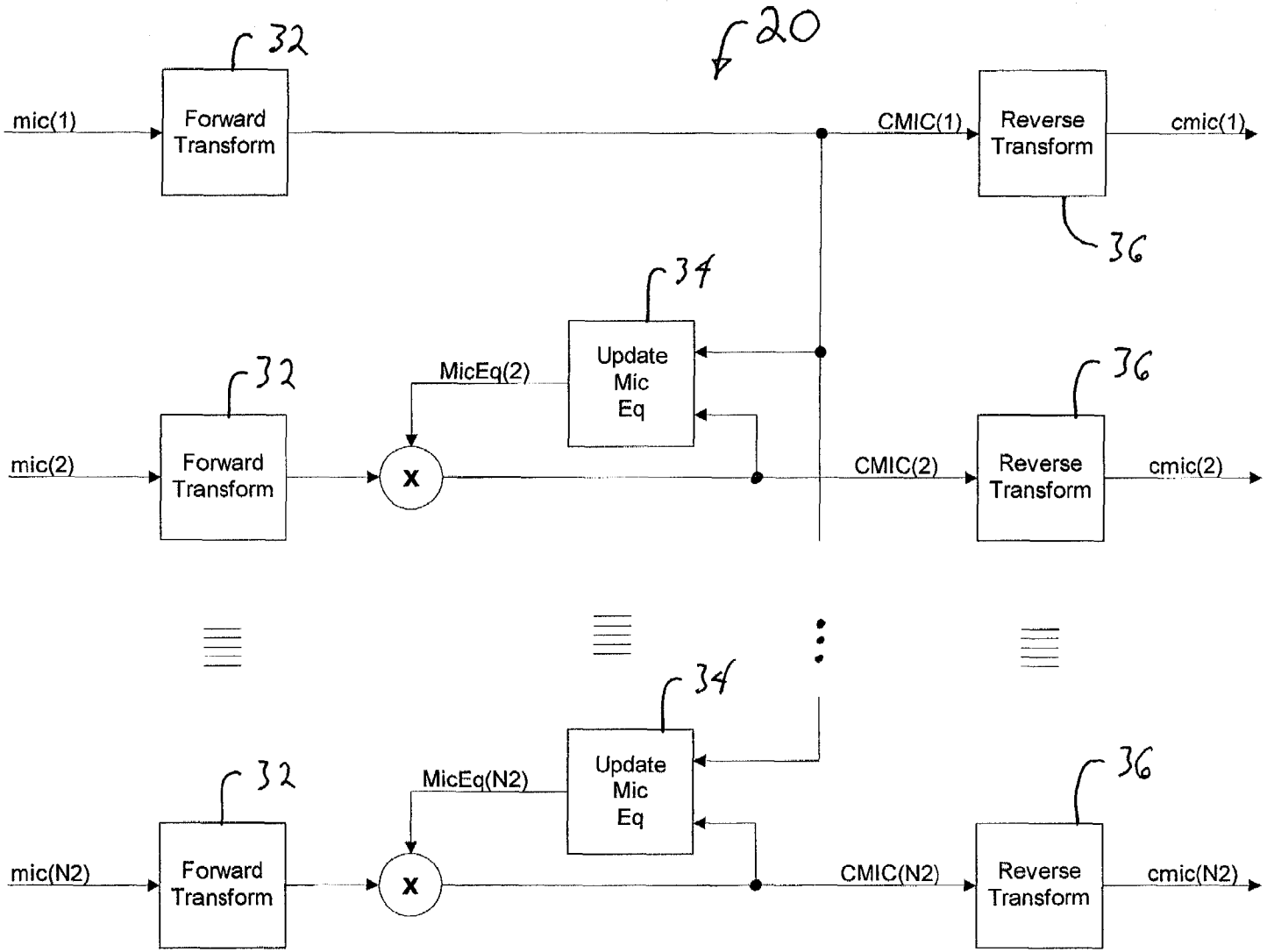
FIG. 4 is a block diagram of the microphone equalizer of FIG. 2.

Turning now to FIG. 4, a block diagram of the microphone equalizer 20 of FIG. 2 is shown. While the microphone equalizer 20 could be implemented in the time domain with a FIR or an IIR filter, the preferred scheme of FIG. 4 works in the frequency domain. The microphone signals (mic(1) to mic(N2)) are first converted to the frequency domain in a plurality of forward transformers 32. The equalization is then accomplished by multiplying, in the frequency domain, the microphone signals with at least one equalization function (MicEq(i)) generated by a microphone equalization updater 34. The equalized signals are finally converted back to the time domain in a plurality of reverse transformers 36.

To perform the equalization, one of the microphone signals is chosen as a reference. For convenience, the reference signal is referred to with index one, mic(1). This reference signal is by definition equalized and is thus passed through the processing of the microphone equalizer 20 unaltered. To provide for the necessary equalization, the equalization functions generated by the microphone equalization updater 34 should follow the definition of (4) below.

$$MicEq(i) \equiv \frac{S(1)}{S(i)} \tag{4}$$

In (4), S(1) is the sensitivity defined as the digital value at the input of the microphone equalizer 20 of FIG. 2 divided by the sound pressure of the reference microphone signal and S(i) is the corresponding sensitivity of the other microphones, respectively. All of the terms of (4) are implicit functions of frequency.

Figure 5:
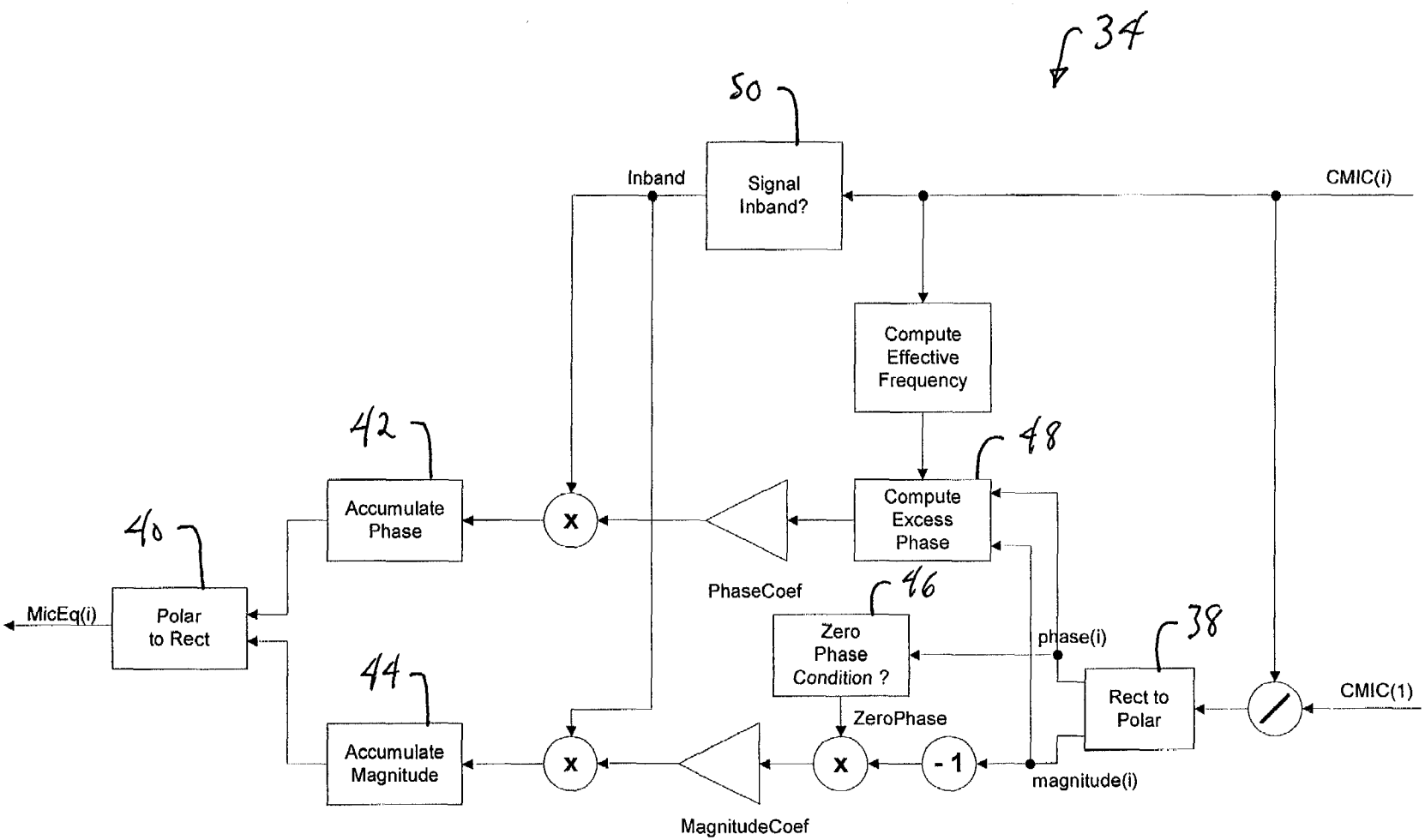
FIG. 5 is a block diagram of the microphone equalization updater of FIG. 4.

Turning now to FIG. 5, a block diagram of the microphone equalization updater 34 of FIG. 3 is shown. Some of the processing is done in a polar complex, that is, magnitude/phase, format so a rectangular to polar converter 38 and a polar to rectangular converter 40 are provided. The rest of the processing, except as noted, uses a rectangular, that is, real/imaginary, format for complex numbers. A phase accumulator 42 and a magnitude accumulator 44 hold the equalization response of the specific microphone (i). The response is updated at regular intervals by accumulating small updates to the phase and magnitude accumulators 42, 44, respectively. To derive the response updates, the current equalized spectrum, CMIC(1), of the reference channel is divided by the equalized spectrum, CMIC(i), of the respective channel. The quotient is converted to polar format as phase and magnitude in the rectangular to polar converter 38.

To derive a magnitude update, the phase of the quotient is analyzed in a zero phase condition detector 46. If the phase indicates that the sound incidence is from a direction and a distance for which the current microphone signal should have the same magnitude sensitivity as the reference microphone signal, then the zero phase condition detector 46 will output a logic one as a ZeroPhase output signal. If the phase condition does not hold, then the analyzer will output a logic zero. When the quotient magnitude minus one is gated with this ZeroPhase switch signal and scaled with a MagnitudeCoef coefficient, a magnitude update value is obtained that is suitable to use to update the magnitude accumulator 44 for the equalizing function.

To derive a phase update, both the phase and the magnitude of the quotient are analyzed. Under normal conditions, it will generally not be possible to derive any information regarding a misfit of the phase of the microphone equalization response. But once in a while, triggered by a specific input from a specific direction, the microphone signals will relate to each other in a way that can only be possible if the equalization response is incorrect. In a compute excess phase monitor 48, the signals are monitored and if such an "impossible condition" is found to exist the amount by which the phase is un-natural will be output as an excess phase signal. If the phase conditions are natural, the compute excess phase monitor 48 will output zero. As the excess phase conditions depend upon signal frequency, the compute excess phase monitor 48 estimates the frequency for its use. The phase update signal is scaled with the PhaseCoef coefficient.

To further improve the quality of the magnitude and phase update signals it is gated with an Inband signal output of a signal inband detector 50. The signal inband detector 50 outputs a logic one if the power in the current frequency band is contributed mainly by input contents of frequencies falling within the band. Conversely, the signal inband detector 50 outputs a logic zero if the contents are due mainly to input at frequencies outside of the band. It is widely known that most time-to-frequency transforms "spill" energy from the source band to neighboring bands due to windowing effects or similar mechanisms. However, only signals within the frequency band should be allowed to influence the equalizing value for a band. This differentiation is possible through the use of the Inband signal.

With the equalization processing described here, the equalization response will be updated dynamically. The phase and the magnitude of the equalization response will be regulated independently. Updating follow through statistical processes that rely on the noise-like nature of the signals that are most likely to be encountered as inputs to the audio processor, such as speech, machine noise, wind noise, and the like. The update signals will contain large noise components, therefore they are scaled with small coefficients, that is, PhaseCoef and MagnitudeCoef, respectively, such that the adaptation times are slow. The use of the coefficients prevents noise from entering the forward signals through the equalization processes.

In an embodiment, the phase and magnitude accumulators 42 and 44 are divided into static and dynamic parts, where the updates only influence the dynamic parts. The effective equalization response is the product of the static and dynamic parts.

In yet another embodiment, the static part of the equalization response is measured with standard measuring techniques once or regularly at the time of production test or at some other convenient times and saved.

In a further embodiment, a forgetting factor is included with the dynamic part of the accumulator. The forgetting factor causes the dynamic response to converge towards zero when no updates are received.

In yet a further embodiment, means are provided that can save the accumulated equalization response when the audio processor is powered down and read the saved response again when the processor is powered up the next time.

In a still further embodiment, the signals mic(i) are all omni directional and the zero phase condition detector 46 is implemented so as to compare the magnitude of the phase with a constant value. If the phase magnitude is smaller than the constant, then a logic one ZeroPhase signal is generated.

In another embodiment, the signals mic(i) are all omni directional and the compute excess phase monitor 48 generates the phase update signal according to (5) below. In (5),f(i) is the frequency as estimated by the compute excess phase monitor 48. In (5), a,f, and ExcessPhase are all vectors covering the frequency range of the frequency transformation used. The * operation in (5) denotes an element-by-element multiplication and not a vector multiply. d(i) is the physical spacing between Microphone(i) and the reference microphone, Microphone(1). c is the speed of sound. ∈ is a small positive constant.

$$\begin{cases} a(i) = 2*\pi*f(i)*\dfrac{d(i)}{c} \\ ExcessPhase(i) = \\ \begin{cases} 0 & \text{if } |phase(i)| < a(i) \vee |magnitude(i) - 1| > \varepsilon \\ phase(i) - a(i) & \text{if } phase(i) > a(i) \wedge |magnitude(i) - 1| < \varepsilon \\ phase(i) + a(i) & \text{if } phase(i) < -a(i) \wedge |magnitude(i) - 1| < \varepsilon \end{cases} \end{cases} \tag{5}$$

In still another embodiment, the center frequency, f(i), for the equalization is estimated as the center frequency of the band i.

In yet another embodiment, the frequency, f(i), for the equalization is estimated as in (6) below. In (6), k is the frequency band index, fc(k) is the center frequency of band k, BW(k) is the bandwidth of band k, and b is a positive constant.

$$f(k, i) = fc(k) + \left(\frac{|CMIC(k+1, i)| - |CMIC(k-1, i)|}{|CMIC(k+1, i)| + |CMIC(k-1, i)|}\right) \cdot \frac{BW(k)}{2} \cdot b \tag{6}$$

In a further embodiment, the signal inband detector 50 for each frequency band evaluates the absolute value of its input signal in the current band and the two nearest neighboring bands. If the current band carries the highest absolute value, then the Inband signal for the current band is generated as a logic one and otherwise it is generated as a logic zero.

Figure 6:
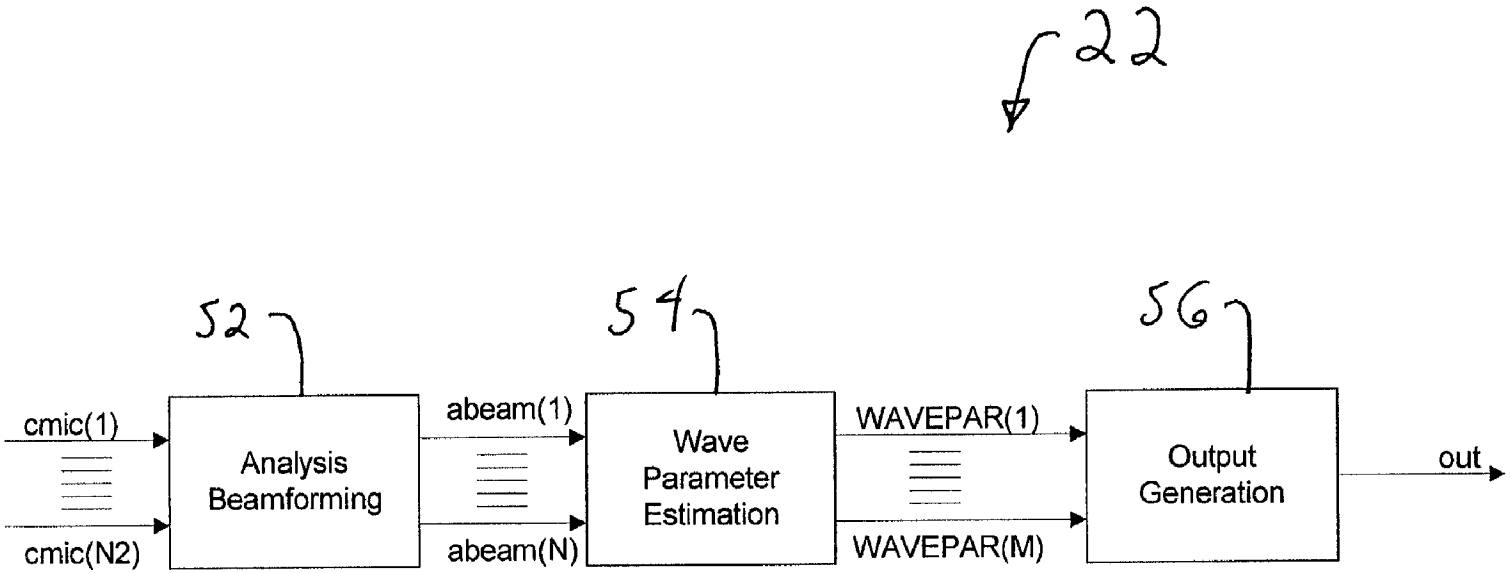
FIG. 6 is a block diagram according to a preferred embodiment of the present invention of the apparent incidence processor of FIG. 2.

Turning now to FIG. 6, a block diagram according to a preferred embodiment of the present invention of the apparent incidence processor 22 of FIG. 2 is shown. As noted above, two different embodiments of the apparent incidence processor 22 will be disclosed. In this case, the wave generation method is shown. The processing runs in three stages. First, analysis beamforming 52 is performed on the equalized microphone signals. Second, the parameters of the incoming sound waves are estimated in a wave parameter estimator 54. Finally, an output generator 56 produces a signal that contains the incoming waves modified in such a way that unwanted waves are attenuated by comparison to the utility waves.

Figure 7:
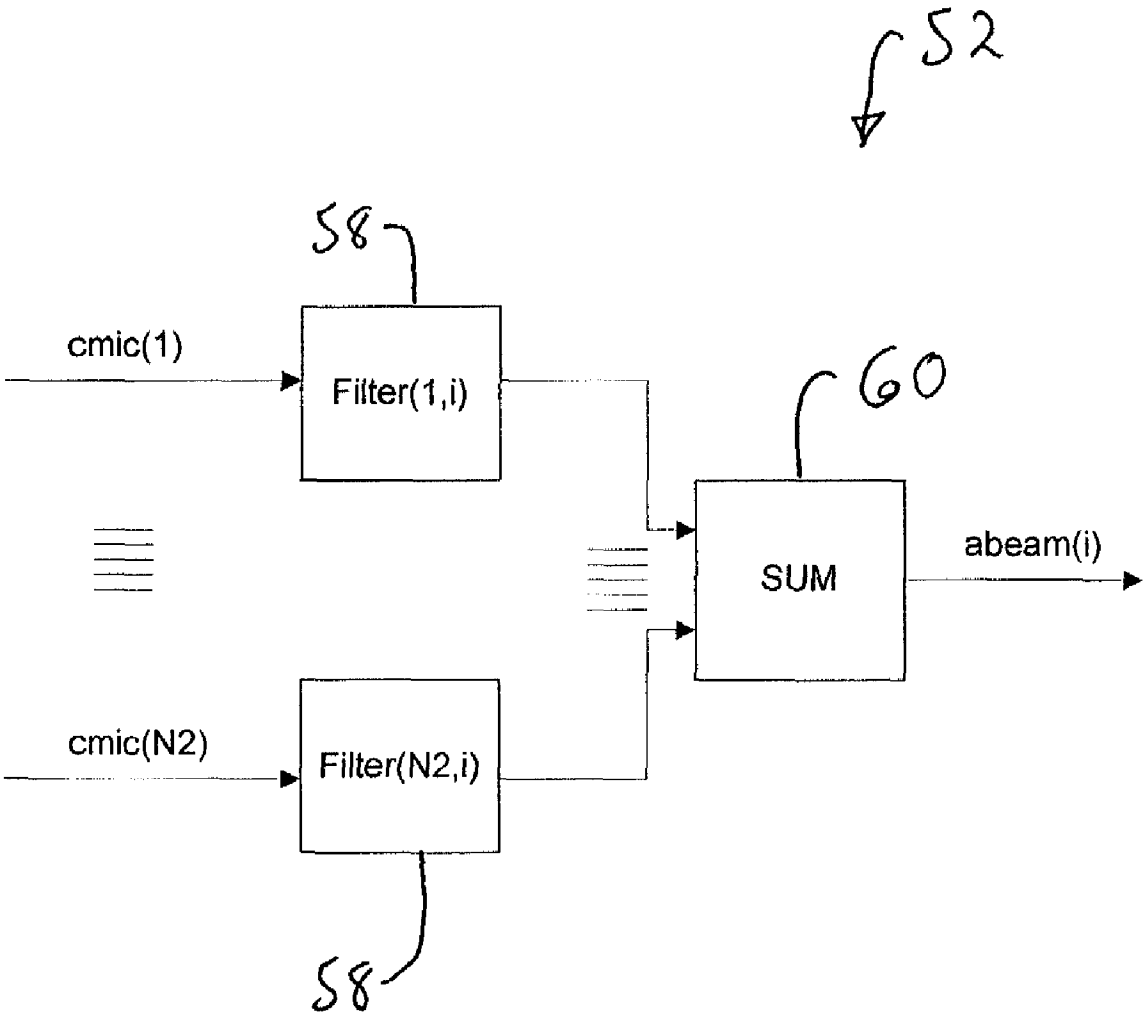
FIG. 7 is a block diagram of the analysis beamformer of FIG. 6.

Turning now to FIG. 7, a block diagram of the analysis beamformer 52 of FIG. 6 is shown. The analysis beamformer 52 is similar to the analog beamformer 18 of FIG. 3 described above but it works in the digital domain. The analysis beamformer 52 generates a plurality of abeam signals and for each signal it includes a plurality of filters 58 and a summing device 60. The analysis beamformer 52 serves, among other functions, to remove unwanted noise from the signal thus enhancing quality of the wave parameter estimation.

In an embodiment, analysis beamforming is not performed and thus the signals cmic(i) are directly copied to abeam(i) with N2=N.

Another embodiment is described with the set of filters described in (7) below.

$$\begin{cases} Filter(j, 1) = -\dfrac{1}{N2} & \text{for } j \neq 1 \\ Filter(1, i) = \dfrac{1}{N2} & \\ Filter(i, i) = \dfrac{N2-1}{N2} & \text{for } i \neq 1 \\ Filter(j, i) = -\dfrac{1}{N2} & \text{for } i \neq j \wedge i, j \neq 1 \\ N = N2 & \end{cases} \tag{7}$$

In yet another embodiment, the analysis beamforming of (7) is combined with the analog beamforming of (1) above. In such a combination, it can then be shown that the output of the analysis beamformer 52 will be estimates of the microphone outputs as described in (8) below.

$$\text{abeam}(i) = c_{AD}\text{Microphone}(i) \tag{8}$$

In (8), $c_{AD}$ is the A/D converter conversion gain. With this embodiment the sequence of the processing is preferably changed so that the analysis beamformer 52 precedes the microphone equalizer 20 of FIG. 2. In this way the microphone sensitivities are directly equalized.

In another embodiment, each of the filters 58, Filter(j,i), approximates different time delays of the microphone signals, that is, either inverting or non-inverting.

In yet another embodiment, the latest embodiment described is changed so that only two of the Filters(j,i) for each beam i are present.

In a further embodiment, each of the beams, abeam(i), implements the same directivity using different microphone combinations.

In yet a further embodiment, a variation of the last described, the microphones are placed equidistant along a common axis. In this case, the analysis beamformer 52 is defined according to (9) below. The numbering j of the microphones follows their placement along the common axis with number one being closest to the sound source. NB-1 is commonly referred to as the order of the directivity.

$$\begin{cases} Filter(j, i) = Filter(j+1, i+1) & \text{for all } j < N2-1, i < N1-1 \\ Filter(j, i) = 0 & \text{for } j < i \vee j > i + NB \\ N1 = N2 - NB & \end{cases} \tag{9}$$

In still another embodiment, the analysis beamforming is performed in frequency bands.

Figure 8:
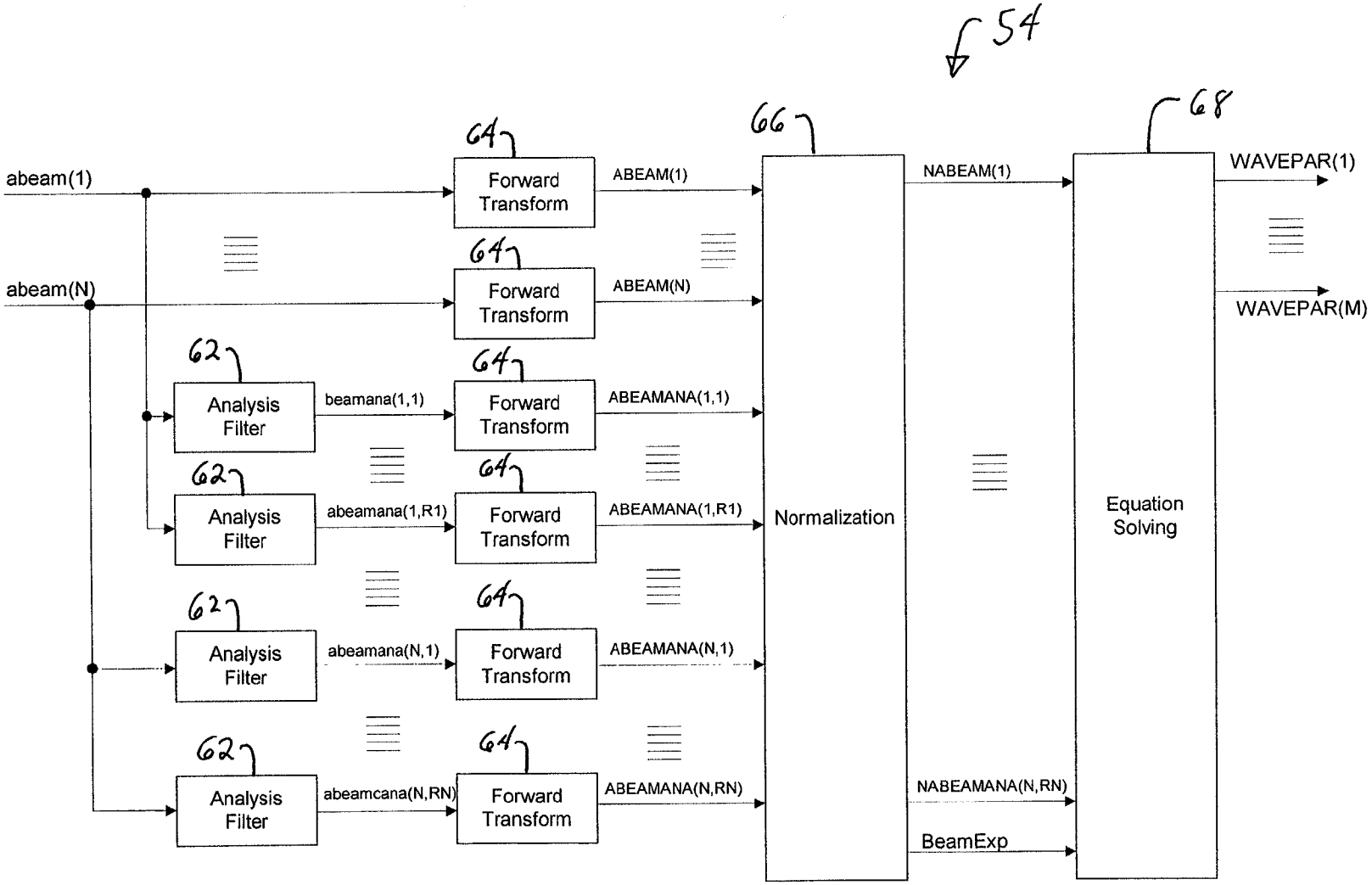
FIG. 8 is a block diagram of the wave parameter estimator of FIG. 6.

Turning now to FIG. 8, a block diagram of the wave parameter estimator 54 of FIG. 6 is shown. The wave parameter estimator 54 includes a plurality of analysis filters 62, a plurality of forward transformers 64, a normalizer 66, and an equation solver 68. The analysis filters 62 are optional and when implemented serve to create additional input signals to the equation solver 68 such that the individual components carry different weights. If the input consists of two or more sinusoidal waves of the same frequency, then it will not be possible to distinguish between the waves. However, if the waves carry different frequency content, then it will be possible to distinguish between the waves. Processing the input with filters of different magnitude responses, phase responses, or both creates additional information for the equation solver 68. The equation solver 68 is most efficiently implemented in the frequency domain. Therefore, if it has not been previously performed, the inputs are converted to the frequency domain in the forward transformers 64.

The equation solver 68 utilizes mathematical functions. Such functions can be included either through table look-up, Taylor-series approximation, or the like. In any case, the dynamic range of the functions may be limited due to hardware constraints. In order to gain maximal use of a limited mathematical dynamic range, the input signals are normalized in the normalizer 66. However normalization may not be necessary or desirable, in which case the normalizer 66 may be omitted. When implemented, the output from the normalizer 66 carries not only the normalized frequency domain signals but also information about the amount by which the signals have been normalized, an exponent, collected in the output signal BeamExp. This exponent enables the recovery of the absolute values from the normalized values. Each beam input and frequency may be equalized independently but the same exponent may also be used across all beams, frequencies, or both.

In an embodiment, the analysis filters 62 perform differentiation with respect to time. Note that differentiation with respect to time can be expressed in the frequency domain with the transfer function of (10) below. In (10), j is the imaginary unit.

$$H_{diff}(\omega)=(-j\cdot\omega)^{D} \tag{10}$$

where D is the order of differentiation.

In another embodiment, the analysis filters 62 use the difference equation of (11) below to approximate first order differentiation with respect to time. In (11), n is the sample index and FS is the sampling frequency.

$$y(n)=(x(n)-x(n-1))\cdot FS \tag{11}$$

In yet another embodiment, only a single analysis filter 62 per abeam is included.

In still another embodiment, a single analysis filters 62 is included to filter the first abeam signals only, that is, abeam(1).

In an embodiment, the forward transformers 64 are FFT based.

In another embodiment, the forward transformers 64 are performed with a time domain filterbank.

In yet another embodiment, the forward transformers 64 are performed with a time domain filterbank that delivers quadrature outputs from which phase information can be extracted.

In an embodiment, the microphone equalizer 20 of FIG. 4, the analysis beamformer 52 of FIG. 6, and the analysis filters 62 operate in the same domain. In this way, the forward transformers 32 of the microphone equalizer 20 will suffice and the reverse transformers 36 of the microphone equalizer 20 and the forward transformers 64 of the wave parameter estimator 54 can be omitted.

In an embodiment, the normalizer 66, independently for each frequency band, finds the complex component, real or imaginary, of the ABEAM(i) signals, with the largest magnitude. A common exponent for all beams is found using this largest component. All beams are then normalized with the common exponent.

In another embodiment, the equation solver 68 uses floating point arithmetic. In such a case, the normalizer 66 also converts each of the beams to floating point notation.

Figure 9:
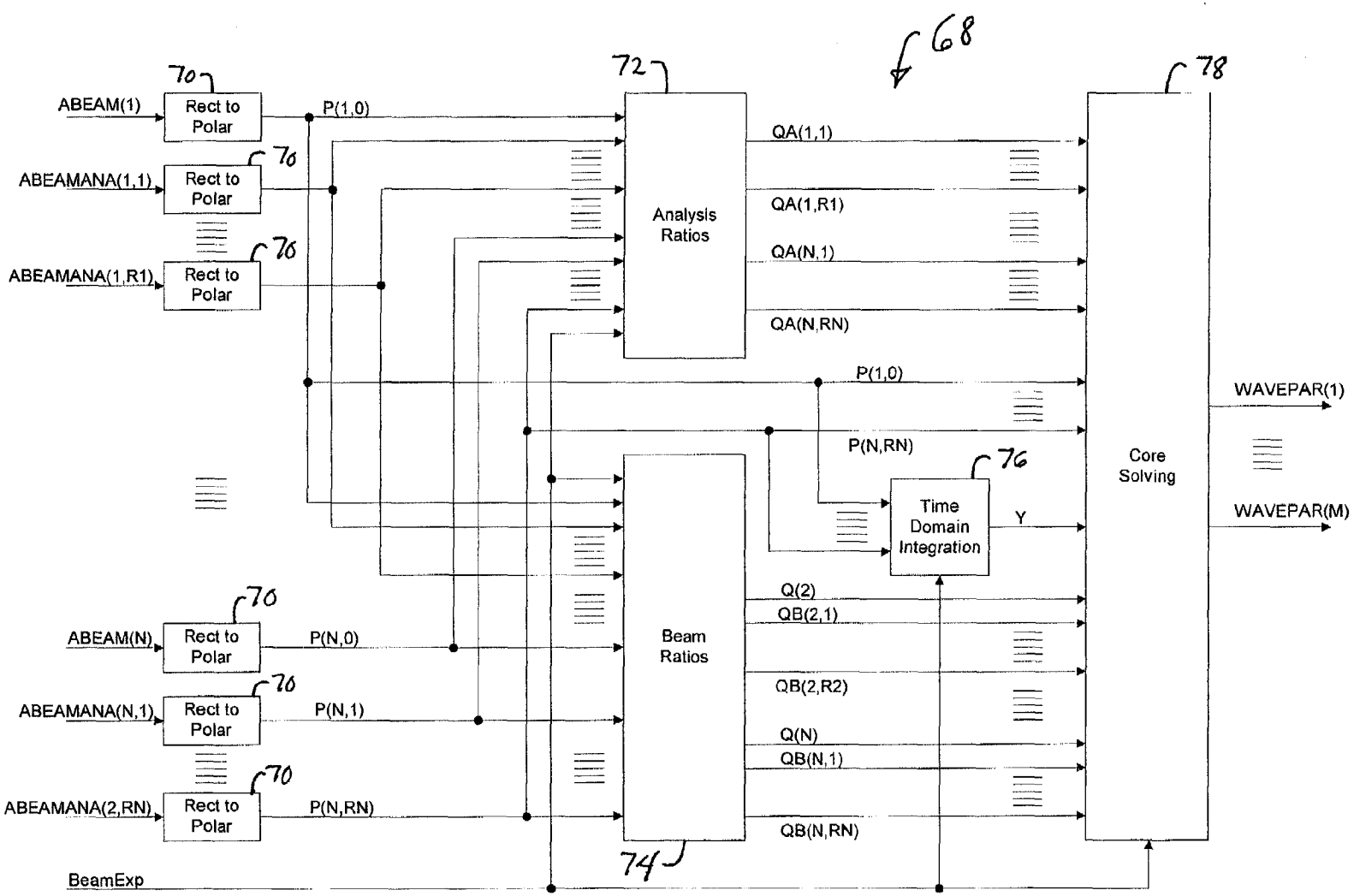
FIG. 9 is a block diagram of the equation solver of FIG. 8.

Turning now to FIG. 9, a block diagram of the equation solver 68 of FIG. 8 is shown. As the sound field equations are most efficiently solved with the input signals in a phase, magnitude notation, the signals are converted to such a polar notation before further processing is performed in the equation solver 68 by a plurality of rectangular to polar converters 70. Furthermore, it is convenient to use ratios of the various input signals when solving for angle of incidence and frequency, therefore the needed ratios are computed in an analysis ratio processor 72 and a beam ratios processor 74. The functioning of these processors can be described, respectively, by equations (11) and (12) below.

$$QA(i,a)=\frac{P(i,a)}{P(i,0)} \tag{11}$$

$$\left.\begin{cases} Q(i)=\dfrac{P(i,0)}{P(1,0)} \\ QB(i,a)=\dfrac{P(i,a)}{P(1,a)} \end{cases}\right| \text{ for } i>1 \tag{12}$$

In (11) and (12), a is the analysis filter index and i the abeam index.

The equation solver 68 may include a time domain integrator 76 which is optional. When implemented, it integrates product factors P(i1,a1)*P(i2,a2) over time. Through the use of the time domain integrator 76, it may be feasible to enhance the analysis especially for any embodiment using time domain filterbanks as the forward transformers 64 of FIG. 8.

The equation solver 68 most importantly includes a core solver 78 which solves the sound field equations. A sound field can be described in several ways. The description can be in the time domain or in the frequency domain, among others. Furthermore, the description can involve a potential field describing both pressure and velocity with the same function or the description can have distinct pressure and velocity equations.

In this case, it is preferred that the sound field be described primarily in the frequency domain and simplifications will be used when judged feasible. Initially, the sound field will be described with two functions. The first function is a complex scalar function. It gives the sound pressure as a function of frequency and position. The second function is a complex vector function. It gives the sound particle velocity as a function of frequency and position.

To move forward towards a solution, it is necessary to make some assumptions regarding the sound field. First, the sound consists of M waves. The waves are not required to be plane waves. Second, only the sound pressure and the direction of the sound particle velocity are of interest. The value of the sound particle velocity is not important. Both the sound pressure and the sound particle velocity of the individual waves will be functions of time. Third, each of the waves in the description may in reality consist of the sum of several waves. The principle of superposition holds for sounds up until very high sound pressure levels. Fourth, one is only interested in the sound pressure levels at the places of the microphones and only as seen through the initial beamforming, A/D conversion, and so forth. Fifth, each of the waves is quasi-sinusoidal in the sense that within each frequency band of the analysis the energy is mainly due to a single sinusoid only. Thus each wave may consist of several sinusoids, spread over the frequency range.

Given these assumptions, the sound field can be described with a set of equations (13) below that gives the sound pressures at the locations of the microphone sound inlets.

$$\begin{cases} P_a(k, i) = \sum_m W_m(k, i) \\ W_m(k, i) = A_m(k) \cdot \exp\left(-j \cdot \omega_m(k) \cdot \frac{\overline{v_m(k)} \cdot \overline{x(i)}}{c}\right) \cdot \exp(-\delta_m(k) \cdot \overline{v_m(k)} \cdot \overline{x(i)}) \quad \text{for } i > 1 \\ W_m(k, 1) = A_m(k) \end{cases} \tag{13}$$

In (13), the small dots denote element by element multiplication and the large dots denote inner products. c is the speed of sound. k is the frequency band index. $\omega_m$ is the angular frequency of the wave m. m is the wave index. x(i) is a vector and is the position of microphone i. $v_m$ is a unit vector in the direction of the sound particle velocity. $v_m$ is thus the direction of sound incidence of the wave. $\delta_m$ is the damping factor along $v_m$. Note that all wave parameters generally will depend upon k, the frequency band index. This dependency stems in part from the fact that it is assumed that each wave in the description can be the sum of more than one factual waves in the sound field. However, it also accounts for windowing effects and other non-idealities associated with the frequency transformation used. Note also that the wave parameters will be functions of time. In (13) and the equations to come, the dependencies upon the frequency band index and time are implicit except when otherwise noted.

For convenience, the sound field equations (13) above will be rewritten in (14) below as it can be observed through the input signals that are supplied to the core solver 78.

$$\begin{cases} P(1, 0) = \sum_m A_m \\ P(1, a) = \sum_m A_m \cdot H_a(\omega_m) \\ P(i, 0) = \sum_m A_m \cdot \exp\left(-j \cdot \omega_m \cdot \frac{\overline{v_m} \cdot \overline{x(i)}}{c}\right) \cdot G(i, v_m) \\ P(i, a) = \sum_m A_m \cdot \exp\left(-j \cdot \omega_m \cdot \frac{\overline{v_m} \cdot \overline{x(i)}}{c}\right) \cdot G(i, v_m) \cdot H_a(\omega_m) \end{cases} \quad \text{for } i > 1 \tag{14}$$

In (14), the effects of the microphone and A/D converter sensitivities, among others, have been included in the values $A_m$. a indexes the Analysis Filters $H_a$. $G(i,v_m)$ is a function that collects all variations due to wave damping, microphone directivity, analog beamforming, and analysis beamforming.

In some applications it will be feasible to place the microphones along a common axis. In this case, the method only allows for imperfect detection of the direction of the sound incidence. Only the angle $\alpha_m$, between the microphone axis and the wave direction in the plane in space that contains both vectors, can be detected. For such embodiments, (14) can be rewritten in terms of this angle as in (15) below.

$$\begin{cases} P(1, 0) = \sum_m A_m \\ P(1, a) = \sum_m A_m \cdot H_a(\omega_m) \\ P(i, 0) = \sum_m A_m \cdot \exp\left(-j \cdot \omega_m \cdot \frac{\cos(\alpha_m) \cdot d(i)}{c}\right) \cdot G(i, \alpha_m) \\ P(i, a) = \sum_m A_m \cdot \exp\left(-j \cdot \omega_m \cdot \frac{\cos(\alpha_m) \cdot d(i)}{c}\right) \cdot G(i, \alpha_m) \cdot H_a(\omega_m) \end{cases} \quad \text{for } i > 1 \tag{15}$$

In (15), d(i) is the physical distance from the reference microphone, microphone 1, to microphone i.

As noted above, it is preferred that the sound field be described primarily in the frequency domain. The frequency domain is generally the most advantageous domain in terms of complexity and computing costs. Nevertheless in some cases the processing of the present invention is most feasible performed together with other audio processing applications. If such audio processing runs in the time domain it may prove efficient to implement the apparent incidence audio processing in the time domain as well. In the following, the sound field equations will therefore be stated in the time domain. Below, (16) states the sound field equations in the time domain under the assumptions as used in the formulation of (14) above. In (16), p is used to describe the time domain version of P and n is the sample index.

$$\begin{cases} A_m = |A_m| \cdot \exp(j \cdot \varphi_m) \\ d_m = \frac{\overline{v_m} \cdot \overline{x(i)}}{c} \\ p(1, 0, n) = \sum_m |A_m| \cdot \cos\left(\omega_m \cdot \frac{n}{FS} + \varphi_m\right) \\ p(1, a, n) = \sum_m |A_m| \cdot |H_a(\omega_m)| \cdot \cos\left(\omega_m \cdot \frac{n}{FS} + \varphi_m + \arg(H_a(\omega_m))\right) \\ p(i, 0, n) = \sum_m |A_m| \cdot |G(i, v_m)| \cdot \cos\left(\omega_m \cdot \left(\frac{n}{FS} - d_m\right) + \varphi_m + \arg(G(i, v_m))\right) \\ p(i, a, n) = \sum_m |A_m| \cdot |G(i, v_m) \cdot H_a(\omega_m)| \cdot \cos\left(\omega_m \cdot \left(\frac{n}{FS} - d_m\right) + \varphi_m + \arg(G(i, v_m) \cdot H_a(\omega_m))\right) \end{cases} \quad \text{for } i > 1 \tag{16}$$

(16) can generally not be solved for a single sample measurement only. It is necessary to measure over a number of samples and perform some form of averaging. To enable the solution, new measurement signals are defined in (17) below. In (17), indexes a1 and a2 may have a value of zero. B is the number of samples to average over and win( ) is an optional window to weight the measurements with.

$$Y(i1, a1, i2, a2) = \frac{1}{B} \sum_{b=0}^{B} win(b) \cdot p(i1, a1, n - b) \cdot p(i2, a2, n - b) \cdot pow(2, BeamExp) \tag{17}$$

The product terms in the right hand side of (17) will according to (16) be the product of constants and two cosine terms dependent on time through the sample index n. The product of two cosine results in a sum of two different cosines, namely at the sum angle and the difference angle. The sum and difference angles may be DC terms or AC terms. When integrating over a large number of samples the AC terms will diminish from (17). Furthermore, as is known from Fourier transform theory, the integral of the product of two cosines goes to zero for large integration times if the cosines are of a different frequencies. Below, (18) shows what remains of (17) when B is sufficiently large.

$$\begin{cases} Y(1,0,1,0)=\sum_m |A_m|^2 \\ Y(1,0,1,a)=\sum_m |A_m|^2\cdot|H_a(\omega_m)|\cdot\cos(\arg(H_a(\omega_m)) \\ Y(1,0,i,0)=\sum_m |A_m|^2\cdot|G(i,v_m)|\cdot\cos(-\omega_m\cdot d_m+\arg(G(i,v_m))) \\ Y(1,0,i,a)=\sum_m |A_m|^2\cdot|G(i,v_m)\cdot H_a(\omega_m)|\cdot\cos(-\omega_m\cdot d_m+\arg(G(i,v_m)\cdot H_a(\omega_m))) \\ Y(1,a1,1,a2)=\sum_m |A_m|^2\cdot|H_{a1}(\omega_m)\cdot H_{a2}(\omega_m)|\cdot\cos(\arg(H_{a1}(\omega_m)\cdot H_{a2}(\omega_m)) \\ Y(1,a1,i,a2)=\sum_m |A_m|^2\cdot|G(i,v_m)\cdot H_{a1}(\omega_m)\cdot H_{a2}(\omega_m)|\cdot\cos(\arg(G(i,v_m)\cdot H_{a1}(\omega_m)\cdot H_{a2}(\omega_m)) \\ Y(i1,0,i2,0)=\sum_m |A_m|^2\cdot|G(i1,v_m)\cdot G(i2,v_m)|\cdot\cos(-\omega_m\cdot d_m+\arg(G(i1,v_m)\cdot G(i2,v_m))) \\ Y(i1,0,i2,a)=\sum_m |A_m|^2\cdot|G(i1,v_m)\cdot G(i2,v_m)\cdot H_a(\omega_m)|\cdot\cos(-\omega_m\cdot d_m+\arg(G(i1,v_m)\cdot G(i2,v_m)\cdot H_a(\omega_m))) \\ Y(i1,a1,i2,a2)=\sum_m |A_m|^2\cdot|G(i1,v_m)\cdot G(i2,v_m)\cdot H_{a1}(\omega_m)\cdot H_{a2}(\omega_m)|\cdot\cos(-\omega_m)\cdot d_m+\arg(G(i1,v_m)\cdot G(i2,v_m)\cdot H_{a1}(\omega_m)\cdot H_{a2}(\omega_m)) \end{cases} \tag{18}$$

A subset of (18) will normally suffice to solve for all parameters except the phase, $\phi$. To solve for $\phi$, a subset of (16) combined with a subset of (18) is needed.

In general all parameters of the waves of the sound field will a priori be unknown and the sound field equations must be solved for all parameters. However, some special cases may exist where, for example, a wave is known to come from a specific direction. In other cases, it may prove useful to make certain assumptions regarding wave parameters. When certain parameters are known or assumed a priori, the task of solving the sound field equations becomes less complex. In still other cases, it may be desirable to imply constraints upon the parameters of the waves. This will generally increase the complexity of the task of solving the equations for the wave parameters, but it can simplify the task of mapping the parameters to wave gains.

In an embodiment, the wave frequencies are assumed such that $\omega_c=2\pi f_c$, where $f_c$ is the center frequency of the individual bands of the frequency transform.

In another embodiment, the waves are assumed to be plane waves with $\delta_m$ equal to zero.

In yet another embodiment, the first wave is assumed to impinge from a target direction.

A further embodiment solves for two waves. The first, signal, wave is constrained to have a direction from within a certain tolerance around a target direction. The second, noise, wave is constrained to have a direction from outside the tolerance field.

A still further embodiment solves for M waves. The solutions are not directly constrained but they are ordered so that the waves impinge further away from the target direction the higher the wave number is.

There exists several different techniques that allow for the solution of (14), (16), or(18) with respect to parameters of the waves that the sound field consists of. The parameters to solve for may include the following:

$A_m$—the wave amplitude (note that $A_m$ is a complex number incorporating phase information)

$v_m$—the direction of sound incidence of the wave $\omega_m$—the angular frequency of the wave ($\omega=2\pi f$)

$\delta_m$—the wave damping factor

Next, five different techniques will be described for equation solving. The first technique is referred to as direct solving. Under special conditions it is possible to solve (14) above directly using arithmetical methods. Such direct solving yields the wanted parameters as mathematical functions of the input signals to the core solver 78.

In a specific application, a system with two microphones 12 of FIG. 1 is used. The analog beamformer 18 of FIG. 2 and the analysis beamformer 52 of FIG. 6 are deleted. A single analysis filter 62 of FIG. 8 H(1,1) is included. This analysis filter 62 is implemented as differentiation with respect to time. The technique will assume that only a single wave is present in the sound field. It will further be assumed that it is a plane wave with zero damping. For this embodiment (15) above can be rewritten as (19) below.

$$\begin{cases} P(1,0)=A_1 \\ P(1,1)=-j\cdot\omega_1\cdot A_1 \\ P(2,0)=A_1\cdot\exp\left(-j\cdot\omega_1\cdot\frac{\cos(\alpha_1)\cdot d(2)}{c}\right) \end{cases} \tag{19}$$

In (20) below, (19) above can be solved to yield the wave parameters in terms of the input signals to the core solver 78.

$$\begin{cases} \omega_1 \approx j \cdot \dfrac{P(1,1)}{P(1,0)} \\ A_1 \approx P(1,0) \\ \alpha \approx \arccos\left(\ln\left(\dfrac{P(2,0)}{P(1,0)}\right) \cdot \dfrac{c}{d(2)} \cdot \dfrac{P(1,0)}{P(1,1)}\right) \\ \delta_1 \approx 0 \end{cases} \tag{20}$$

In (21) below the result of (20) has been rewritten to take advantage of the ratio inputs to the core solver 78. Furthermore, the result has been simplified in order to always return values for the wave frequency and angle of incidence that are real valued.

$$\begin{cases} \omega_1 \approx |QA(1,1)| \\ A_1 \approx P(1,0) \\ \alpha_1 \approx \arccos\left(\arg(Q(2)) \cdot \dfrac{c}{d(2)} \cdot \dfrac{1}{|QA(1,1)|}\right) \\ \delta \approx 0 \end{cases} \tag{21}$$

In (21) above a special technique has been introduced. The wave direction has been solved for while disregarding input amplitude information. In some cases it is possible to estimate some wave parameters using mainly the phase information of the input signals. To disregard the amplitude information has the advantage that the estimation will not be vulnerable to sensitivity changes of the microphones and thus a microphone equalization circuit may not be needed.

The second technique for equation solving is referred to as iteration. Unfortunately it is not generally the case that a solution for the sound field equations in (14) above can be found directly. When a solution cannot be found explicitly as a mathematical expression, it is still possible to use numerical methods. A group of numerical methods can collectively be called iterative methods.

Iteration can roughly be said to include the following steps:

Formulate an initial guess.

Compute an error.

Compare computed error to a predetermined limit.

If the error is less than the predetermined limit, then a solution has been found.

If the error is greater than or equal to the predetermined limit, then map the current solution to a subsequent solution.

Repeat computation and comparison steps until a solution is found.

The error is found by subtracting the actual measurement from the results that are obtained by inserting the current solution in the right hand side of (14). The error can be expressed in a mean square sense but it can also be taken as maximal of any of the measurements. However, the error can also be expressed as the relative difference between two successive solutions.

In an embodiment, the wanted directivity response is symmetric around a given axis. The wave parameters are solved using Newton-Rhapson iteration. Parameter error functions are defined as in (22) below.

$$\begin{cases} nerr^l = \sum_i |perr(i,0)^l|^2 + \sum_i \sum_a |perr(i,a)^l|^2 \\ perr(1,0)^l = \sum_m A_m^l - P(1,0) \\ perr(1,a)^l = \sum_m A_m^l \cdot H_a(\omega_m^l) - P(1,a) \\ \left.\begin{array}{l} perr(i,0)^l = \sum_m A_m^l \cdot \exp\left(-j \cdot \omega_m^l \cdot \dfrac{\cos(\alpha_m) \cdot d(i)}{c}\right) \cdot \\ G(i,\alpha_m) - P(i,0) \\ perr(i,a)^l = \sum_m A_m^l \cdot \exp\left(-j \cdot \omega_m^l \cdot \dfrac{\cos(\alpha_m) \cdot d(i)}{c}\right) \cdot \\ G(i,\alpha_m) - H_a(\omega_m^l) - P(i,a) \end{array}\right| \text{for } i > 1 \end{cases} \tag{22}$$

In (22), the superscript I is the iteration index. Below, (23) gives the equations to find the next step of the iteration.

$$\begin{cases} A_m^1 = A_m^{l-1} + \sum_i \dfrac{perr(i,0)^{l-1}}{\left.\dfrac{\delta(perr(i,0))}{\delta A_m}\right|_{l-1}} + \sum_i \sum_a \dfrac{perr(i,a)^{l-1}}{\left.\dfrac{\delta(perr(i,a))}{\delta A_m}\right|_{l-1}} \\ \omega_m^1 = \omega_m^{l-1} + \sum_i \dfrac{perr(i,0)^{l-1}}{\left.\dfrac{\delta(perr(i,0))}{\delta \omega_m}\right|_{l-1}} + \sum_i \sum_a \dfrac{perr(i,a)^{l-1}}{\left.\dfrac{\delta(perr(i,a))}{\delta \omega_m}\right|_{l-1}} \\ \alpha_m^1 = \alpha_m^{l-1} + \sum_i \dfrac{perr(i,0)^{l-1}}{\left.\dfrac{\delta(perr(i,0))}{\delta \alpha_m}\right|_{l-1}} + \sum_i \sum_a \dfrac{perr(i,a)^{l-1}}{\left.\dfrac{\delta(perr(i,a))}{\delta \alpha_m}\right|_{l-1}} \\ \delta_m^1 = \delta_m^{l-1} + \sum_i \dfrac{perr(i,0)^{l-1}}{\left.\dfrac{\delta(perr(i,0))}{\delta \delta_m}\right|_{l-1}} + \sum_i \sum_a \dfrac{perr(i,a)^{l-1}}{\left.\dfrac{\delta(perr(i,a))}{\delta \delta_m}\right|_{l-1}} \end{cases} \tag{23}$$

The iteration stops when the mean square error nerr is smaller than a given value.

In another embodiment, the error cost function, nerr, is defined as the maximal relative difference between the last two iterative solutions as in (24) below.

$$nerr^l = \max\left(\left|\frac{A_1^l - A_1^{l-1}}{A_1^l}\right|, \left|\frac{A_2^l - A_2^{l-1}}{A_2^l}\right|, \ldots, \left|\frac{\delta_M^l - \delta_M^{l-1}}{\delta_M^l}\right|\right) \tag{24}$$

In a further embodiment, an extra level of iteration is introduced, that is, wave iteration. Wave iteration may be said to include the following steps:

Solve, using iteration or another method, a subset of the sound field equations for a limited number, for example two, of the waves.

Evaluate a cost function werr, for example as defined in (25) below.

If werr is smaller than a predefined constant, then continue with the next step below otherwise increase the number of waves and return to the solution step above.

Set the amplitudes for the resting M−1 waves to a value of zero and the rest of the parameters for these waves to predefined values.

$$werr^l = \frac{\min(|A_1^l|, \ldots, |A_l^l|)}{\max(|A_1^l|, \ldots, |A_l^l|)} \tag{25}$$

It should be noted that iteration for a solution can have limitations. For one, the process may not converge. Adding appropriate means to the iteration process can solve this problem. However, iteration might also find a "local extreme" where the stop conditions for the iteration are fulfilled even when the solution is not the correct "global solution."

The third technique for equation solving is referred to as a full parameter scan. Unlike the iteration solution, this method will always find the global solution when properly set up. The drawback is a greater amount of computation. With the full parameter scan, the possible solution ranges are defined and within these ranges grids are set up. The grids are set to implement the wanted resolution for the respective parameters. Then the error cost function, for example as in (22) above, is evaluated for all possible combinations of wave parameters on the grids. All parameter combinations for which the error cost function is smaller than a given threshold are possible solutions.

In a specific embodiment, the microphone configuration is axis-symmetric and the error cost function is defined as in (22). The parameter ranges are set to [0 . . . 2*BeamExp] for |A|, [0 . . . 2*π] for arg(A), [0 . . . π] for α, and [−3 . . . 3] for δ. Parameter scan is performed and the wave parameters are chosen as the set that gives the lowest value for nerr.

In another embodiment, full parameter scan is combined with iteration. Parameter ranges and grids are set up using a coarse grid. All parameter combinations on the coarse grid are used as starting guesses for an iteration leading to a "local solution" for the wave parameters. The local solution with the lowest error cost function is chosen as the correct solution.

The fourth technique for equation solving is referred to as solution screening/optimizing for minimal power. The methods described above may yield more than one possible solution for the sound field equations for a given a set of measurements. Measurement noise from sources such as A/D conversion, microphones, etc. can be sources of ambiguity but the system may also be underestimated. The sources of underestimation are that the number of microphones used is not large enough to solve for the number of waves assumed or that the sound in reality consists of more waves than solved for.

Even when the system is known to be underestimated it may due to cost reasons be attractive to use solution screening/optimization to work around the problem instead of making the system unambiguous. With solution screening the solution with the lowest cost function is not simply chosen. In stead, a threshold for the error cost function is defined. All solutions for which the error cost function is lower than the threshold are deemed possible solutions. From the set of possible solutions the solution is chosen for which a power estimate is minimal.

With this strategy the chosen solution may not be the correct one, but even if the correct solution is not chosen the strategy results in a system gain for noise components equal to or lower than the noise gain that would have been the result if the correct solution was to be used.

A specific embodiment uses the full parameter scan method. All parameter sets for which the error cost function is equal to or lower than the minimal cost function encountered plus a threshold are deemed possible solutions. The solution with the lowest $P_{tot}$, (26), is chosen.

$$P_{tot} = \sum_m |A_m|^2 \tag{26}$$

The fifth technique for equation solving is referred to as solving for a subset. In some applications, knowledge of the full set of wave parameters is not necessary in order to control the wave gain. A subset only will suffice. This may simplify the task of solving the sound field equations.

In an embodiment, only the wave damping is of interest. Two microphones are used in this embodiment and it is assumed that the sound field consists of a single wave coming from a direction on the microphone axis. In this case, the sound field equations can be simplified as shown in (27) below.

$$|Q(2)| = \left|\frac{P(2,0)}{P(1,0)}\right| = \exp(-\delta_m) \tag{27}$$

Above, five techniques for solving the sound field equations have been described with respect to the parameters for the waves in the sound field. Two implementations for these techniques will now be described. A first implementation involves the use of conventional computer software. Several brands of application software exist that are capable of solving the sound field equations with either symbolical or numerical methods. These include mathematical programs such as Mathematica, Matlab, Maple, and the like. In addition circuit simulators may be used under certain conditions.

An embodiment of the system includes a standard computer architecture to do parts of the acoustical sound processing. The sound field equations are defined and solved for the wave parameters within a conventional software package on a conventional computer architecture.

A second implementation involves the use of a conventional table look up. A table can be pre-computed that contains the optimal solutions with a certain resolution. The table can be computed using any of the solving techniques described. Once the table has been computed, one simply looks the solution up in the table to solve the sound field equations. Adding an iteration or approximation process to the look up process can enhance it by minimizing the size of the storage used for the table.

Figure 10:
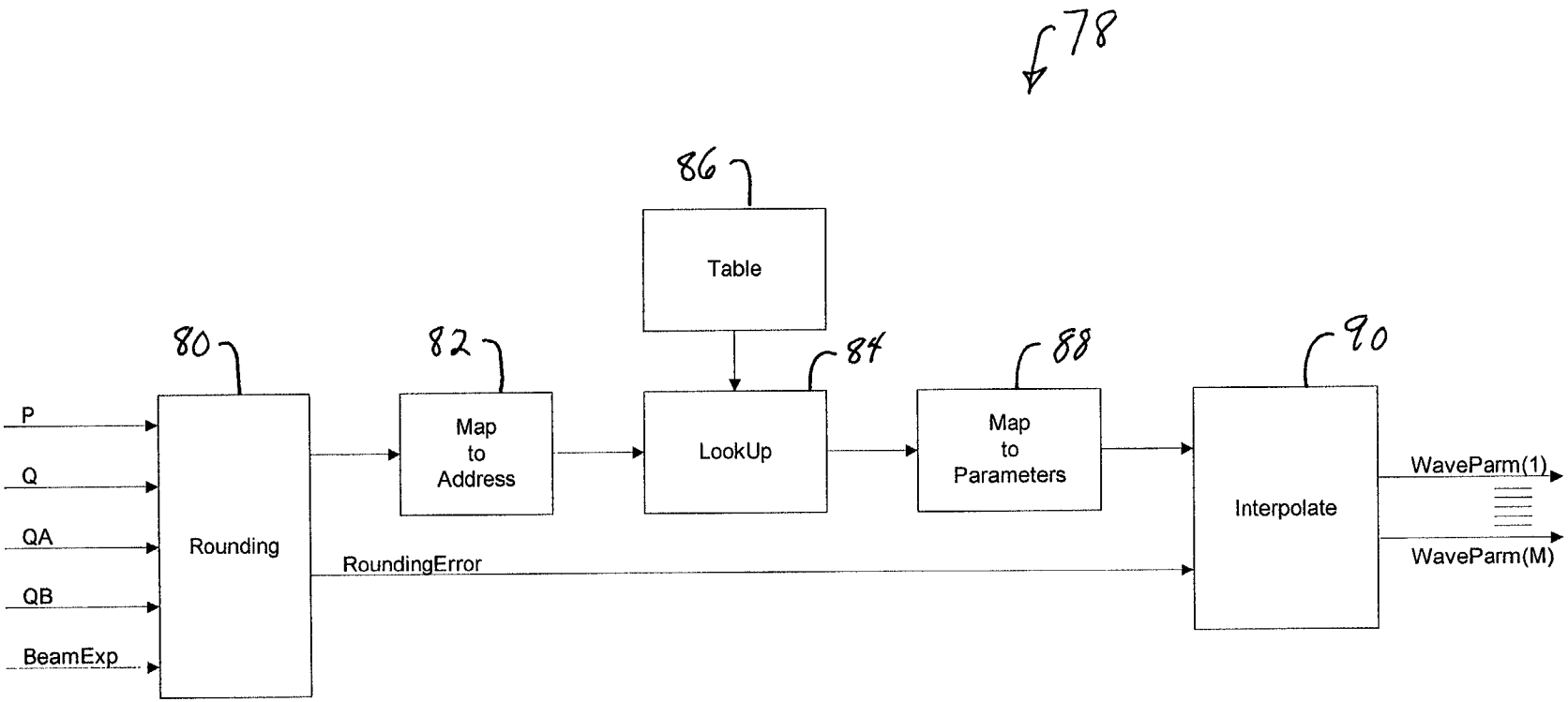
FIG. 10 is a block diagram of an embodiment of the core solver of FIG. 9 using a table look up implementation with optional approximation.

Turning now to FIG. 10, a block diagram of an embodiment of the core solver 78 of FIG. 9 using a table look up implementation with optional approximation is shown. First, the measurements are rounded to a predefined precision in rounder 80. The rounded measurements are then mapped to an integer space to yield an address in a map to address mapper 82. The address is used by look up 84 to look up in a pre-computed table 86. The table 86 may be stored on any storage device including RAM, ROM, hard disk, and the like. To save space, the table 86 may contain wave parameters in an encoded form. Thus a map to parameter mapper 88 for mapping back to parameter space may optionally be inserted as shown. Finally an interpolation 90 is optionally done to yield the parameter output. To enable interpolation, the table 86 may contain parameter derivatives besides parameter values. The approximation/interpolation process can be described with equation (28) below. In 28, the large dot denote inner product, m is the wave index, and i indexes parameter type (A, ω, . . . ). WP is the parameters as looked up in the table and mapped to parameter space. G controls the approximation order.

$$WaveParm(m, i) = WP_0(m, i) + \sum_{g=1}^{G} RoundingError^g \cdot WP_g(m, i) \tag{28}$$

Figure 11:
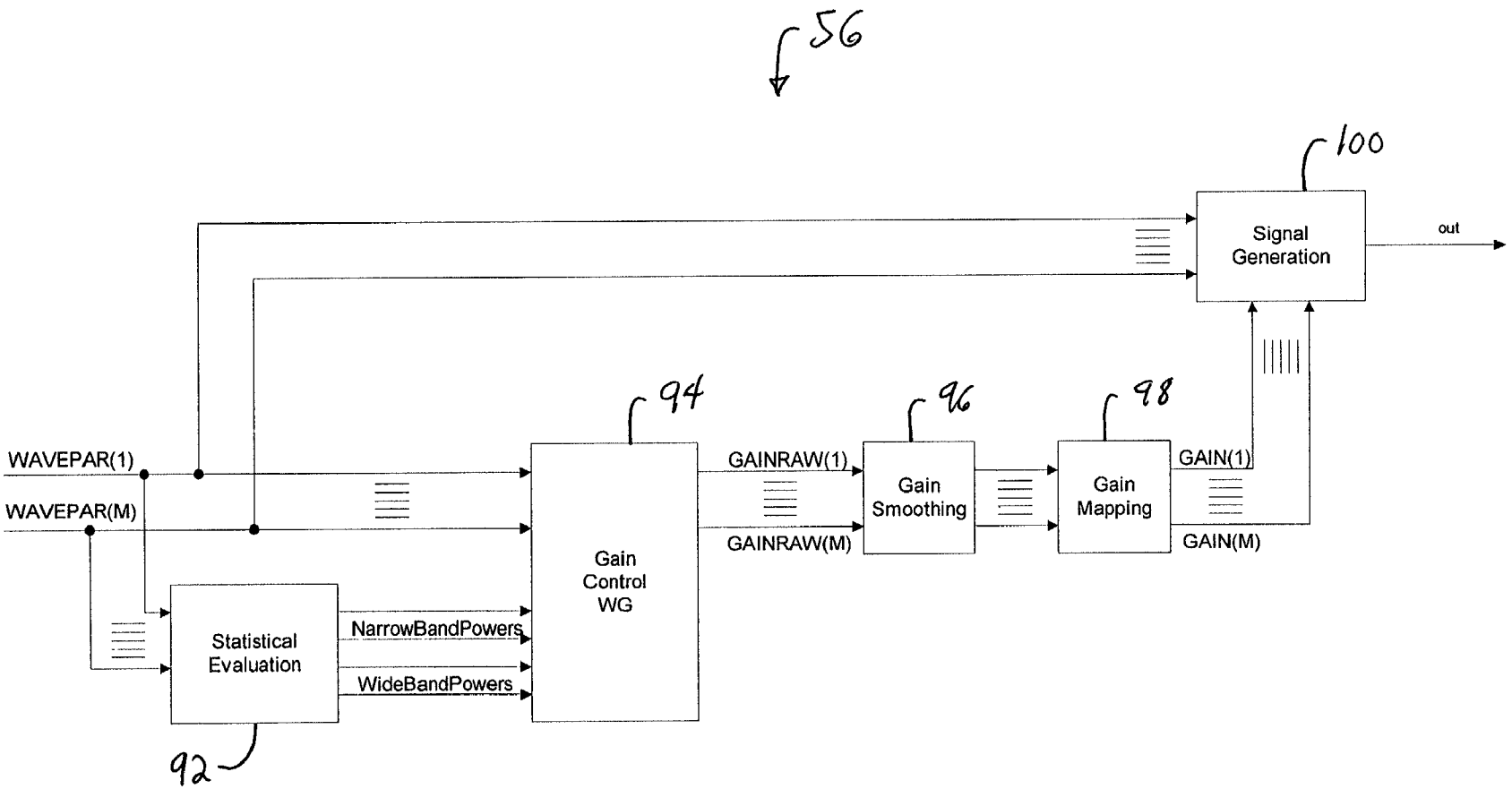
FIG. 11 is a block diagram of the output generator of FIG. 6.

Turning now to FIG. 11, a block diagram of the output generator 56 of FIG. 6 is shown. Recall that the discussion continues to focus on the wave generation embodiment of the apparent incidence processor 22 of FIG. 2. The output generator 56 include a statistical evaluator 92, a wave generation (WG) gain controller 94, a gain smoother 96, a gain mapper 98, and a signal generator 100. The statistical evaluator 92 is optional and when implemented it analyzes the waves to obtain measures of the running signal and noise powers of the sound field. In the WG gain controller 94, the individual waves are analyzed and a gain is attached to each wave. The wave gains are generated so that they attenuate unwanted waves, noise, while preserving utility waves. The raw gain output from the WG gain controller 94 is first smoothed and then mapped to the domain of the wave generation. The purpose of the gain smoother 96 is to prevent abrupt gain changes from occurring. The purpose of the gain mapper 98 is twofold. First, the raw gain may exhibit a frequency/value distribution that would cause time domain aliasing to occur if used in the raw state. Second, the raw gain may be defined in another domain 11 or with a different resolution than needed for the signal generator 100. In this case, the gain mapper 98 maps the gain to the different domain/resolution. In the signal generator 100, the waves are synthesized and weighted according to the mapped gain.

Figure 12:
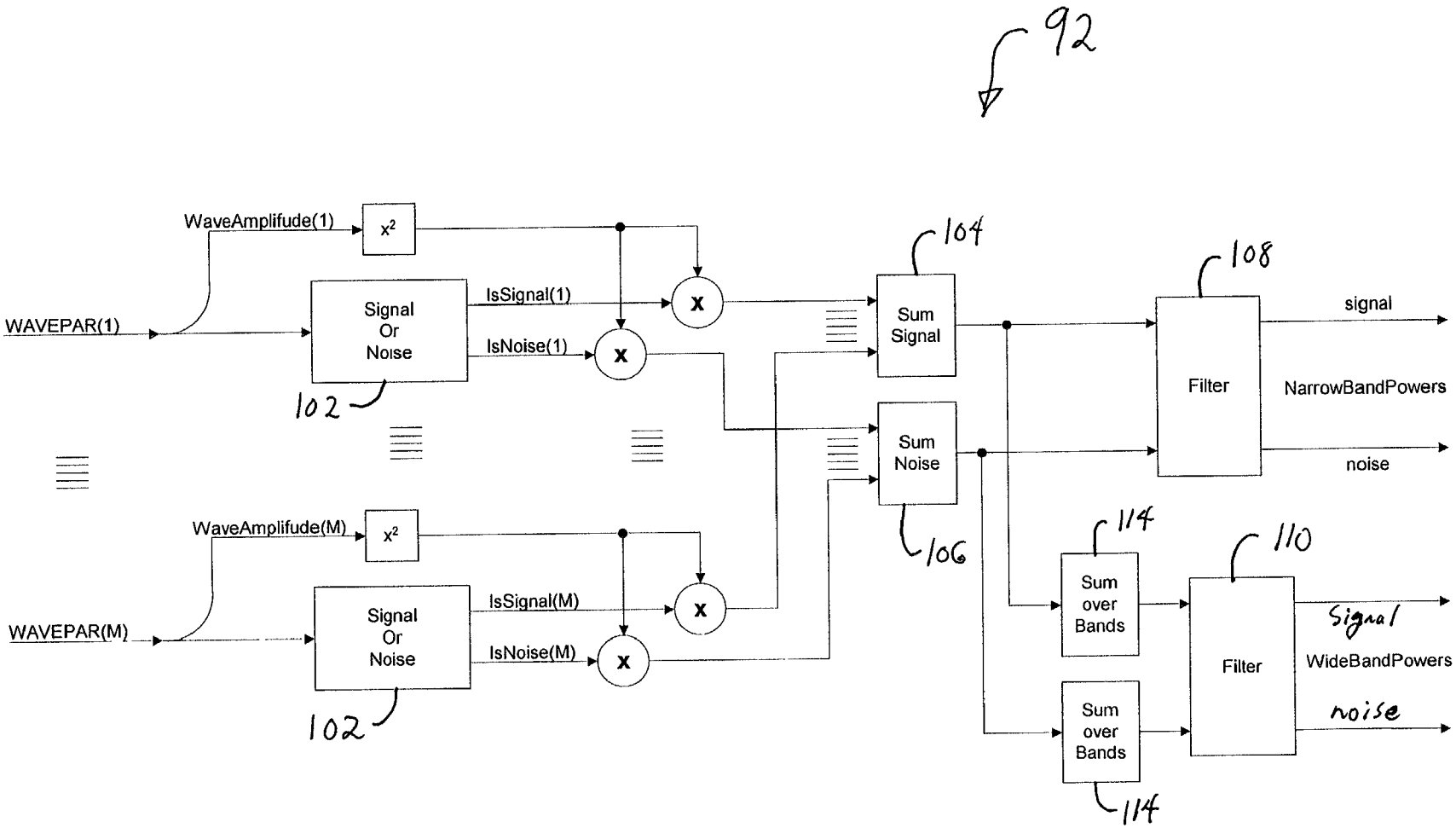
FIG. 12 is a block diagram of the statistical evaluator of FIG. 11.

Turning now to FIG. 12, a block diagram of the statistical evaluator 92 of FIG. 11 is shown. Each set of wave parameters are analyzed in one of a plurality of signal or noise analyzers 102. For each wave and at each frequency band a decision is made as to whether the wave/band combination carries utility signal or noise information. If the combination carries signal information, then the corresponding part of an IsSignal signal is set to logic one and the corresponding part of an IsNoise signal is set to logic zero. If the combination carries noise, then IsSignal is set to logic zero and IsNoise is set to logic one.

The IsSignal and IsNoise switch signals are multiplied with the wave powers, that is, the squared wave amplitudes. The wave power are summed over all waves in a signal summer 104 and a noise summer 106. The summed signal and noise powers are low pass filtered in a NarrowBand filter 108 to yield narrow band estimates of the signal and noise powers. The effective integration time of the filter 108 controls the speed of the measurement. It must be set large enough that inaccuracies in the wave parameter estimates are filtered out. The narrow band measurement may thus be relatively slow.

To obtain a faster measurement of the signal and noise powers may also be made with a coarser frequency resolution. The WideBandPowers output provides the same measurements as the NarrowBandPowers output with the exception that the measurement has been integrated over wide bands in sum over bands integrators 114 before being low pass filtered in WideBand filter 110. Due to the wide bandwidth the measurement may be performed at a faster rate, that is, a shorter integration time, and with a smaller delay than the narrow band measurement. Note that the dynamic characteristics of filters 108 and 110 control the update speed of the power signals. Therefore the filters will in general have different characteristics.

In an embodiment, the signal or noise analysis 102 is based on the measured direction of sound incidence. If this is within a given tolerance equal to a target direction, then the wave/frequency pair is judged to be signal and otherwise it is judged to be noise.

Figure 14:
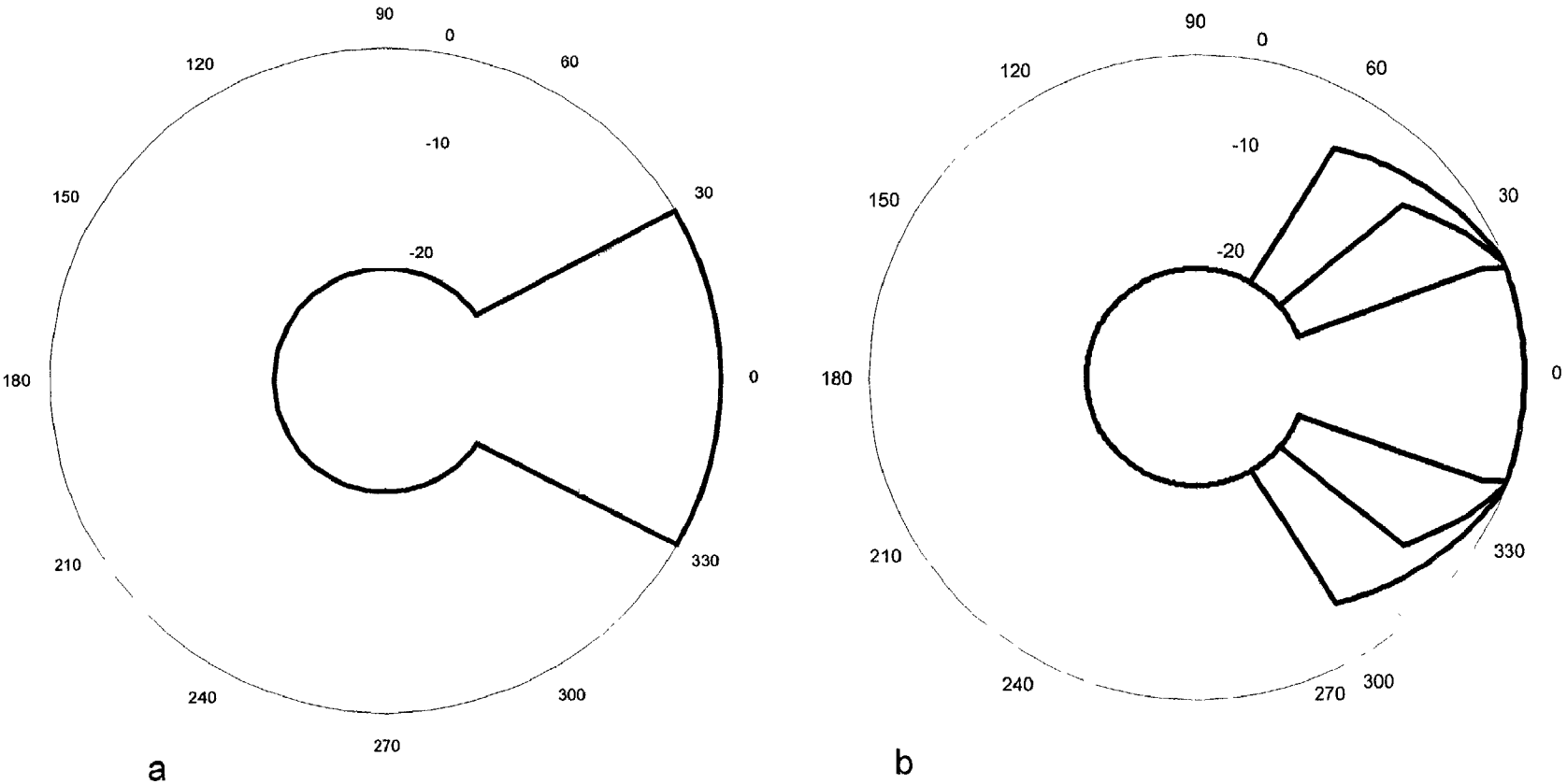
FIG. 14 is a pair of polar plots of a set of gain versus direction functions.

In another embodiment, the signal or noise analysis 102 is based on the measured direction of sound incidence. The IsNoise signal is generated with the help of a directivity function as shown, for example, in the polar plots of FIG. 14. The IsNoise signal is taken as unity minus the IsSignal signal.

In yet another embodiment, the signal or noise analysis 102 is based on the measured wave damping. If this is greater than a given threshold, then the wave/frequency pair is judged to be signal and otherwise it is judged to be noise.

In an embodiment, an additional path, generating a second NarrowBandPowers signal, is provided. The two NarrowBandPowers are generated with two different update rates.

Figure 13:
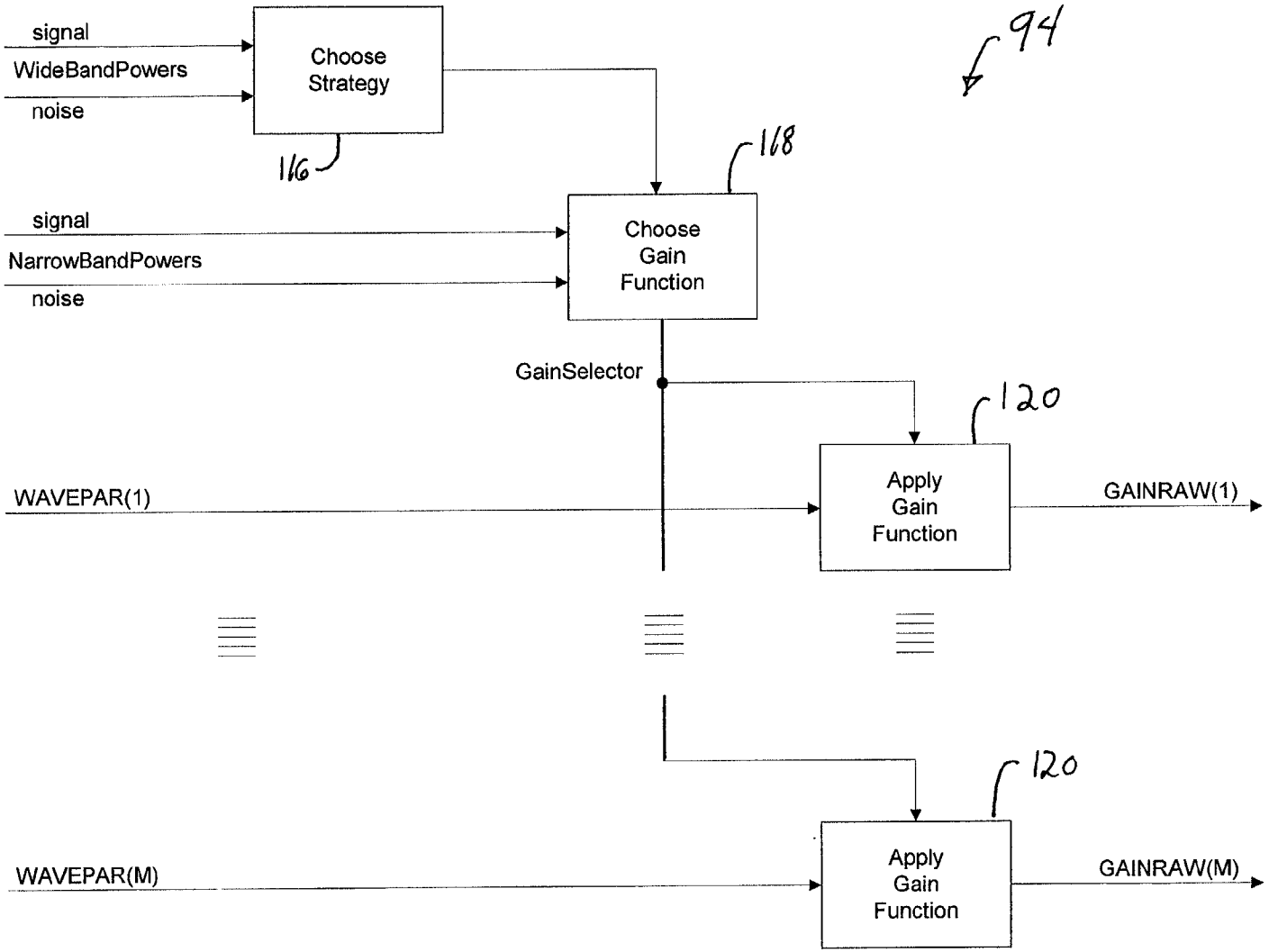
FIG. 13 is a block diagram of the wave generation gain controller of FIG. 11.

Turning now to FIG. 13, a block diagram of the wave generation gain controller 94 of FIG. 11 is shown. The WG gain controller 94 includes a strategy chooser 116, a gain function chooser 118, and a plurality of gain function appliers 120. In the strategy chooser 116, an overall strategy is chosen based on the wideband power measurement. Strategies can, for example, be to use omni directional response or to use narrow beam directional response, among others. The strategy is controlled in wide bands.

The gain function appliers 120 can be thought of as the heart of the processing. They directly control the gain of each wave as a function of some or all of the wave parameters including the direction of the sound incidence, the wave damping, and the frequency and amplitude. It is thus here that the directivity of the processing is implemented. The gain function chooser 118 selects the gain function that serves best for the current signal to noise ratio in view of the strategy input that has been chosen. The output of the gain function chooser 118 will typically control the width of the main lobe of the directional response.

In an embodiment, two gain strategies are implemented, that is, both omni directional and directional. The strategy chooser 116 compares the wideband signal power with the wideband noise power. The omni directional strategy is chosen in all narrow frequency bands covered by wide bands where signal power is greater than a predefined constant times the noise power. In all other bands, the directional strategy is chosen.

In another embodiment, only the directional strategy is implemented.

In an embodiment, the gain function appliers 120 operate by comparing the direction of incidence with a target direction. If the direction of incidence is within a predefined tolerance, the cut-off angle, from the target direction, then the raw gain is set to a predefined maximal gain and otherwise the raw gain is set to a predefined minimal gain. This results in a directivity as shown, for example, in the polar plot of FIG. 14*a*.

In an enhancement of the embodiment just described above, the gain function chooser 118 outputs the cut-off angle as a GainSelector signal. The cut-off angle is controlled as a function of the narrowband band signal to noise ratio.

In another embodiment, the cut-off angle is controlled so as to produce a wide mainlobe of the beam for poor signal to noise ratios and a narrow mainlobe for good signal to noise ratios.

Conversely, in yet another embodiment, the cut-off angle is controlled so as to produce a narrow mainlobe of the beam for poor signal to noise ratios and a wide mainlobe for good signal to noise ratios.

In a further embodiment, the gain function appliers 120 operate by table look-up and optional approximation/interpolation in a similar way as the table look up process described with respect to FIG. 10 but with the wave parameters as input and the raw gain as output. Furthermore, the table output is mapped to gain space instead of parameter space. This embodiment can implement an arbitrary directivity. For example, any of the directivities depicted in the polar plots of FIGS. 14*a* and 14*b* can be implemented.

In a still further embodiment, the GainSelector signal switches between a finite number of different gain functions, for example, those implemented by different tables. An example of a set of gain versus direction functions is shown in the polar plot of FIG. 14*b*.

In a far field embodiment, the gain function is chosen to attenuate waves where the absolute value of the wave damping is greater than a predefined threshold. Thus waves are attenuated that are not far field waves.

In a near field embodiment, the gain function is chosen to attenuate waves where the value of the wave damping is lower than a given threshold. Thus far field waves are attenuated.

In another embodiment, only the wave(s) with the largest relative absolute amplitude(s) are amplified and the rest of the waves are attenuated.

The wave estimation and gain control processes will normally be performed on a block of samples. The duration of the blocks will be so large that it is possibly that the raw gain for a specific frequency band in consecutive blocks will differ significantly. Unfortunately, an abrupt gain change may cause unwanted audible effects. Therefore it will generally be desirable to prevent abrupt gain changes. This is the purpose of the gain smoother 96 of FIG. 11.

In an embodiment, the gain smoother 96 of FIG. 11 copies its input to its output without making any changes. In effect, this eliminates the function of the gain smoother 96.

In another embodiment, the gain is smoothed in the gain smoother 96 of FIG. 11. The smoothed output is the average of the raw gains of the most recent Msmooth blocks.

In yet another embodiment, the gain is smoothed with exponential averaging of the raw gains of successive blocks in the gain smoother 96 of FIG. 11.

Figure 15:
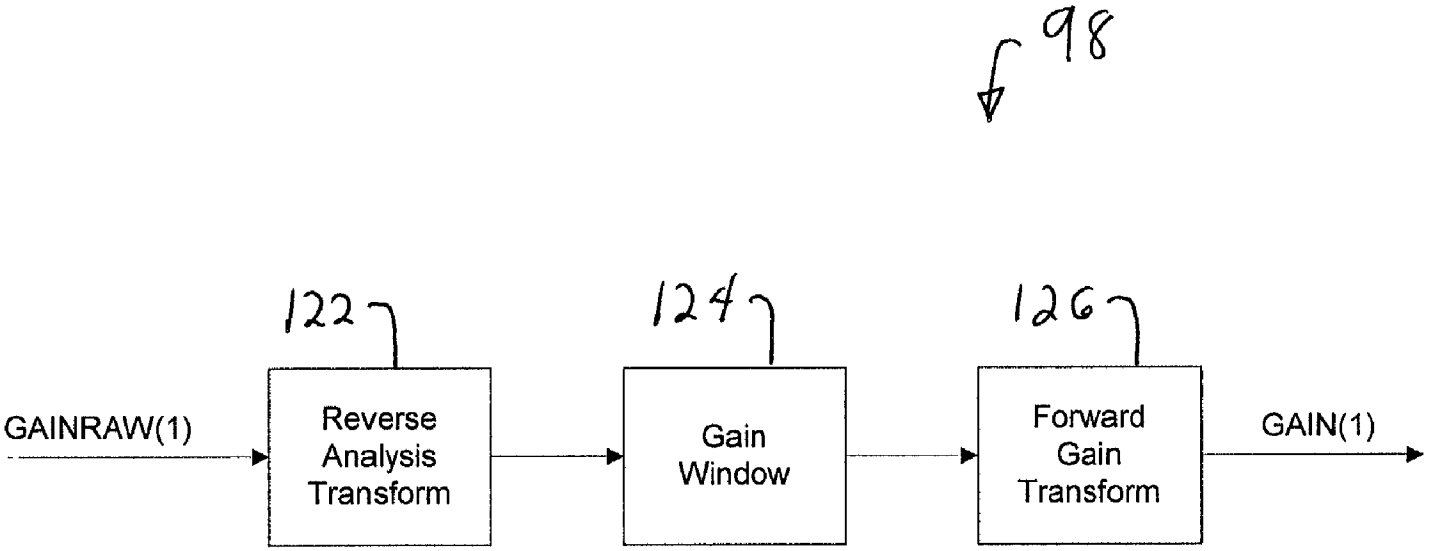
FIG. 15 is a block diagram of the gain mapper of FIG. 11.

Turning now to FIG. 15, a block diagram of the gain mapper 98 of FIG. 11 is shown. This is only one possible embodiment of the gain mapper 98 as other embodiments exist that are capable of performing the same function. The gain mapper 98 includes a reverse analysis transformer 122, a gain windower 124, and a forward gain transformer 126. The raw gain is first converted from the domain of the wave estimation to the time domain in the reverse analysis transformer 122. The converted raw gain is then shortened by applying a window and optionally padding with zeros in the gain windower 124. The length of the window is chosen so as not to provoke time domain aliasing artifacts when the gain is applied downstream. The windowed filter time (FIR) response is finally converted, by the forward gain transformer 126, to the domain that is to be used by the processing downstream.

In an embodiment, the wave estimation is performed in the frequency domain. The reverse analysis transformer 122 is thus FFT-based.

In another embodiment, the wave estimation is performed in time domain filter bands. The reverse analysis transformer 122 is then implemented as a reconstruction filter bank.

In yet another embodiment, the wave estimation is performed in the time domain. The reverse analysis transformer 122 is thus omitted.

In an embodiment, the output of the gain mapper 98 is in the frequency domain. The forward gain transformer 126 is thus FFT-based.

In another embodiment, the output of the gain mapper 98 is in time domain filter bands. The forward gain transformer 126 is thus implemented as an analysis filter bank.

In yet another embodiment, the output of the gain mapper 98 is in the time domain. The forward gain transformer 126 is thus omitted.

Figure 16:
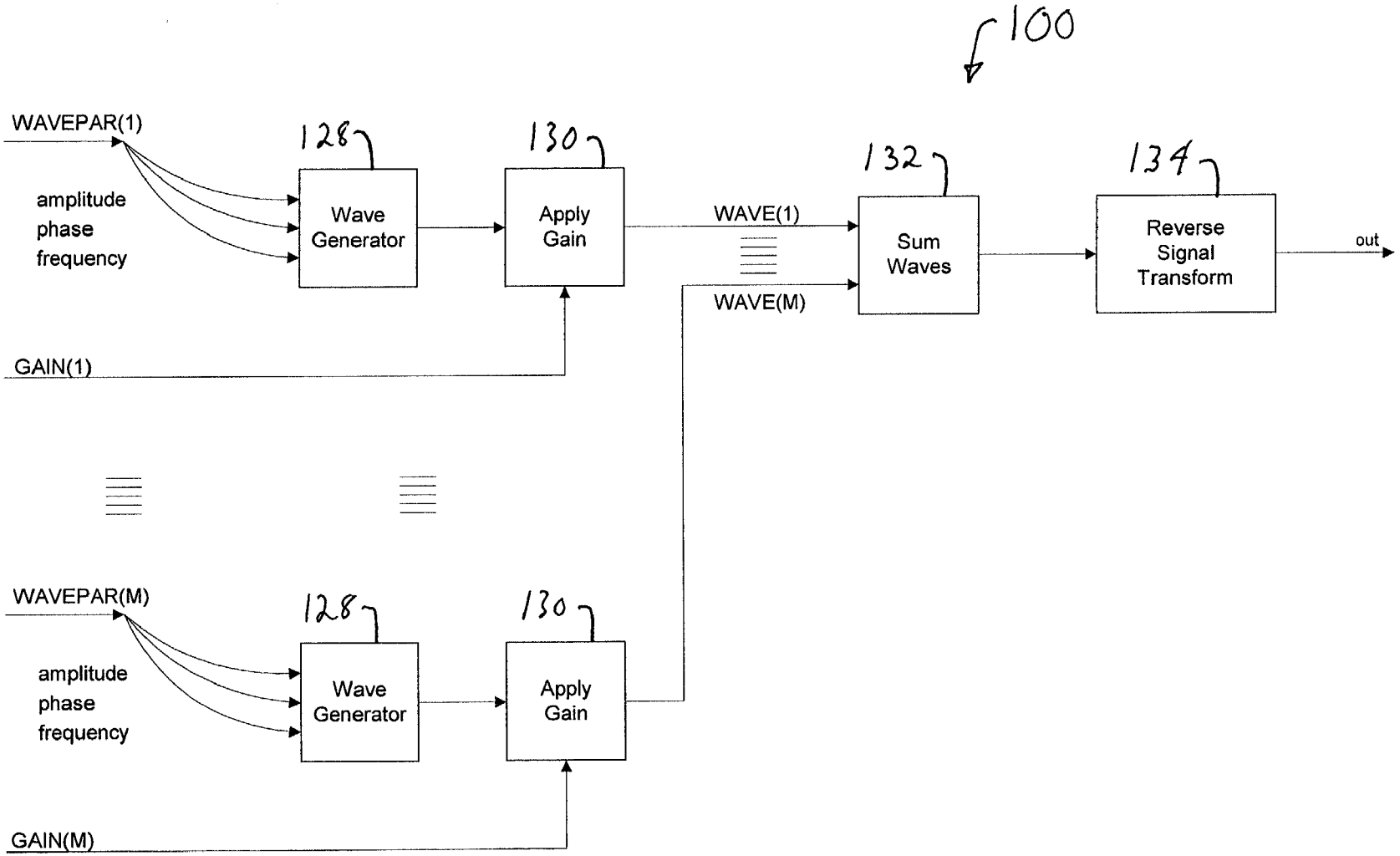
FIG. 16 is a block diagram of the signal generator of FIG. 11.

Turning now to FIG. 16, a block diagram of the signal generator 100 of FIG. 11 is shown. The signal generator 100 includes at least one wave generator 128, at least one gain applier 130, a wave summer 132, and a reverse signal transformer 134. Based on the amplitude, phase, and frequency of the wave, the wave is generated with the wave generator 128. The gain is applied by the gain applier 130, the individual waves are summed by the wave summer 132, and the sum of all the waves is converted, by the reverse signal transformer 134, back to the time domain as the output of signal generator 100 and the apparent incidence processor 22 of FIG. 2.

In an embodiment, the signals are generated in the frequency domain. The wave generator 128 thus merely has to output the complex amplitude, $A_m$ or $abs(A_m)*exp(j*\phi_m)$. Then the gain is applied by multiplying with the frequency domain gain. Finally, the reverse signal transformer 134 performs an inverse frequency transform.

In another embodiment, the signals are generated in the time domain with sine wave generators for the wave generators 128. The reverse signal transformer 134 is omitted.

In yet another embodiment, the signals are generated in the time domain in narrow frequency bands by the wave generators 128. Then the gain is applied by multiplying in the bands. Finally, the reverse signal transformer 134 is implemented with a reconstruction filter bank.

Recall from above that two different embodiments of the apparent incidence processor 22 of FIG. 2 are to be disclosed. Both embodiments use the same principles to estimate the properties of the individual waves of the sound field. With discussion of the wave generation method essentially complete, the discussion of the forward filtering method now follows.

Figure 17:
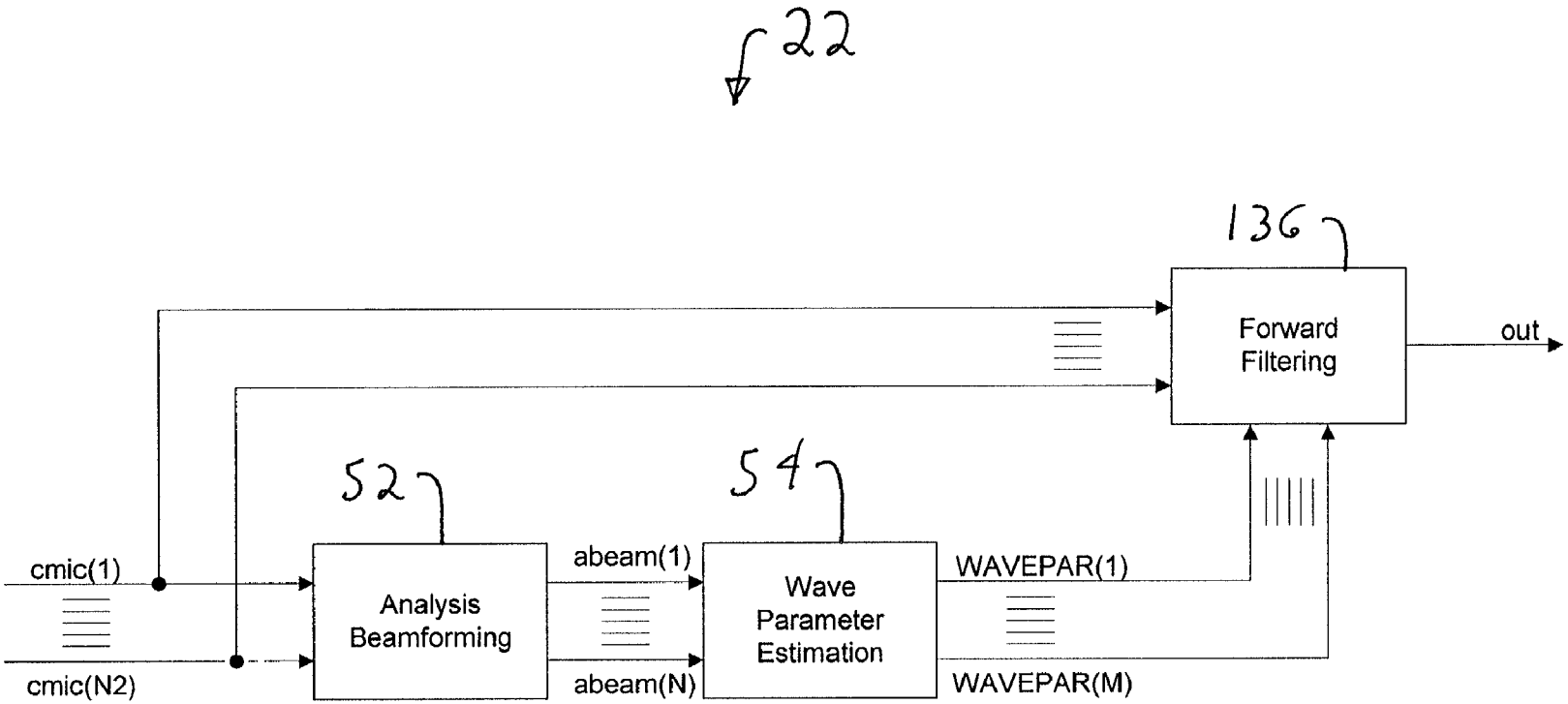
FIG. 17 is a block diagram according to another preferred embodiment of the present invention of the apparent incidence processor of FIG. 2.

Turning next to FIG. 17, a block diagram according to another preferred embodiment of the present invention of the apparent incidence processor 22 of FIG. 2 is shown. In this case, the forward filtering method is shown. As with the wave generation method (outlined with respect to FIG. 6, the processing runs in three stages with the first two being the same. First, analysis beamforming 52 is performed on the equalized microphone signals. Second, the parameters of the incoming sound waves are estimated in a wave parameter estimator 54. However, in the third stage of the forward filtering method, the wave parameters are used in the forward filter 136 to generate filter coefficients for a filter that is applied to the input signals.

Figure 18:
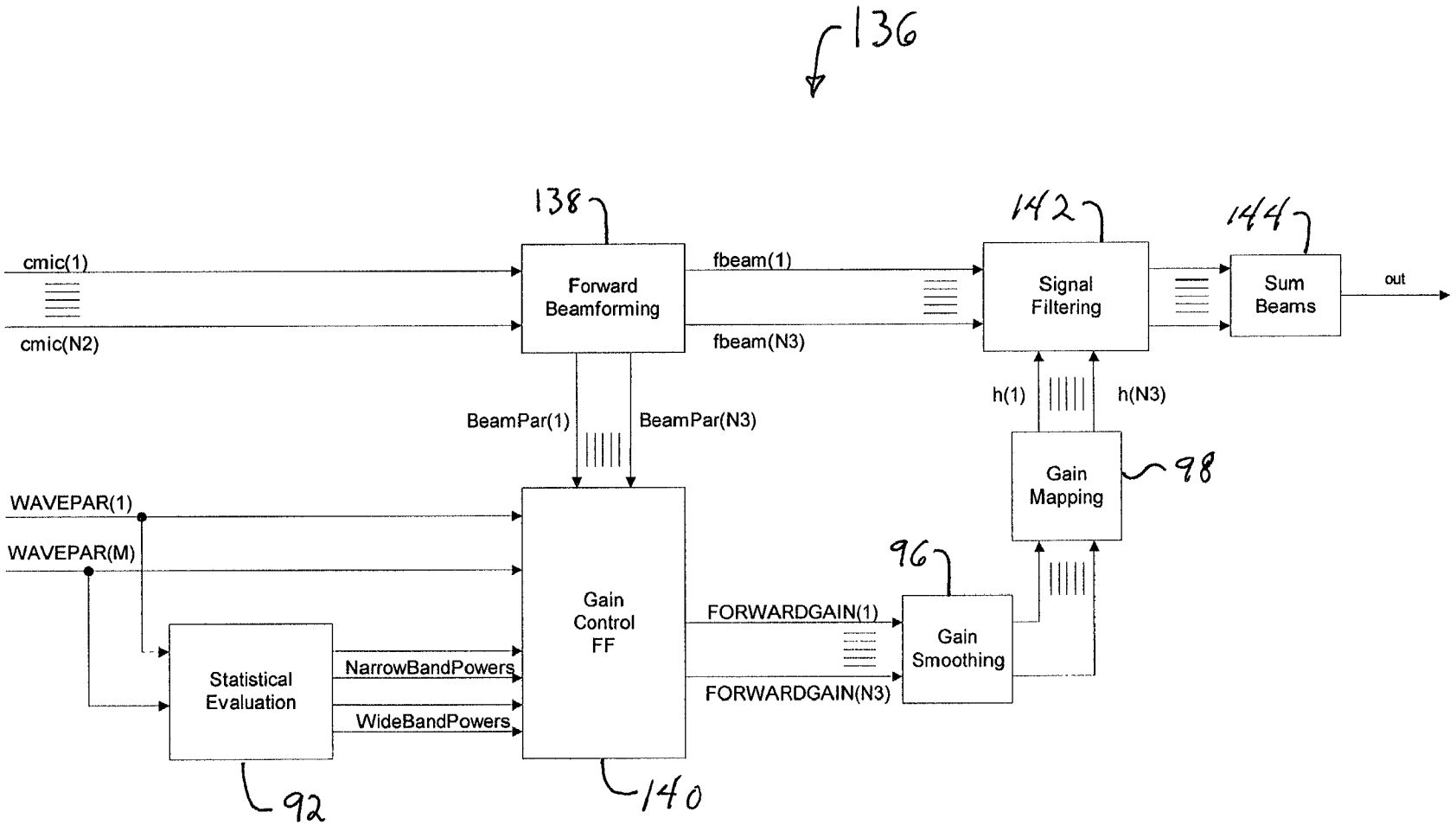
FIG. 18 is a block diagram of the forward filter of FIG. 17.

Turning now to FIG. 18, a block diagram of the forward filter 136 of FIG. 17 is shown. The forward filter 136 include a statistical evaluator 92, a gain smoother 96, and a gain mapper 98 like those described above with respect to FIG. 11. In addition, the forward filter 136 includes a forward beamformer 138, a forward filter (FF) gain controller 140, a signal filter 142, and a beam summer 144. The inputs are beamformed by the forward beamformer 138 to produce a number of forward beam signals that are filtered by the signal filter 142 and summed by the beam summer 144 to form the output. The filter responses, that the forward beams are filtered with, are controlled by the FF gain controller 140 that in turn uses the wave parameters as well as the statistically evaluated signal and noise powers from the statistical evaluator 92 to calculate the filter responses.

The forward beamformer 138 is optional and may be deleted leaving the input signals to be directly connected to the signal filter 142. When implemented, the forward beamformer 138 serves to remove noise from the signal thus enhancing the noise reduction performance achieved by the wave parameter controlled gain of the FF gain controller 140. The processing is similar to that of the analysis beamformer 52 of FIG. 6.

In an embodiment, the forward beamformer 138 is identical to the analysis beamformer 52 of FIG. 7. In this case, the fbeam signals are taken as the abeam outputs of the analysis beamformer 52.

In another embodiment, the forward beamformer 138 is in principle identical to the analysis beamformer 52 of FIG. 6 except that where the analysis beamformer 52 is optimized for frequency selectivity the forward beamformer 138 is optimized for low signal delay.

In a further embodiment, two fbeam signals are generated, that is, an omni directional signal and a narrow beam, for example a supercardioid.

Figure 19:
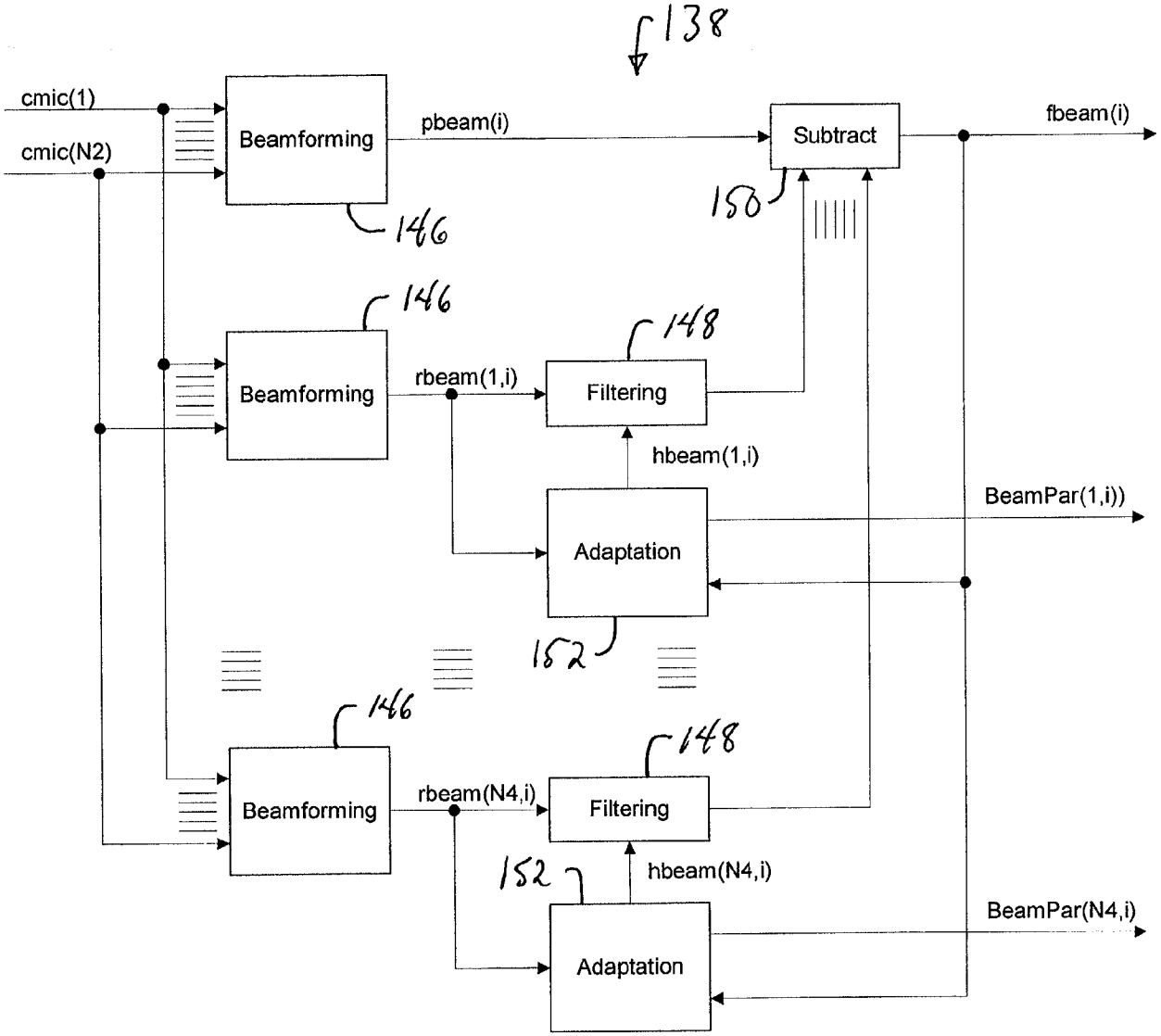
FIG. 19 is a block diagram of the forward beamformer of FIG. 18.

Turning now to FIG. 19, a block diagram of the forward beamformer 138 of FIG. 18 is shown. Unlike the embodiments of the forward beamformer 138 presented above, in this case, one or more of the fbeam signals may be generated with adaptive beamforming. The adaptive beamforming is achieved by first generating, through a plurality of beamformers 146, a number of fixed beam signals. The first being the target beam, pbeam, and the rest being one or more rear beams, rbeam(q). The rbeam signals are filtered by filters 148 and subtracted (150) from the pbeam to form the beamforming output. pbeam is an ordinary beam with full sensitivity at the target direction suppressing other directions to some extent. rbeam(q) is a number of different beam signals that all have zero sensitivity towards the target direction. The rbeam signals can thus be subtracted from the pbeam without influencing the signal coming from the target direction. The filter responses used to filter the rbeam signals are adapted by adaptors 152.

Figure 20:
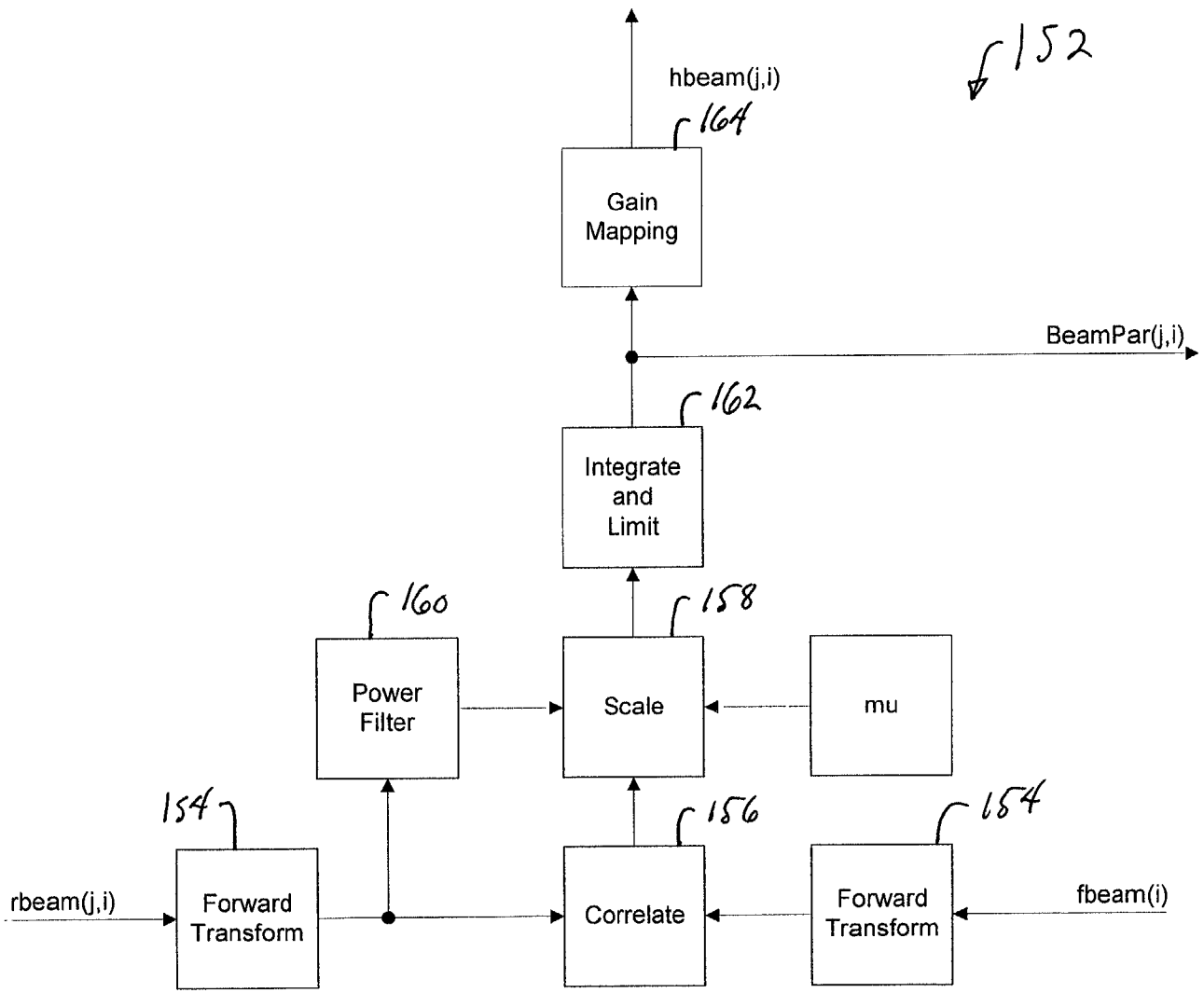
FIG. 20 is a block diagram of the adaptor of FIG. 19.

Turning now to FIG. 20, a block diagram of the adaptor 152 of FIG. 19 is shown. In the adaptor 152, the fbeam output and rbeam signal are converted to the frequency domain by forward transformers 154 and correlated by a correlator 156. The cross-correlation is scaled by scaler 158 with an adaptation speed constant, mu, and is normalized with a lowpass filtered estimate, from a power filter 160, of the power of the rbeam signal. The scaled cross-correlation is integrated, by integrator and limiter 162, to yield the adapted filter response in the time domain. Besides being integrated, the filter response needs to be limited to eliminate convergence and computation noise problems. To eliminate time domain aliasing, a gain mapping is performed on the adapted response by a gain mapper 164.

In an embodiment, the fbeam and rbeam signals are implemented in the frequency domain. The forward transforms 154 are thus not implemented.

In another embodiment, the correlator 156, the power filter 160, and the integrator and limiter 162 are implemented in the time domain. The rbeam and fbeam signals are likewise also implemented as time domain signals and the forward transformers 154 are omitted. As a result, the gain mapper 164 merely windows the filter response.

In yet another embodiment, the integrator and limiter 162 includes a forgetting factor causing the integrated response to tend towards zero during periods of no signal activity.

In a further embodiment, two microphones are positioned along the target axis. The forward beams include an adaptive beam fbeam(i1). pbeam(i1) is implemented with a beamformer 146 of FIG. 19 generating a supercardioid for the target direction as implemented by the beamformer filters defined in (29) below. A single rear beam is used at the adaptive beamforming, rbeam(1,i1). It is a cardioid in the reverse direction of the target direction as described by the component filters of (30) below. (29) and (30) describe two beamformers 146 in the frequency domain.

$$\begin{cases} PBEAM(i1) = CMIC(1) * H1 + CMIC(2) * H2 \\ H1(\omega) = \dfrac{\exp(-j\cdot\omega\cdot t0)}{1-\exp\left(-j\cdot\omega\cdot\dfrac{d(2)}{c}\cdot(1+e)\right)} \\ H2(\omega) = \dfrac{\exp\left(-j\cdot\omega\cdot\left(t0+e\cdot\dfrac{d(2)}{c}\right)\right)}{1-\exp\left(-j\cdot\omega\cdot\dfrac{d(2)}{c}\cdot(1+e)\right)} \end{cases} \tag{29}$$

$$\begin{cases} RBEAM(1, i1) = CMIC(1) * H3 + CMIC(2) * H4 \\ H3(\omega) = \dfrac{\exp\left(-j\cdot\omega\cdot\left(t0+\dfrac{d(2)}{c}\right)\right)}{1-\exp\left(-j\cdot\omega\cdot\dfrac{d(2)}{c}\cdot 2\right)} \\ H2(\omega) = \dfrac{\exp(-j\cdot\omega\cdot(t0))}{1-\exp\left(-j\cdot\omega\cdot\dfrac{d(2)}{c}\cdot 2\right)} \end{cases} \tag{30}$$

In (29) and (30), e is constant in the range 0.5 to 1 and d(2) is the microphone spacing.

In a still further embodiment using at least one adaptive forward beam, in FIG. 19 the pbeam signal for this forward beam is taken as the microphone signal cmic(1) directly without the use of the beamformer 146.

Figure 21:
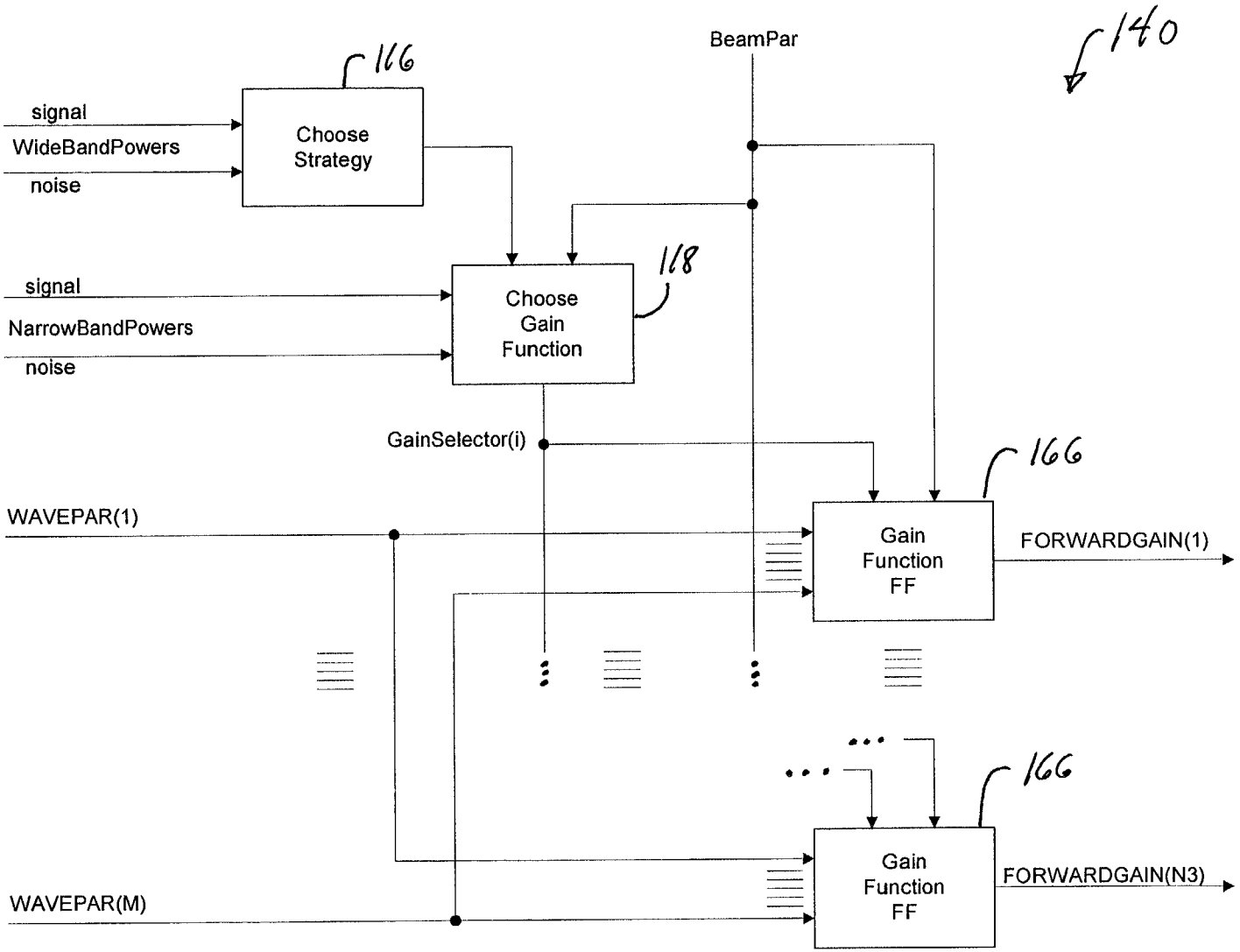
FIG. 21 is a block diagram of the forward filter gain controller of FIG. 18.

Turning now to FIG. 21, a block diagram of the forward filter gain controller 140 of FIG. 18 is shown. The FF gain controller 140 is similar to the WG gain controller 94 of FIG. 13. The strategy chooser 116 and the gain function chooser 118 are comparable to those in FIG. 13 above. A few differences exist between the gain controllers though as will be described below.

The signal filtering in the forward filtering embodiments can be based on already beamformed input signals. The FF gain controller 140 therefore has to compensate for the directivity and near field characteristics of the forward beams. The BeamPar signal carries enough information about the forward beam that a plurality of FF gain function appliers 166 can compute a gain that implements the target directivity as shown, for example, in the polar plots of FIG. 14. For static forward beamformers 138 of FIG. 18, the BeamPar signal is not needed. The beam directivity can be "hard coded" into the individual FF gain function appliers 166.

Figure 22:
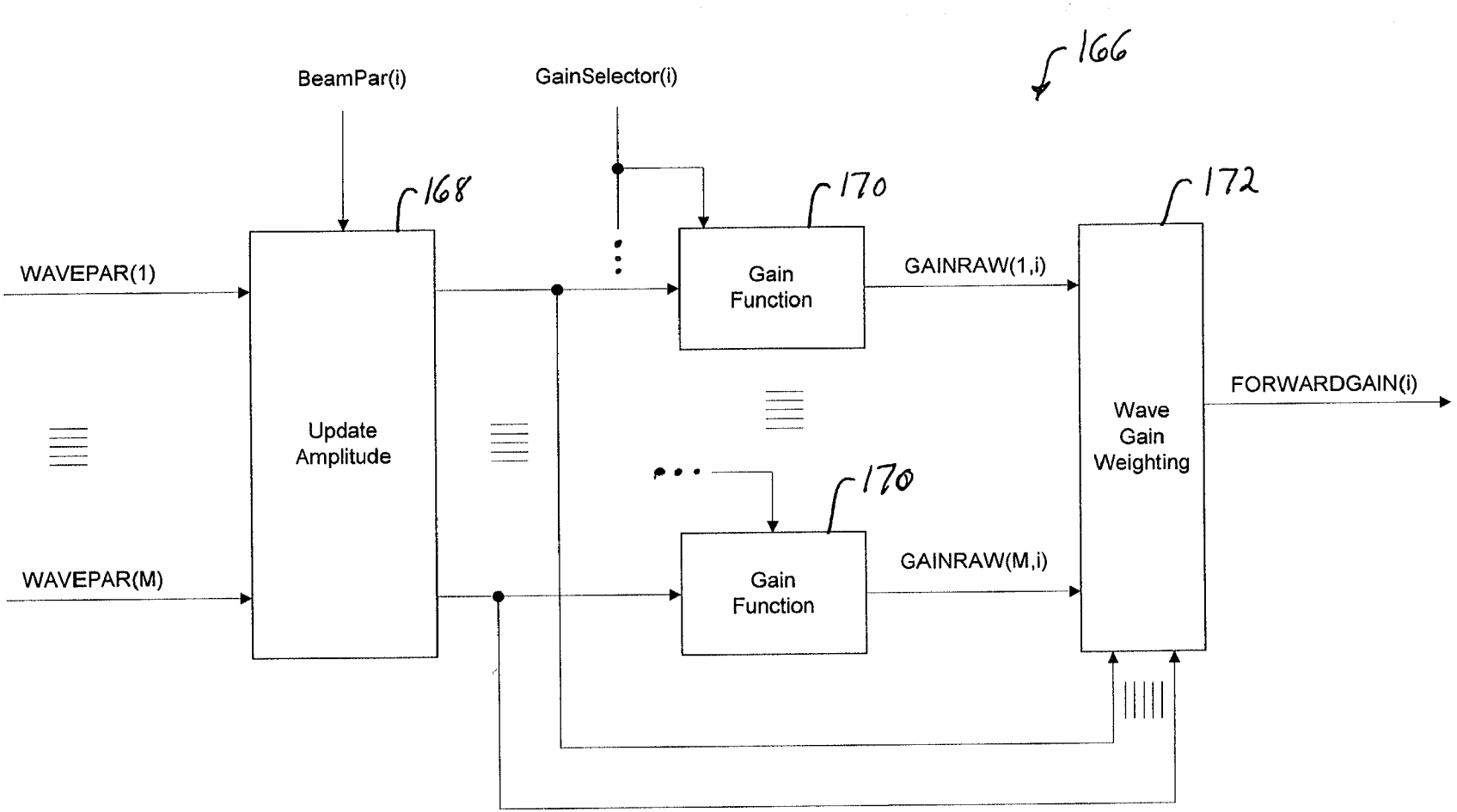
FIG. 22 is a block diagram of the forward filter gain function applier of FIG. 21.

Turning now to FIG. 22, a block diagram of the forward filter gain function applier 166 of FIG. 21 is shown. The FF gain function applier 166 includes an amplitude updater 168, a plurality of gain function appliers 170, and a wave gain weighter 172. In the amplitude updater 168, the wave amplitude is corrected to take the characteristics of the forward beamformer into account. The gain function applier 170 implements, for each wave, the directivity, amplitude, damping, and like responses in the same manner as described for the gain function appliers 120 of FIG. 13. Since the forward beam contain all waves but can only be assigned a single gain value, all of the different wave gains must be summarized. This is done in the wave gain weighter 172.

In an embodiment, all of the forward beams are static. The beam dependency has been included with the pre-computed tables for the gain function chooser 118 of FIG. 21 and thus the amplitude updater 168 is not used.

In another embodiment, the FORWARDGAIN(i) signal is taken as the maximal of the wave gains GAINRAW(j,i).

In yet another embodiment, the FORWARDGAIN(i) signal is taken as the minimal of the wave gains GAINRAW (j,i).

In still another embodiment, the FORWARDGAIN(i) signal is the power weighted average of the individual wave gains as defined in (31) below.

$$FORWARDGAIN(i) = \frac{\sum_m |A_m|^2 \cdot GAINRAW(m, i)}{\sum_m |A_m|^2} \tag{31}$$

In a further embodiment, at least one static forward beam signal and at least one adaptive beam signal are implemented. The FF gain function applier 166 monitors and analyses the BeamPar signal from the adaptive beam over time. When the BeamPar signal is stable, indicating a significant noise signal from a constant direction, then the GainSelector signal is switched to use the adaptive beam mainly to build the output. When the BeamPar signal resembles random noise, then the GainSelector signal is switched to remove the adaptive beam from the output.

Returning to FIG. 18, there are a number of embodiments of the signal filter 142 that are possible. In one embodiment, the signal filter 142 is performed in the time domain with FIR or IIR filters. In another embodiment, the signal filter 142 is performed in the time domain within frequency bands. In yet another embodiment, the signal filter 142 is performed in the frequency domain.

Figure 23:
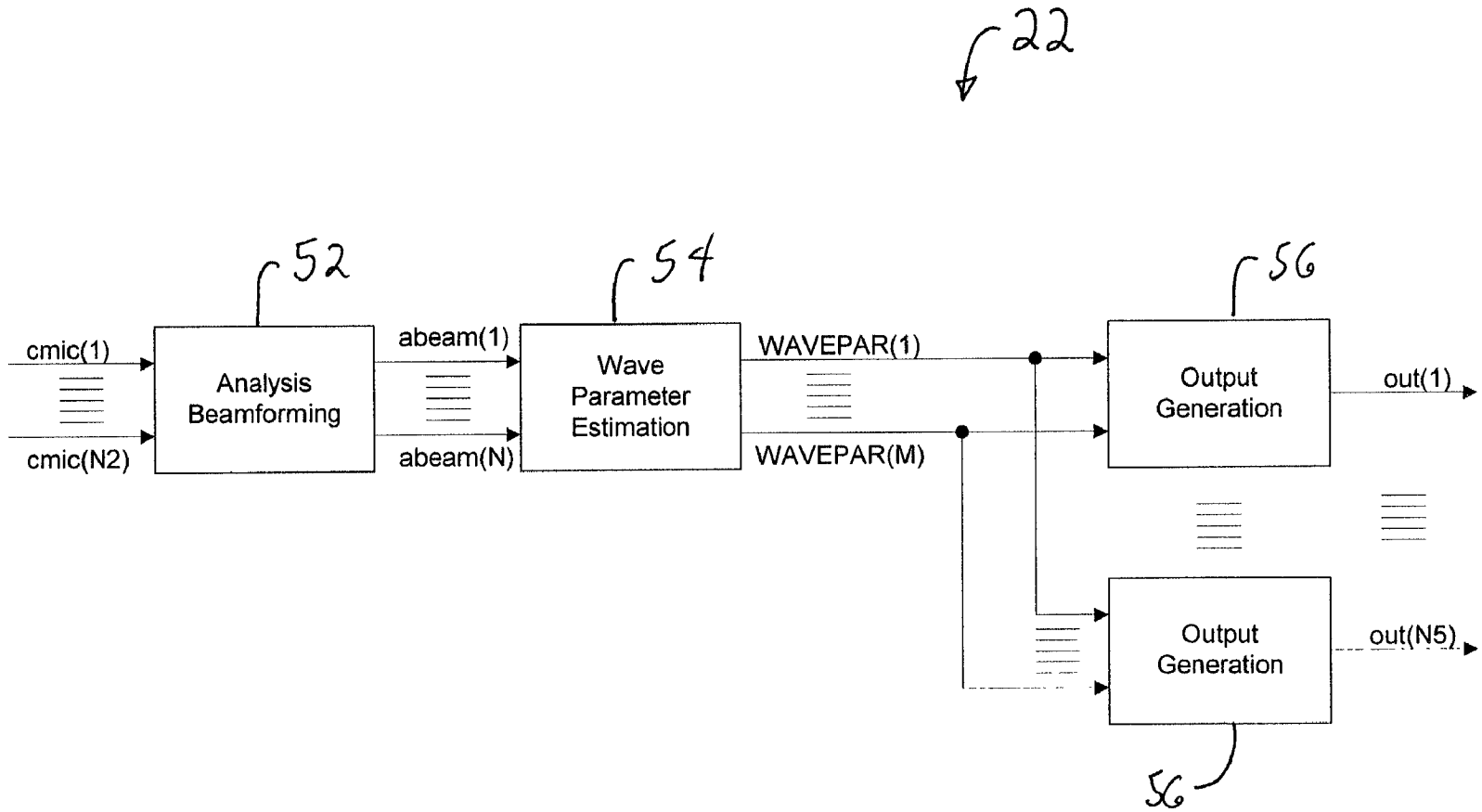
FIG. 23 is a block diagram of a multiple output embodiment of the wave generation method.
Figure 24:
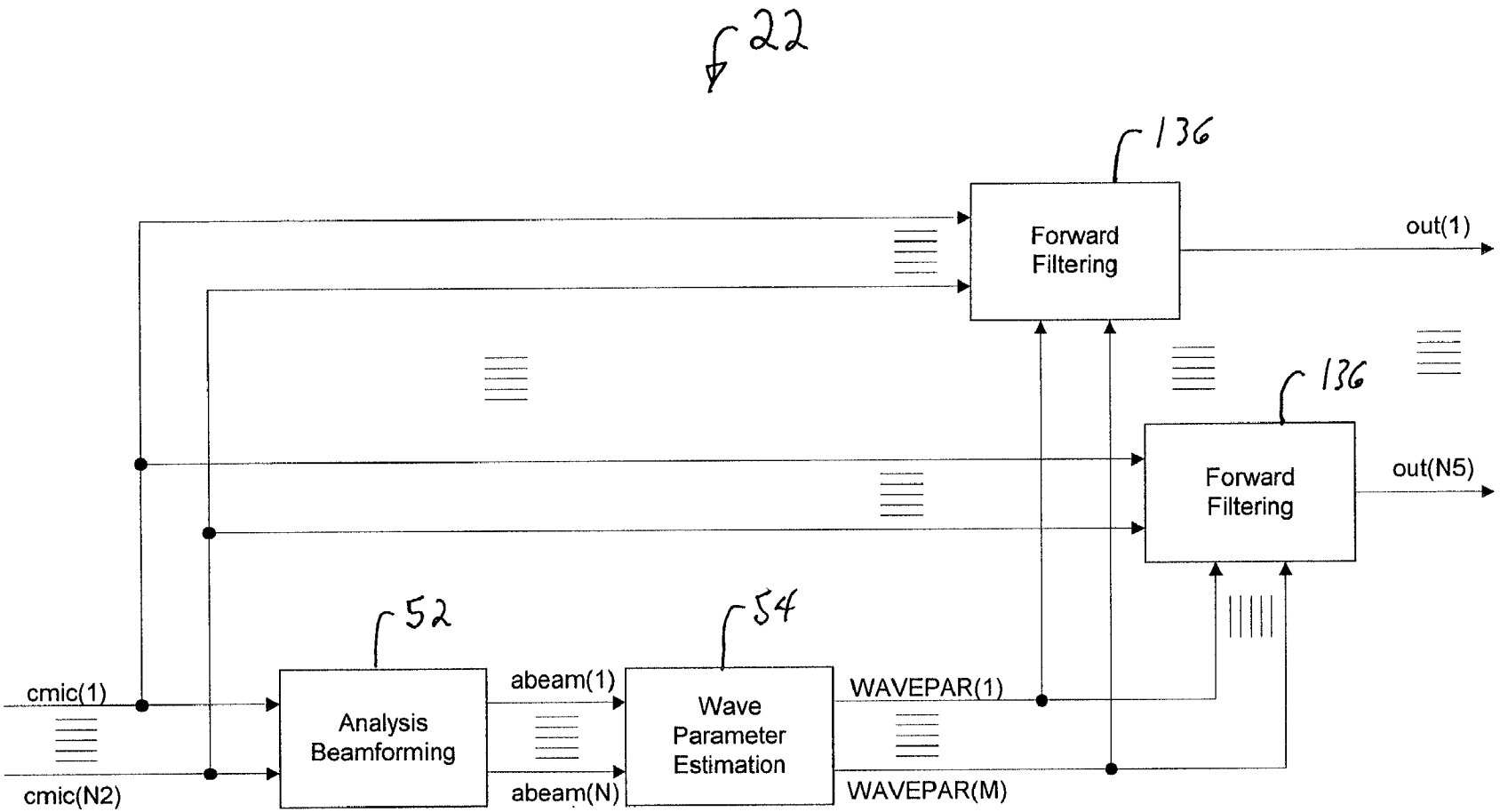
FIG. 24 is a block diagram of a multiple output embodiment of the forward filtering method.

In addition to the single output embodiments of the apparent incidence processors 22 of FIGS. 6 and 17, it is also possible to generate more than a single output. FIGS. 23 and 24 show corresponding multiple output embodiments of the wave generation method and the forward filtering method, respectively.

In an embodiment of either method, two outputs are generated. The first output contains the sum of the near field waves while the second output contains the sum of the far field waves.

In another embodiment of either method, there are N5 different outputs generated.

Each output contains the sum of the waves originating from a specific range of directions.

In yet another embodiment of either method, again there are N5 different outputs generated. Each output contains the sum of the waves originating from a specific range of directions. The wide band power of the waves in the sound field is measured. The individual output generation blocks are controlled in a way such that the first output is always generated using a range of directions centered around the origin of the wave with the largest power.

Figure 25:
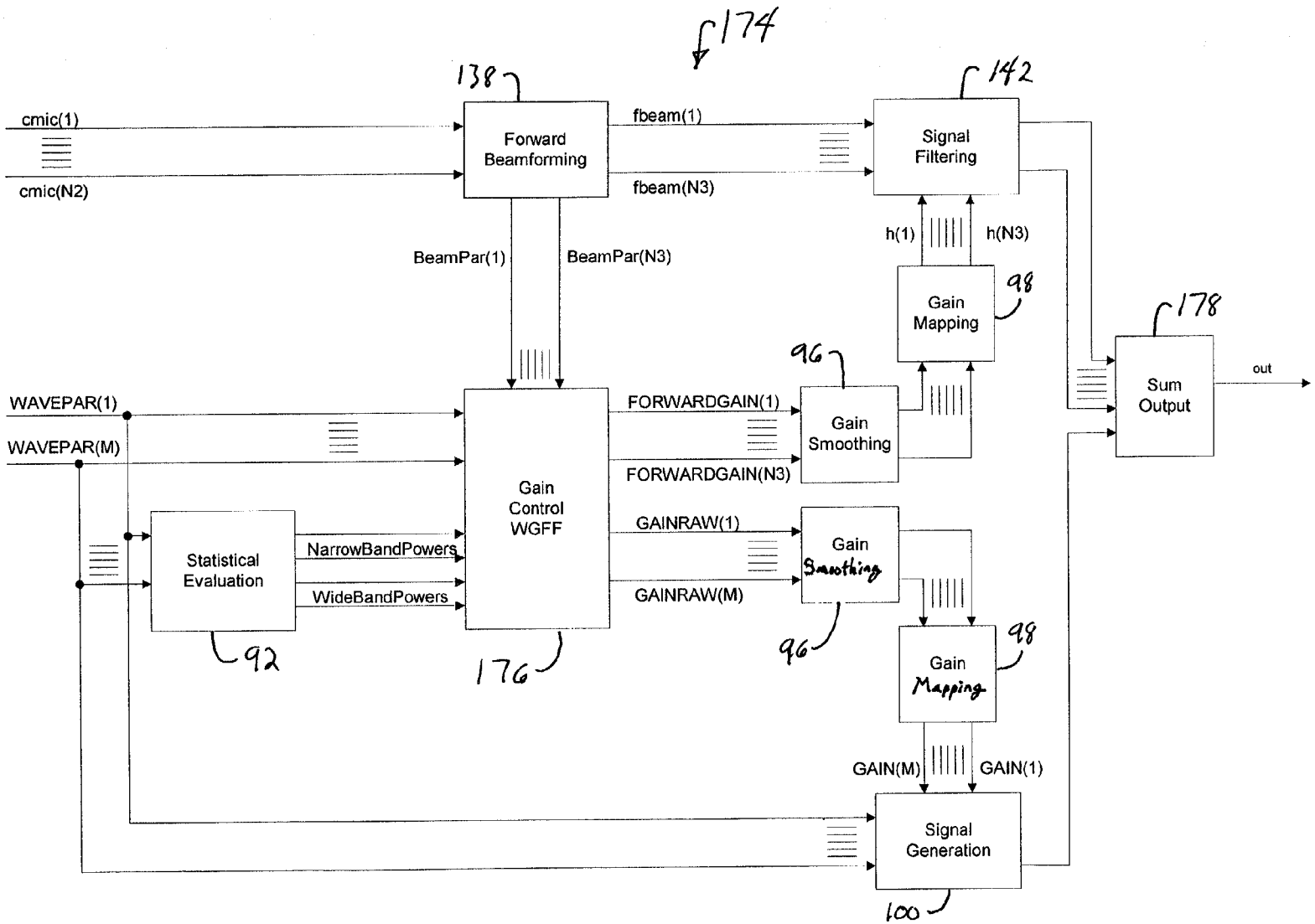
FIG. 25 is a block diagram of a forward filter/output generator.

To this point of the discussion, embodiments have been described that employed either the wave generation method or the forward filtering method. It is also possible to combine the two methods. One simply replaces the forward filter 136 of FIG. 17 with a forward filter/output generator 174 that performs both methods. Turning now to FIG. 25, a block diagram of a forward filter/output generator 174 is shown. The forward filter/output generator 174 is a combination of the output generator 56 of FIG. 11 and the forward filter 136 of FIG. 18. The various elements are substantially similar except for a wave generator/forward filter (WGFF) gain controller 176 and an output summer 178. The forward filter/output generator 174 contains two output paths. The outputs from both paths are summed by the output summer 178 to yield the combined output.

Figure 26:
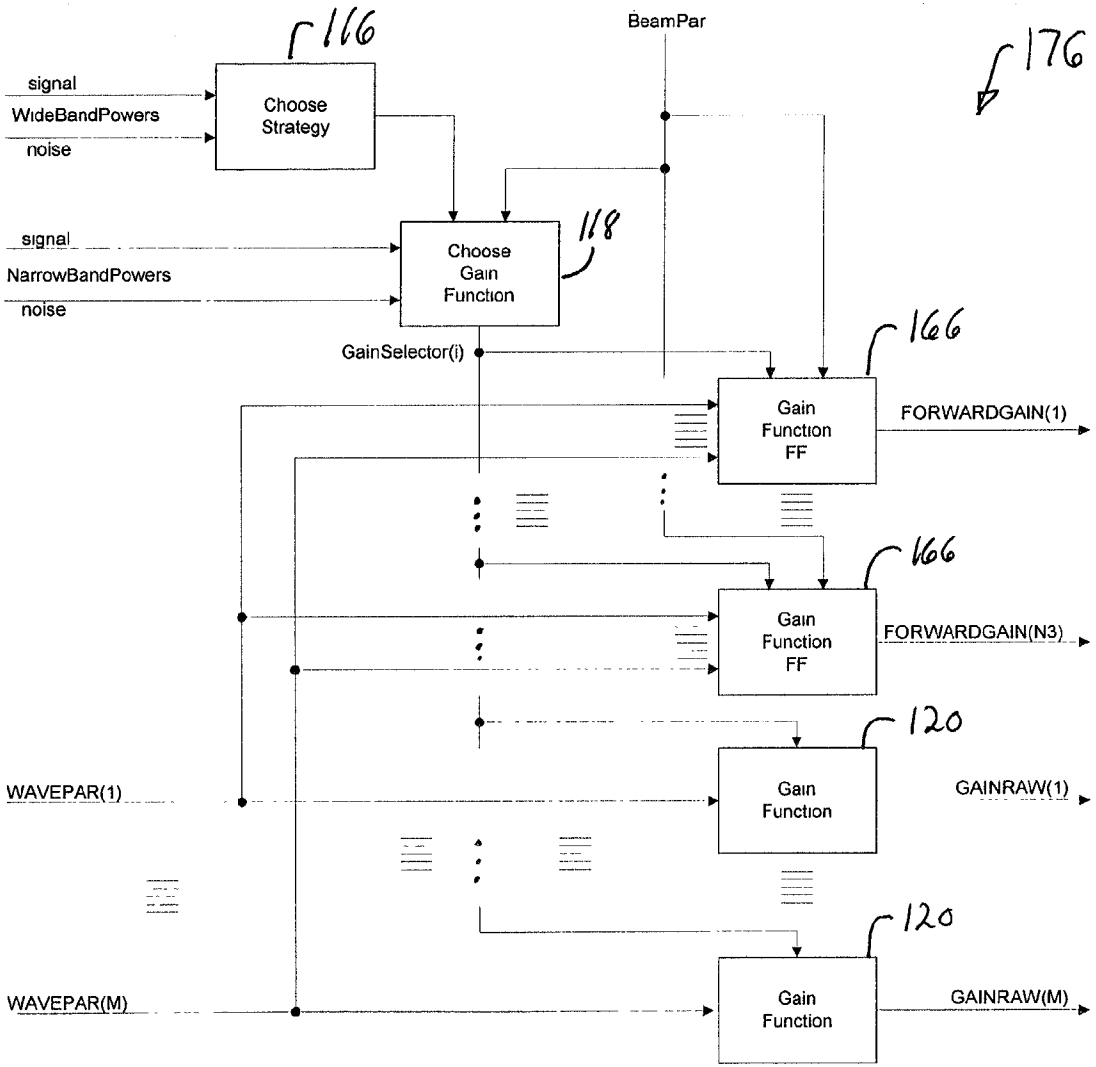
FIG. 26 is a block diagram of the wave generator/forward filter gain controller of FIG. 25.

Turning now to FIG. 26, a block diagram of the WGFF gain controller 176 of FIG. 25 is shown. As with the forward filter/output generator 174 of FIG. 25, the functioning of the WGFF gain controller 176 follows from the descriptions of the WG gain controller 94 of FIG. 13 and the FF gain controller 140 of FIG. 21, respectively.

In a specific embodiment utilizing both the wave generation method and the forward filtering method, the WGFF gain controller 176 chooses the gain function so that: at high signal to noise ratios, forward filtering is the primary contributor to the output; and at low signal to noise ratios, wave generation is the primary contributor to the output.

In the embodiments so far the process of finding gains for the waves of the sound has included two main steps, that is, finding the parameters of the waves and deriving a gain based on the parameters found. Both these main processes can be described by mathematical transforms, as depicted in (32) below, and in many cases they are best implemented using techniques known from mathematical pocket calculators Mathematically the gain may be described as a transform directly of the inputs as described in (33) below.

$$\begin{cases} waveparameters = f1(soundpressures) \\ gains = f2(waveparameters) \end{cases} \tag{32}$$

$$\begin{cases} gains = f3(soundpressures)) \\ f3(.) = f2(f1)(.)) \end{cases} \tag{33}$$

Figure 27:
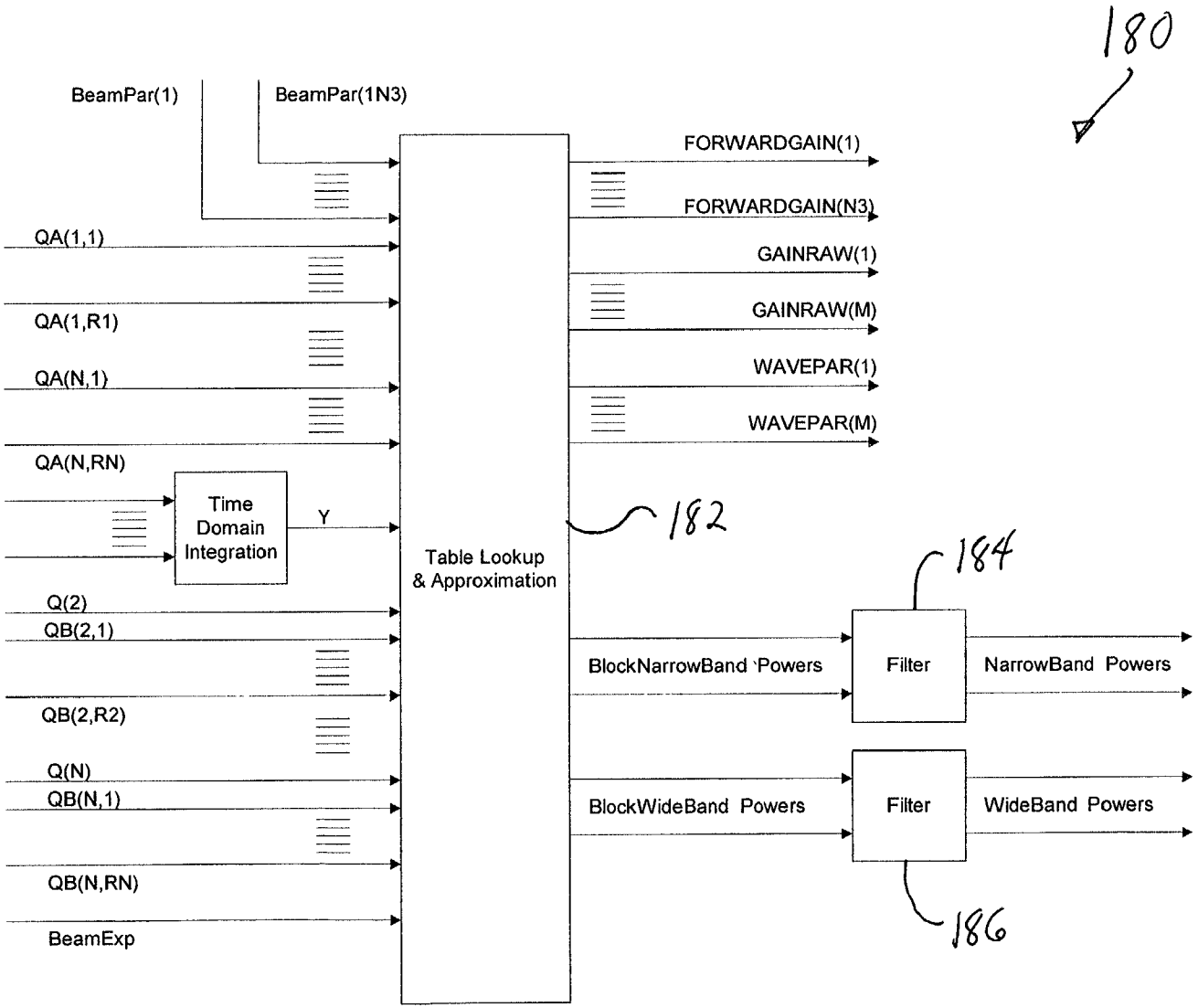
FIG. 27 is a block diagram of a single combined mathematical transform processor.

Turning now to FIG. 27, a block diagram of a single combined mathematical transform processor 180 is shown. The combined processor 180 utilizes both the wave generation method and the forward filtering method to implement the core equation solving and the gain control. This implementation is especially useful with portable devices because the size of the table used for the mathematical transform may be greatly reduced as the gain may be described using fewer bits than needed for the description of the wave parameters. The input signals for core solving, P, Q, QA, QB, and BeamExp, as well as the gain control inputs BeamPar and the statistical power measures are inputs to a table lookup and approximation unit 182 similar to that of FIG. 10. The table lookup directly yields the raw gains as output. The statistical evaluation is also performed with the help of the table lookup and approximation unit 182. It contains a model of the mapping from input values to wave parameters to power values. The BlockNarrowBandPowers and Block- WideBandPowers signals contain the power estimates for the current block of samples. In the NarrowBand filter 184 and the WideBand filter 186, the block estimates are low pass filtered with appropriate time constants to yield the narrow band and wide band power signals, respectively. Note that the combined processor 180 still needs to solve for and output the wave parameters that are needed in order for the wave generation method to function. In pure forward filtering method embodiments contrarily, there will be no need to output the wave parameters.

Assume that a specific example exists that uses two microphones and that uses forward filtering of the first microphone signal without any beamforming. A single table lookup implements the combined core solving of the sound field equations and the gain control. No statistical evaluation is performed. The inputs to the table lookup are the magnitude and the phase of the ratio Q(2) of the quotient signal obtained when, in the frequency domain, the second microphone signal is divided by the first microphone signal. The phase of Q(2) is quantized to one of thirty two possible phases covering the total complex phase range. The magnitude of Q(2) is quantized to one of 512 possible magnitudes covering the range from 0.01 to 100. The gain is stored as a binary value of either one or zero. The table thus implemented requires 16 Kb of storage capacity.

For applications where speech is to be picked up from the wearer of a headset, as in a mobile phone, a hearing protector, or the like, two main directions regarding noise suppression have until now been used. The most effective method has been the use of so-called noise-canceling microphones. These microphones amplify near field signals while attenuating far field signals. Unfortunately, noise-canceling microphones have to be placed no farther than two to three centimeters away from the speech source in order to be effective. This may not always be possible or convenient. Another method has been to use directional microphones pointing towards the mouth of the wearer. Unfortunately, a directional microphone can make no distinction between near and far field signals and thus it will not offer as large of a noise reduction as is possible with a properly placed noise-canceling microphone. A preferred near field embodiment of the present invention enables signal processing methods with which it is possible to produce sound pick-up with near field characteristics. It is possible to obtain noise reduction better than that possible with noise-canceling microphones. Furthermore, it is possible to maintain the near field characteristic with its noise reducing virtues at a distance further away from the speech source than is possible with conventional noise-canceling microphones.

The near field method works by dividing the input signal into a number of frequency bands. In each band, the input signals are analyzed to see whether the activity in that band is due to near field sources or to far field sources. If the activity is from near field sources, then that band is replicated in the output with a high gain and otherwise it is replicated with a low gain.

Figure 28:
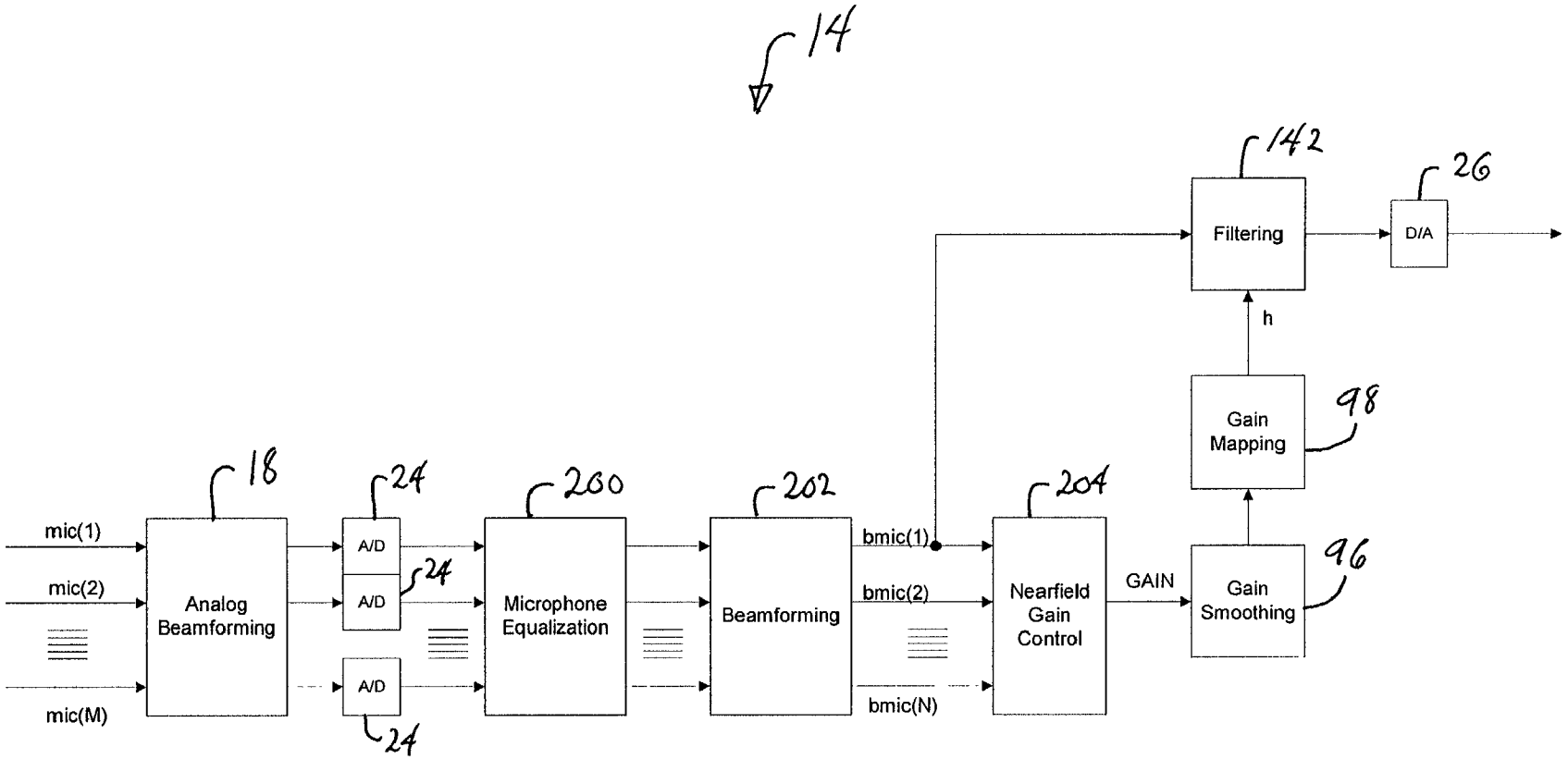
FIG. 28 is a block diagram of a near field embodiment of the audio processor of FIG. 1.

Turning now to FIG. 28, a block diagram of a near field embodiment of the audio processor 14 of FIG. 1 is shown. The near field processor shown is especially well suited for applications where only sound from sources near to the microphones 12 for FIG. 1 should be amplified. Examples of such applications include mobile phones, headsets, and the like. The near field processor includes an analog beamformer 18, at least one A/D converter 24, and at least one D/A converter 26 that are similar to those of FIGS. 2 and 3 above. Also, the near field processor includes a gain smoother 96, a gain mapper 98, and a filter 142 that are similar to those of FIG. 18. Finally, the near field processor includes a microphone equalizer 200, a beamformer 202, and a near field gain controller 204. During operation, the microphone signals are converted to digital signals, the microphone sensitivities are equalized, and optional beamforming is performed to yield the bmic signals. The first output signal is taken as the reference input bmic(1) filtered with the filter response h. The near field gain controller 204 derives a gain in frequency bands. This gain directly yields the filter response h when mapped from the domain of the gain control to the domain of the filtering. The near field processor utilizes a gain function that maps the input pressures directly into band gain.

Figure 29:
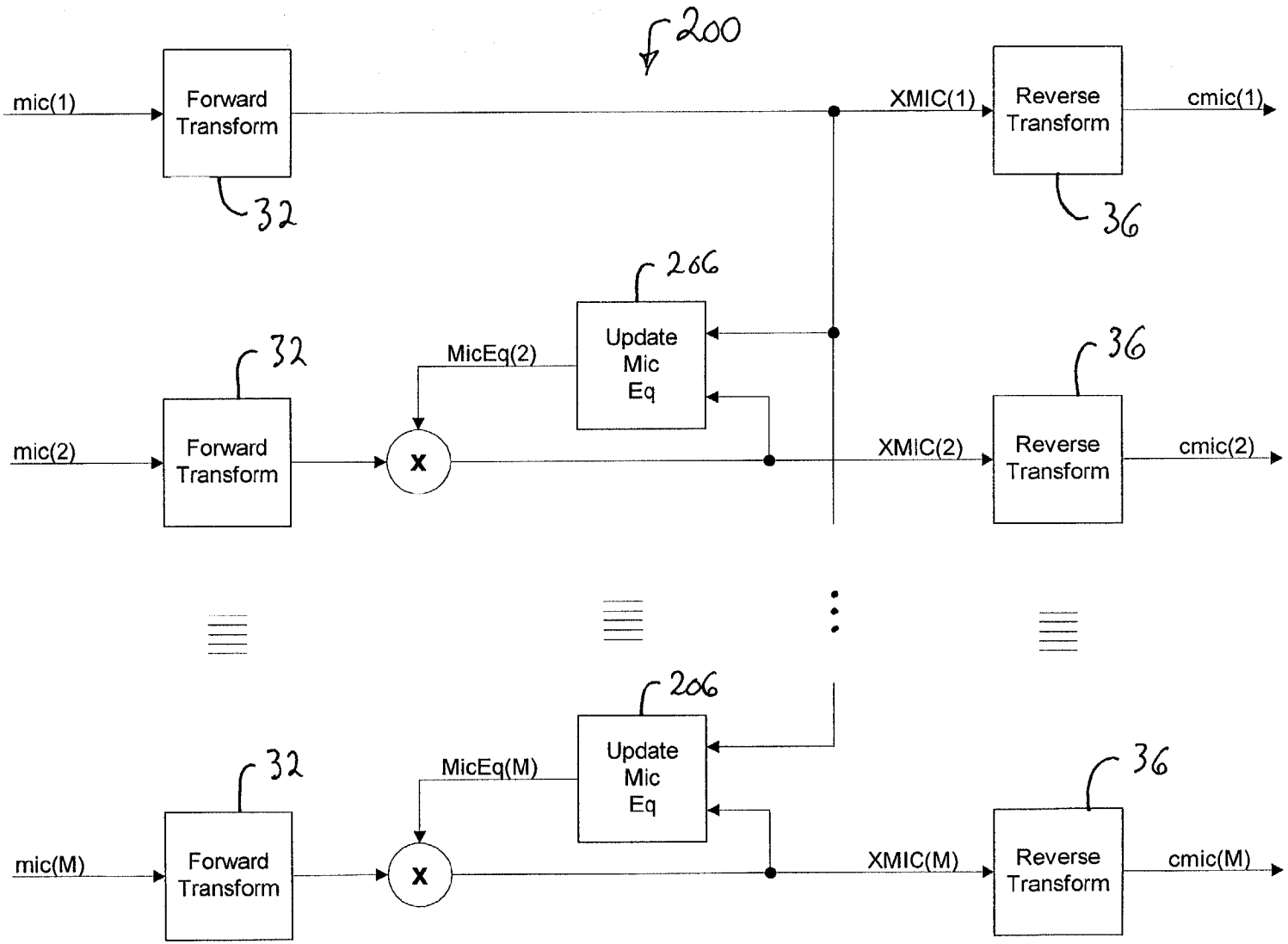
FIG. 29 is a block diagram of the microphone equalizer of FIG. 28.

Turning now to FIG. 29, a block diagram of the microphone equalizer 200 of FIG. 28 is shown. The microphone equalizer 200 includes a plurality of forward transformers 32 and a plurality of reverse transformers 36 that are similar to those in FIG. 4. In addition, the microphone equalizer 200 includes a plurality of microphone equalization updaters 206. In the microphone equalizer 200, one microphone, mic(1), is chosen as the reference. The signals from the other microphone inputs are filtered so that the equalized microphone signals, cmic(i), all have the same absolute sensitivity to sound pressure levels. In the present case, the equalization is performed by multiplying with a frequency dependent gain, MicEq(i), in the frequency domain. MicEq(i) can be a static gain, measured and saved, for example, at production test time or MicEq may also be updated dynamically.

Figure 30:
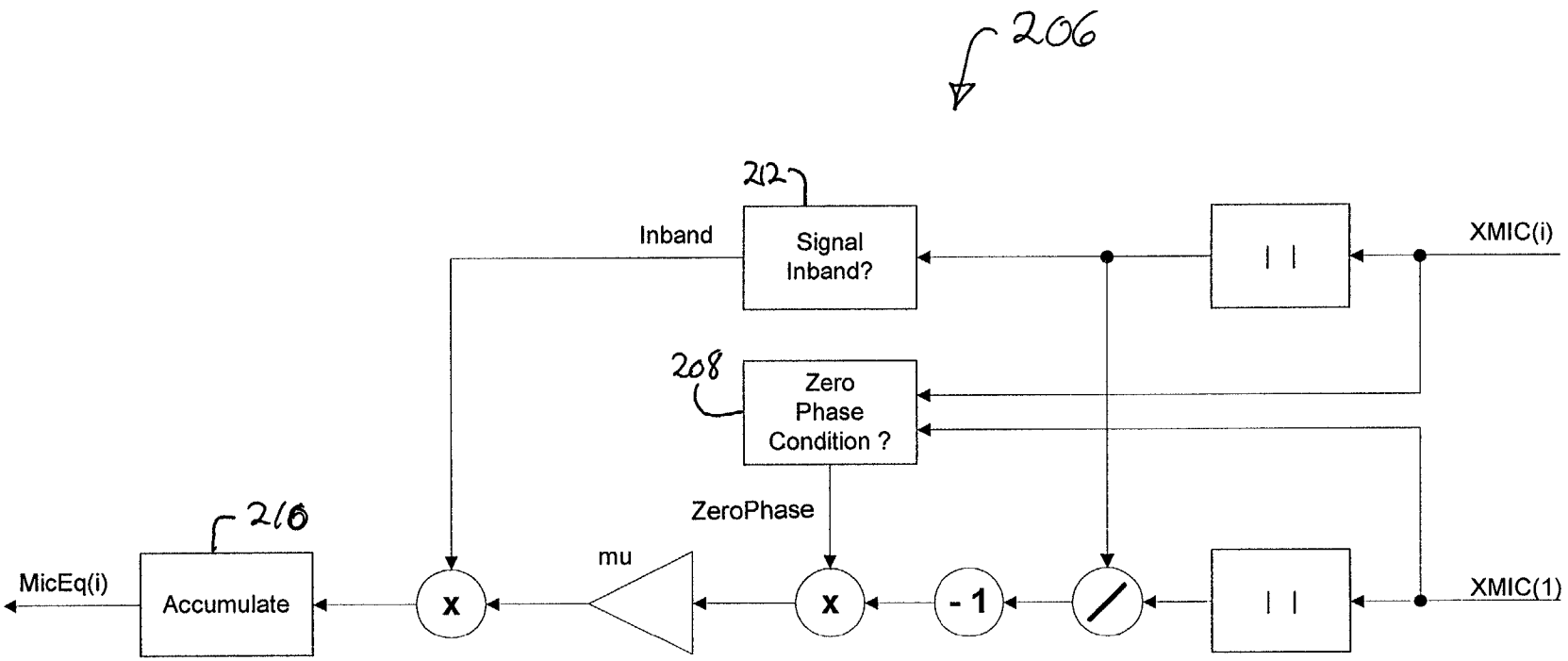
FIG. 30 is a block diagram of the microphone equalization updater of FIG. 29.

Turning now to FIG. 30, a block diagram of the microphone equalization updater 206 of FIG. 29 is shown. During operation, the phase of the reference microphone signal is compared with the phase of the normalized signal of the microphone to be equalized. In most applications, to utilize near field microphones, there will exist a limited range of directions of sound incidence for which the sound wave must arrive with the same absolute amplitude at both microphone locations, that is, mic(1) and mic(i). When the phase indicates that the direction of sound incidence is such, then the zero phase condition detector 208 outputs a logic one as its ZeroPhase signal output and otherwise the output will be a logic zero. When the quotient of the magnitudes of the reference microphone and the current microphone minus one is gated with the ZeroPhase switch signal and scaled with a small constant mu, a signal results that is suitable for accumulating in accumulator 210, to yield a MicEq signal that will equalize the current microphone. It is well known that frequency transforms usually spills energy between bands, therefore the update is gated with an Inband switch signal, from a signal inband detector 212, that will only be a logic one if the energy in the respective band stems from content within the band and otherwise the Inband signal will be a logic zero.

In an embodiment, the accumulator 210 is divided into static and dynamic parts, where the updates only influence the dynamic parts. The effective equalization response is the product of the static and dynamic parts.

In another embodiment, the static part of the equalization response is measured with standard measuring techniques once at the time of production test or at some other convenient time and saved.

In yet another embodiment, a forgetting factor is included with the dynamic part of the accumulator 210. The forgetting factor causes the dynamic response to converge towards zero when no updates are received.

In a further embodiment, means are provided that can save the accumulated equalization response when the near field audio processor is powered down and read the saved response again when the processor is powered up the next time.

In yet a further embodiment, the microphones used have the same directivity and frequency response except for the small tolerances that the microphone equalizer 200 of FIG. 28 should be able to compensate for. When the direction of sound incidence of a sound wave is perpendicular to an axis connecting the reference microphone with the current microphone, then the sound wave must arrive with the same amplitude at both microphones. This perpendicular condition is detected by comparing the phases of the two microphone signals in the zero phase condition detector 208. If the phases differ by less than a certain tolerance, then the ZeroPhase signal is generated as a logic one and otherwise it is generated as a logic zero.

In still another embodiment, the signal inband detector 212 for each frequency band evaluates the absolute value of its input signal in the current band and the two nearest neighboring bands. If the current band carries the highest absolute value, then the Inband signal for the current band is generated as a logic one and otherwise it is generated as a logic zero.

Figure 31:
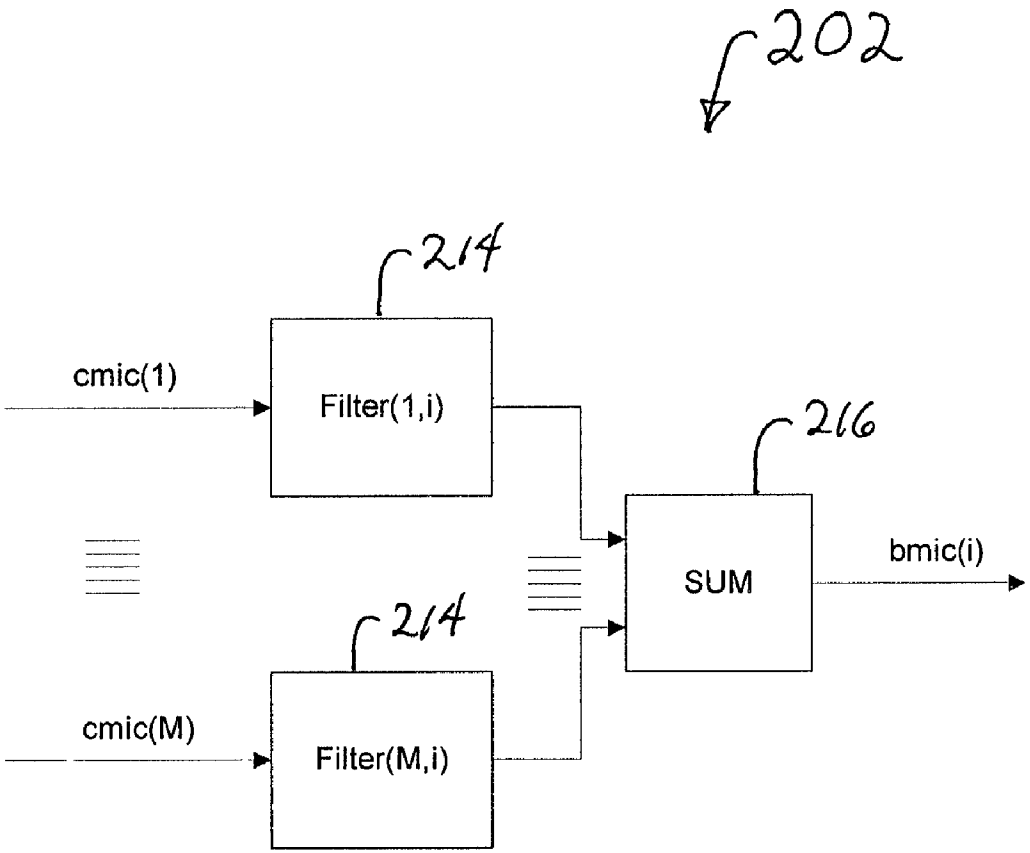
FIG. 31 is a block diagram of the beamformer of FIG. 28.

Turning now to FIG. 31, a block diagram of the beamformer 202 of FIG. 28 is shown. The beamformer 202 is similar to the beamformer 52 of FIG. 7 and also includes a plurality of filters 214 and a summer 216. Again the beamformer 202 is optional and may be omitted. When implemented, the aim of the beamforming process is to remove noise from the signal prior to the near field gain and filter processing, thereby enhancing the performance of these portions of the process. As shown for a single output channel, the microphone inputs are filtered with separate filters and summed to yield the beam output.

In an embodiment, M microphones are placed along a common axis. The microphone signals are pair wise beamformed to yield N=M1 beams with identical directivity response.

In a variation of the embodiment above, the beams are supercardioids.

In another variation, the beams are figures of eight.

In another embodiment, the beamforming is performed in the time domain with FIR or IIR filters.

In yet another embodiment, the beamforming is performed in the frequency domain.

Figure 32:
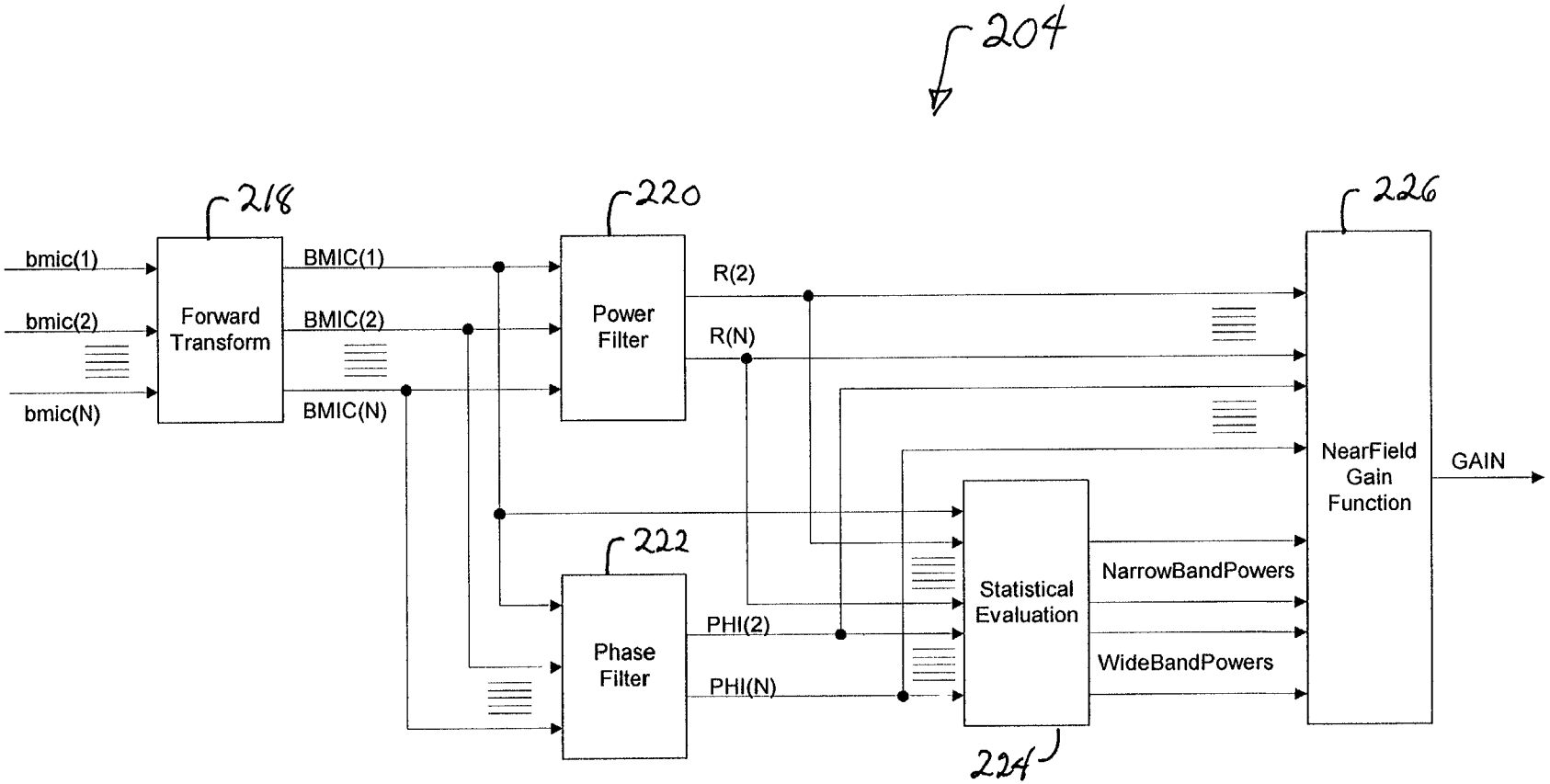
FIG. 32 is a block diagram of the near field gain controller of FIG. 28.

Turning now to FIG. 32, a block diagram of the near field gain controller 204 of FIG. 28 is shown. The near field gain controller 204 includes a forward transformer 218, a power filter 220, a phase filter 222, a statistical evaluator 224, and a near field gain function applier 226. The beam signals are split in frequency bands or converted to the frequency domain in the forward transformer 218. In the power filter 220, the signal powers are measured with a given time constant. The outputs from the power filter 220, R(i), give the ratio between the power of the current microphone signal and the power of the reference microphone signal bmic(1). In the phase filter 222, the filtered signal phases are compared. The PHI(i) outputs give the difference between the unwrapped phase of the current microphone and the unwrapped phase of the reference microphone bmic(1). The statistical evaluator 224 measures the signal and noise powers of different bandwidths and time constants. In the near field gain function applier 226, the raw channel gains are derived.

In an embodiment, the gain control processing is performed on blocks of samples. For each block, a single complex signal value per frequency band is computed. The power and phase filters 220, 222 only use the values from the current block to compute their respective outputs.

In another embodiment, the power and phase filters 220, 222 averages the signal powers and phases over consecutive blocks.

In yet another embodiment, the phase averaging is power weighted.

In still another embodiment, no phase information is utilized.

In a further embodiment, the forward transformer 218 is implemented with a time domain filterbank, no phase information is generated or used, and the signal powers are measured with a finite time constant.

In yet a further embodiment, the forward transformer 218 is FFT based.

Figure 33:
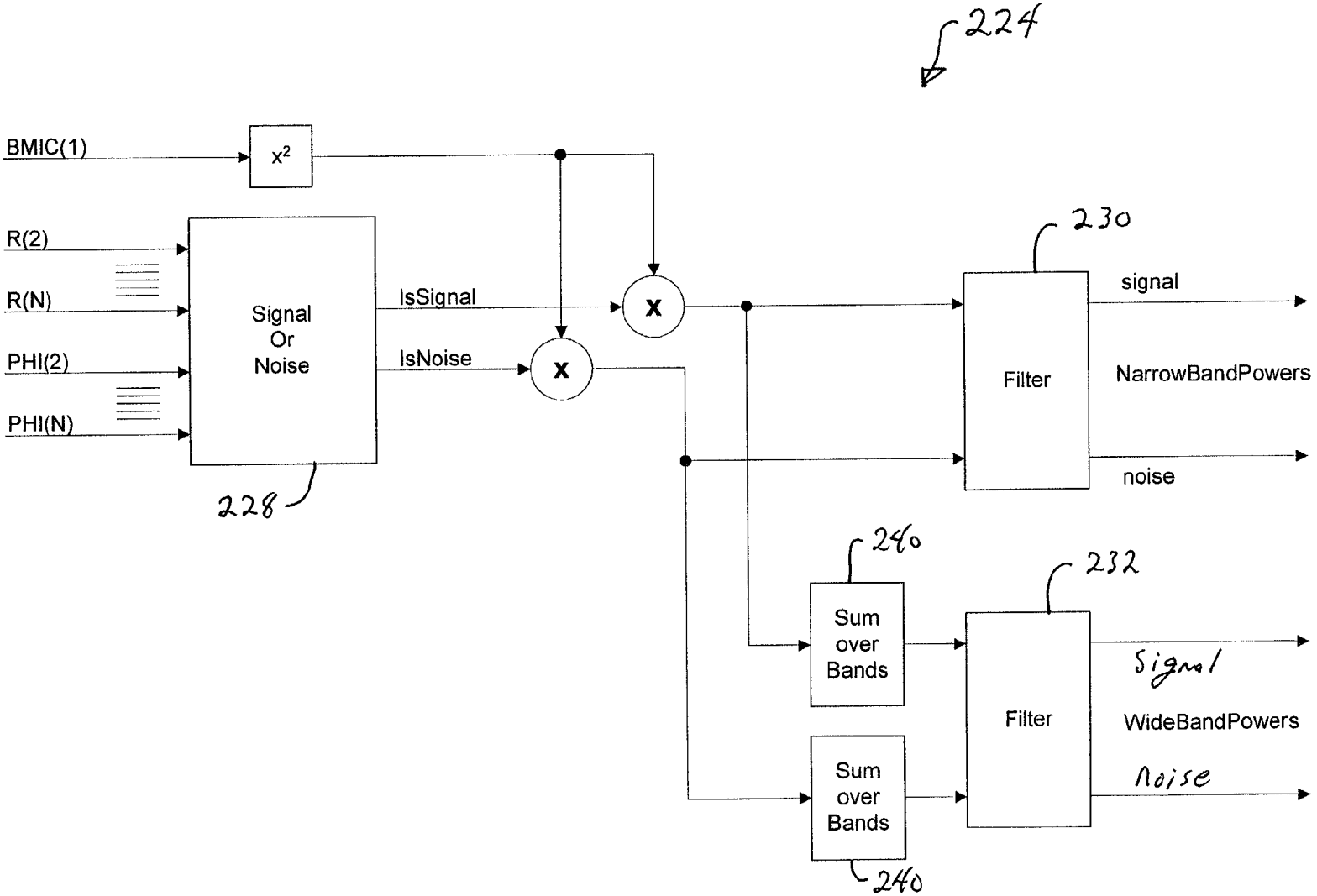
FIG. 33 is a block diagram of the statistical evaluator of FIG. 32.

Turning now to FIG. 33, a block diagram of the statistical evaluator 224 of FIG. 32 is shown. In a signal or noise analyzer 228, the power and phase inputs are evaluated. At each frequency band a decision is made as to whether the signal in the band carries utility signal or noise information. If the band carries signal information, then the corresponding part of the IsSignal signal is set to a logic one and the corresponding part of the IsNoise signal is set to a logic zero. If the signal carries noise, then IsSignal is set to a logic zero and IsNoise is set to a logic one.

The IsSignal and IsNoise switch signals are multiplied with the wave powers, that is, the squared wave amplitudes. The weighted signal and noise powers are low pass filtered in NarrowBand filter 230 to yield narrow band estimates of the signal and noise powers. The effective integration time of the filter 230 controls the speed of the measurement. It must be set large enough that inaccuracies in the wave parameter estimates are filtered out. The narrow band measurement may thus be relatively slow.

To obtain a faster measurement of the signal and noise powers may also be made with a coarser frequency resolution. The WideBandPowers output provides the same measurements as the NarrowBandPowers output with the exception that the measurement has been integrated over wide bands in sum over bands integrators 240 before being low pass filtered in WideBand filter 232. Due to the wide bandwidth the measurement may be performed at a faster rate, that is, a shorter integration time, and with a smaller delay than the narrow band measurement. Note that the dynamic characteristics of filters 230 and 232 control the update speed of the power signals. Therefore the filters will in general have different characteristics.

In an embodiment, the signal or noise analyzer 228 is based on the R(2) signal. If this signal is less than a predefined threshold, then the signal is judged to be utility signal and otherwise it is judged to be noise.

In another embodiment, there is an additional path that generates a second NarrowBandPowers signal. The two NarrowBandPowers are generated at two different update rates.

The near field gain function applier 226 of FIG. 32 provides the core functionality of the near field processing method. It maps a set of level ratios and optionally phase and signal power information into a gain. The gain should provide larger amplification for frequency bands containing mainly near field source material and smaller gain for frequency bands containing mainly far field source material.

In an embodiment, two microphones 12 of FIG. 1 are used. The microphones are placed at a given spacing close to the mouth of a user. The near field gain function applier 226 of FIG. 32 controls the gain in the frequency bands as a function of the ratio of the microphone powers in the bands as shown, for example, in the graph of FIG. 36*a*.

Figure 34:
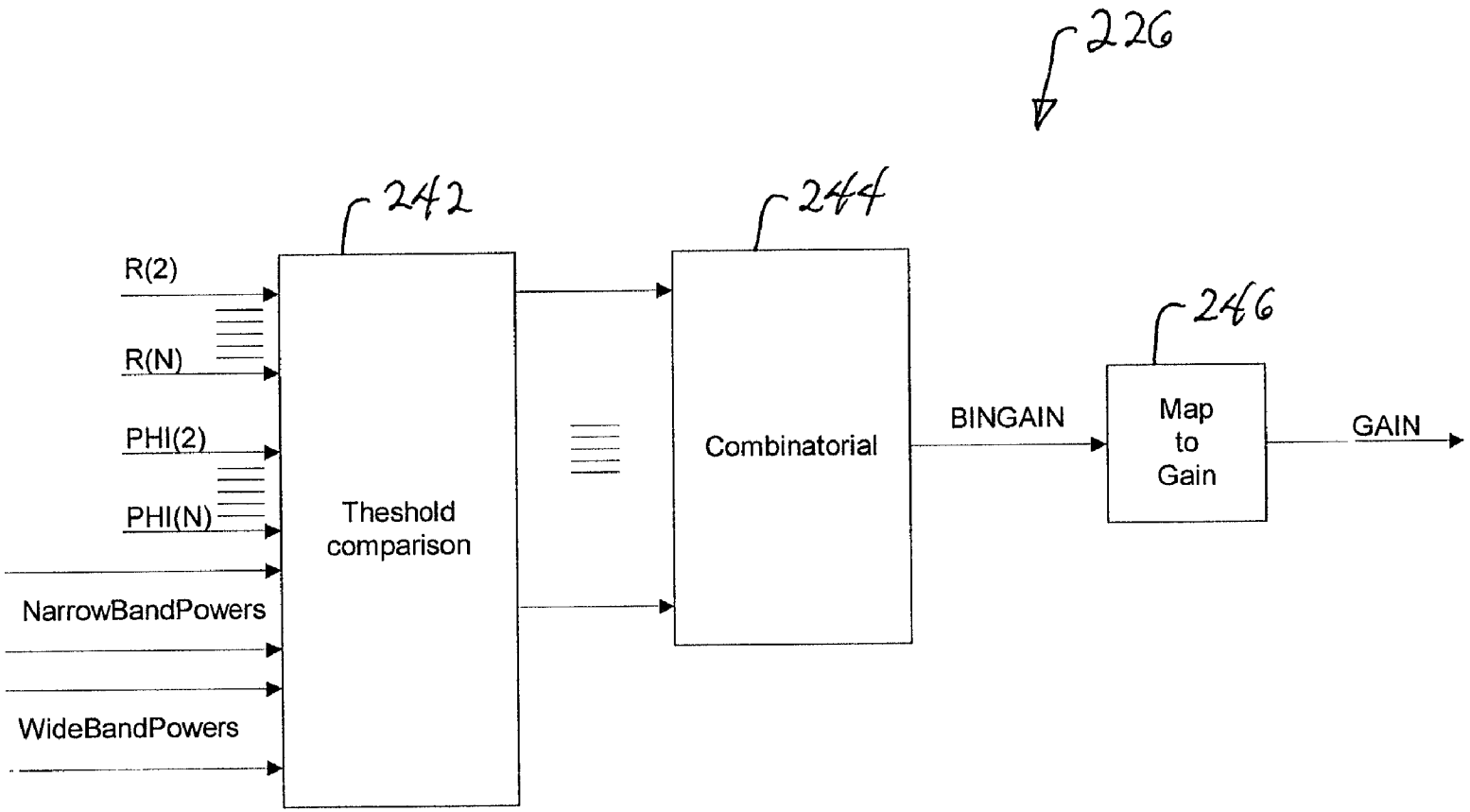
FIG. 34 is a block diagram of an embodiment of the near field gain function applier of FIG. 32.

Turning now to FIG. 34, a block diagram of an embodiment of the near field gain function applier 226 of FIG. 32 is shown. The near field gain function applier 226 includes a threshold comparer 242, a combinatorial unit 244, and a gain mapper 246. The threshold comparer 242 generates logic signals as defined in (34) below. The combinatorial unit 244 performs Boolean algebra on these logic signals to yield an output logic signal, BINGAIN, that indicates whether the respective frequency band should be assigned a high gain for signal or a low gain for noise. The gain mapper 246 maps the output logic signal to actual gain values according to (35) below.

$$\begin{cases} Rt(i,\ j) = (R(i) > mt(j))\ \ j = 1\ \ldots\ NR \\ PHIt(i,\ j) = (PHI(i) > \mathrm{pt}(j))\ \ j = 1\ \ldots\ NPHI \\ SNn(j) = (NarrowBandSignalPower > nt(j) * \\ NarrowBandNoisePower)\ \ j = 1\ \ldots\ Nnarrow \\ SNw(j) = (WideBandSignalPower > wt(j) * \\ WideBandNoisePower)\ \ j = 1\ \ldots\ Nwide \end{cases} \tag{34}$$

$$GAIN = \begin{vmatrix} MaxGain & \text{if } GINGAIN = 1 \\ MinGain & \text{if } BINGAIN = 0 \end{vmatrix} \tag{35}$$

In an embodiment, two microphones are used, no statistical evaluation is performed and neither is the signal phase evaluated, and a single magnitude threshold is implemented. In this case, the near field gain function can be written as in (36) below.

$$\begin{cases} Rt(2,\ 1) = (R(2) > mt(1)) \\ BINGAIN = NOT(Rt(2,\ 1) \\ GAIN = \begin{vmatrix} MaxGain & \text{if } GINGAIN = 1 \\ MinGain & \text{if } BINGAIN = 0 \end{vmatrix} \end{cases} \tag{36}$$

In a variation of the previous embodiment, the phase is evaluated as well. If the phase of the two microphone signals differs too much, then the band will probably contain energy from more than one source and thus be noisy, in which case, a small gain is assigned. Below, (37) shows the gain function for this situation.

$$\begin{cases} Rt(2,\ 1) = (R(2) > mt(1)) \\ PHIt(2,\ 1) = (PHI(2) > \mathrm{pt}(1)) \\ PHIt(2,\ 2) = (PHI(2) > \mathrm{pt}(2)) \\ BINGAIN = \\ NOT(Rt(2,\ 1))\ \text{AND}\ (PHIt(2,\ 1)\ \text{AND}\ (NOT(PHIt(2,\ 2)))) \\ GAIN = \begin{vmatrix} MaxGain & \text{if } BINGAIN = 1 \\ MinGain & \text{if } BINGAIN = 0 \end{vmatrix} \end{cases} \tag{37}$$

In another variation of the embodiment described above, the narrow band powers are evaluated. In this case, the gain function can be described with (38) below.

$$\begin{cases} Rt(2,\ 1) = (R(2) > mt(1)) \\ Rt(2,\ 2) = (R(2) > mt(2)) \\ PHIt(2,\ 1) = (PHI(2) > p1(1)) \\ PHIt(2,\ 2) = (PHI(2) > pt(2)) \\ SNn(1) = (NarrowBandSignalPower > \mathrm{nt}(1) * \\ NarrowBandNoisePower \\ BINGAIN = ((NOT(Rt(2,\ 1))\ \text{AND}\ SNn(1))\ \text{OR} \\ (NOT(Rt(2,\ 2))\ \text{AND NOT}\ (SNn(1))))\ \text{AND} \\ (PHIt(2,\ 1)\ \text{AND}\ (NOT(PHIt(2,\ 2)))) \\ GAIN = \begin{vmatrix} MaxGain & \text{if } BINGAIN = 1 \\ MinGain & \text{if } BINGAIN = 0 \end{vmatrix} \end{cases} \tag{38}$$

Figure 35:
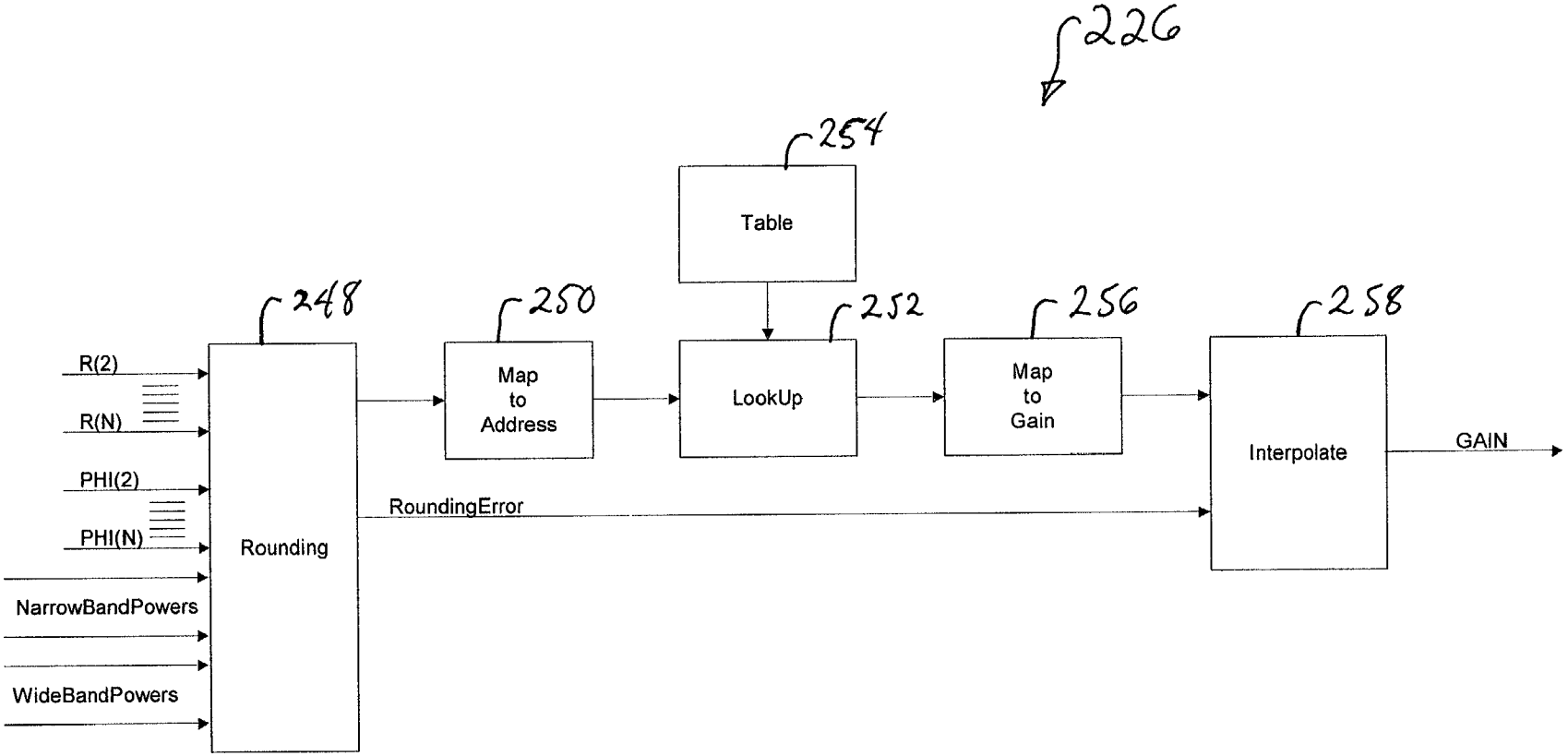
FIG. 35 is a block diagram of an embodiment of the near field gain function applier of FIG. 32 using a table look up implementation with subsequent approximation/interpolation.

Turning now to FIG. 35, a block diagram of an embodiment of the near field gain function applier 226 of FIG. 32 using a table look up implementation with subsequent approximation/interpolation is shown. First, the function inputs are rounded to a predefined precision by rounder 248. The rounded inputs are then mapped, by address mapper 250, to an integer space to yield an address. The address is used by look up 252 to look up in a pre-computed table 254. The table 254 may be stored on any storage device including RAM, ROM, hard disk, and the like. To save space, the table 254 may contain gain values in an encoded form. Thus a gain mapper 256 for mapping back to gain space may optionally be inserted as shown. Finally, an interpolator 258 is optionally provided to yield the raw gain output. To enable interpolator 258, the table 254 may contain parameter derivatives in addition to parameter values.

In a specific embodiment, the WidebandPowers are monitored. At good signal to noise ratios, all of the signals are passed through without attenuation. At poor signal to noise ratios, a near field characteristic is used.

Figure 36:
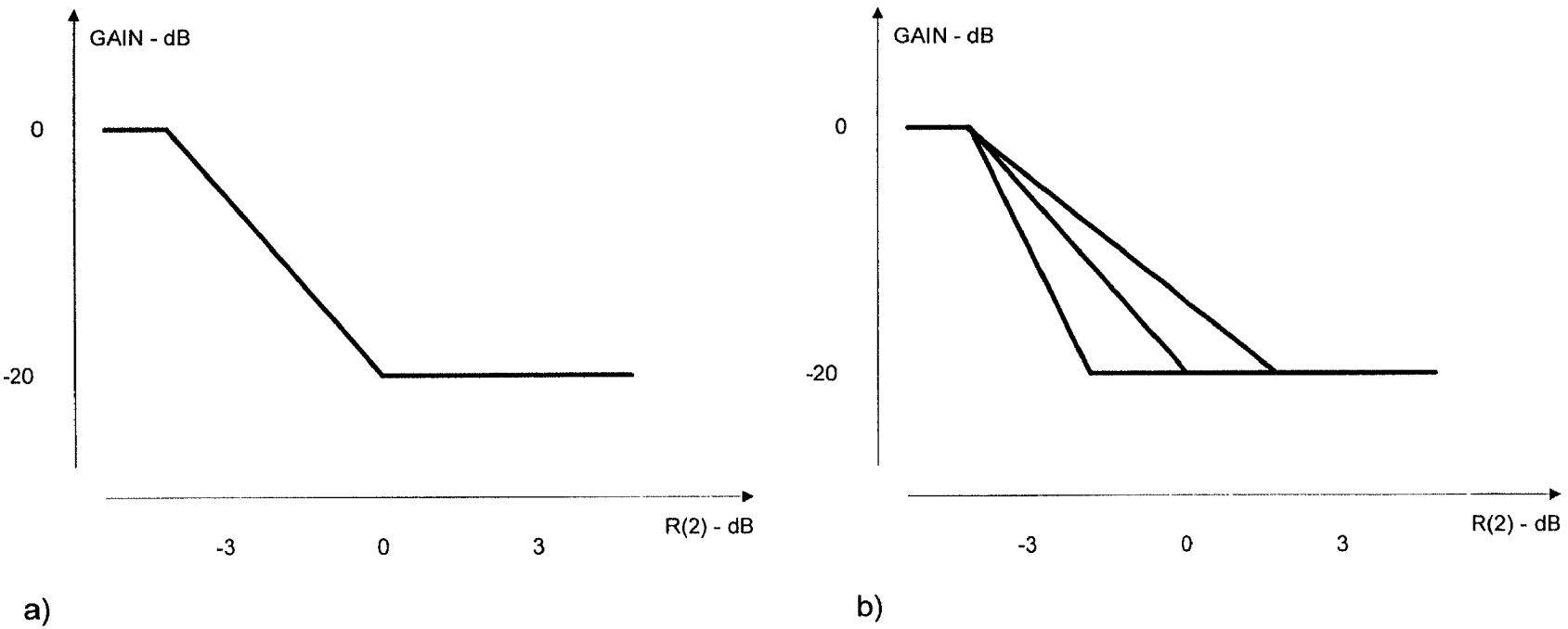
FIG. 36 is a pair of graphs of gain function of different widths.

In another embodiment, the NarrowBandPowers are monitored. Depending on the value of the signal to noise ratio, gain functions of different widths are chosen. For example, the gain function of different widths are shown in the graph of FIG. 36*b*.

In an embodiment, the wideband signal power is compared with the wideband noise power and two gain strategies are implemented, that is, both omni directional and directional. The omni directional strategy is chosen in all narrow frequency bands covered by wide bands where signal power is greater than a predefined constant times the noise power. In all other bands, the directional strategy is chosen.

Returning to FIG. 28, there are a number of embodiments of the filter 142 that are possible. In an embodiment, the filtering is performed in the time domain with a FIR or IIR filter. In another embodiment, the filtering is performed with a FFT based FIR filtering. In yet another embodiment, the filtering is performed with a time domain filterbank.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. An audio processor for a sound processing system comprising a plurality of microphones and an output device, wherein the plurality of microphones is configured to convert a wave into a plurality of electrical signals, the audio processor comprising:

a first analysis filter coupled to at least one microphone in the plurality of microphones, the first analysis filter being configured to filter at least one electrical signal in the plurality of electrical signals to provide a filtered electrical signal;

a wave parameter estimator coupled to the first analysis filter and the plurality of microphones, the wave parameter estimator being configured to analyze the filtered electrical signal and the plurality of electrical signals in first and second frequency sub-bands to provide first and second estimates of a parameter of the wave, the first estimate being associated with the first frequency sub-band and the second estimate being associated with the second frequency sub-band; and a forward filter coupled to the wave parameter estimator and at least one microphone in the plurality of microphones, the forward filter being configured to filter at least one electrical signal in the plurality of electrical signals, the forward filter having a response based on the first and second estimates.

2. The audio processor as defined in claim 1, wherein the first analysis filter is configured to perform differentiation with respect to time.

3. The audio processor as defined in claim 2, wherein the first analysis filter is configured to implement a difference equation to approximate differentiation with respect to time.

4. The audio processor as defined in claim 1, further comprising a second analysis filter, the second analysis filter being configured to filter at least one electrical signals in the plurality of electrical signals.

5. The audio processor as defined in claim 1, wherein the forward filter comprises a forward filter gain controller configured to generate at least a first gain for the first frequency sub-band as a function of the first and second estimates, the forward filter being configured to filter at least one electrical signal in the plurality of electrical signals according at least the first gain.

6. The audio processor as defined in claim 1, wherein the wave parameter estimator operates in the frequency domain.

7. The audio processor as defined in claim 1, wherein the wave parameter estimator operates in the time domain.

8. An audio processor for a sound processing system comprising a plurality of microphones and an output device, wherein the plurality of microphones is configured to convert a wave into a plurality of electrical signals, the audio processor comprising:

a wave parameter estimator coupled to the plurality of microphones and comprising an equation solver configured to perform a direct solving technique, wherein the wave parameter estimator is configured to analyze the plurality of electrical signals in first and second frequency sub-bands to provide first and second estimates of a parameter of the wave, the first estimate being associated with the first frequency sub-band and the second estimate being associated with the second frequency sub-band;

and a forward filter coupled to the wave parameter estimator and at least one microphone in the plurality of microphones, the forward filter being configured to filter at least one electrical signal in the plurality of electrical signals, the forward filter having a response that is based on the first and second estimates.

9. An audio processor for a sound processing system comprising a plurality of microphones and an output device, wherein the plurality of microphones is configured to convert a wave into a plurality of electrical signals, the audio processor comprising:

a wave parameter estimator coupled to the plurality of microphones, wherein the wave parameter estimator is configured to analyze the plurality of electrical signals in first and second frequency sub-bands to provide first and second estimates of a direction of the wave, the first estimate being associated with the first frequency sub-band and the second estimate being associated with the second frequency sub-band, the wave parameter estimator being configured to disregard amplitude information during generation of the first and second estimates of the direction of the wave;

and a forward filter coupled to at least one microphone in the plurality of microphones and the wave parameter estimator, the forward filter including a forward filter gain controller for generating at least a first gain for the first frequency sub-band as a function of the first and second estimates of the direction of the wave, wherein the forward filter filters least one of the plurality of electrical signals according to at least the first gain.

10. A method of audio signal processing for a system comprising a plurality of microphones and an output device, the method comprising:

converting a wave into a plurality of electrical signals;

filtering a first electrical signal in the plurality of electrical signals to provide a filtered electrical signal;

analyzing the plurality of electrical signals in first and second frequency sub-bands to provide first and second estimates of a parameter of the wave, the first estimate being associated with the first frequency sub-band and the second estimate being associated with the second frequency sub-band;

generating at least a first gain for the first frequency sub-band as a function of the first and second estimates;

and filtering at least one of the plurality of electrical signals according to at least the first gain.

11. The method as defined in claim 10, wherein the filtering the first electrical signal to provide the filtered electrical signal is performed through differentiation with respect to time.

12. The method as defined in claim 11, wherein the differentiation with respect to time is approximated using a difference equation.

13. The method as defined in claim 10, wherein one of the first and second estimates is a wave frequency estimate.

14. The method as defined in claim 10, wherein one of the first and second estimates is a wave amplitude estimate.

15. The method as defined in claim 10, wherein one of the first and second estimates is a direction of sound incidence estimate for the wave.

16. The method as defined in claim 10, wherein one of the first and second estimates is a wave damping estimate.

17. The method as defined in claim 10, wherein the analyzing the plurality of electrical signals is performed in the frequency domain.

18. The method as defined in claim 10, wherein the analyzing the plurality of electrical signals is performed in the time domain.

19. A method of audio signal processing for a system comprising a plurality of microphones and an output device, the method comprising:

converting a wave into a plurality of electrical signals;

analyzing, through the use of a direct solving technique, the plurality of electrical signals in first and second frequency sub-bands to provide first and second estimates of a direction of the wave, the first estimate being associated with the first frequency sub-band and the second estimate being associated with the second frequency sub-band;

generating at least a first gain for the first frequency sub-band as a function of the first and second estimates;

and filtering at least one of the plurality of electrical signals according to at least the first gain.

20. A method of audio signal processing for a system comprising two microphones and an output device, wherein the system senses a sound environment in at least a first frequency band and the sound environment has a wave with at least a first wave parameter, the method comprising:

generating at least a first set of wave parameter estimates for the at least a first frequency band of input signals characterizing the wave, wherein the at least a first set of wave parameter estimates includes a wave direction estimate that disregards amplitude information of the input signals;

generating at least a first gain for the at least a first frequency band as a function of the at least a first set of wave parameter estimates;

and filtering the input signals according to at least the first gain.

21. An audio processor for a sound processing system comprising a plurality of microphones and an output device, the audio processor comprising:

means for converting a wave into a plurality of electrical signals;

means for filtering a first electrical signal in the plurality of electrical signals to provide a filtered electrical signal;

means for analyzing the plurality of electrical signals in first and second frequency sub-bands to provide first and second estimates of a direction of the wave, the first estimate being associated with the first frequency sub-band and the second estimate being associated with the second frequency sub-band;

means for generating at least a first gain for the first frequency sub-band as a function of the first and second estimates;

and means for filtering at least one of the plurality of electrical signals according to at least the first gain.

22. An audio processor for a sound processing system comprising two microphones and an output device, wherein the sound processing system is configured to sense a sound environment in at least a first frequency band and the sound environment has a wave with at least a first wave parameter, the audio processor comprising:

means for generating at least a first set of wave parameter estimates for the at least a first frequency band of input signals characterizing the wave, wherein the at least a first set of wave parameter estimates includes a wave direction estimate that disregards amplitude information of the input signals;

means for generating at least a first gain for the at least a first frequency band as a function of the at least a first set of wave parameter estimates;

and means for filtering the input signals according to at least the first gain.

23. A hearing aid comprising:

a plurality of microphones configured to convert a wave into a plurality of electrical signals;

a first filter coupled to at least one microphone in the plurality of microphones, the first filter being configured to filter at least one electrical signal in the plurality of electrical signals to provide a filtered electrical signal;

a wave parameter estimator coupled to the first filter and the plurality of microphones, the wave parameter estimator being configured to analyze the filtered electrical signal and the plurality of electrical signals in first and second frequency sub-bands to provide first and second estimates of a parameter of the wave, the first estimate being associated with the first frequency sub-band and the second estimate being associated with the second frequency sub-band;

a second filter coupled to the wave parameter estimator and configured to filter at least one electrical signal in the plurality of electrical signals, the second filter having a response that is based on the first and second parameters of the wave.

24. A method comprising:

converting a wave into a plurality of electrical signals;

filtering at least one electrical signal in the plurality of electrical signals to provide a filtered electrical signal;

analyzing the filtered electrical signal and the plurality of electrical signals in first and second frequency sub-bands to provide first and second estimates of a parameter of the wave, the first estimate being associated with the first frequency sub-band and the second estimate being associated with the second frequency sub-band;

filtering at least one electrical signal in the plurality of electrical signals based on the first and second parameters of the wave.

* * * * *